US007106350B2

(12) United States Patent
Baba et al.

(10) Patent No.: US 7,106,350 B2
(45) Date of Patent: Sep. 12, 2006

(54) DISPLAY METHOD FOR LIQUID CRYSTAL DISPLAY DEVICE

(75) Inventors: Masahiro Baba, Yokohama (JP); Goh Itoh, Yokohama (JP); Hitoshi Kobayashi, Yokohama (JP); Haruhiko Okumura, Fujisawa (JP); Hajime Yamaguchi, Yokohama (JP); Rei Hasegawa, Yokohama (JP)

(73) Assignee: Kabushiki Kaisha Toshiba, Kawasaki (JP)

( * ) Notice: Subject to any disclaimer, the term of this patent is extended or adjusted under 35 U.S.C. 154(b) by 686 days.

(21) Appl. No.: 09/899,220

(22) Filed: Jul. 6, 2001

(65) Prior Publication Data

US 2002/0003522 A1 Jan. 10, 2002

(30) Foreign Application Priority Data

Jul. 7, 2000 (JP) ..... 2000-207061
Jul. 28, 2000 (JP) ..... 2000-228934
Jul. 31, 2000 (JP) ..... 2000-231869

(51) Int. Cl.
*G09G 5/10* (2006.01)

(52) U.S. Cl. ..... 345/691; 345/89

(58) Field of Classification Search ..... 345/98–100, 345/87, 94, 211–213, 102, 58, 89, 690, 691, 345/692

See application file for complete search history.

(56) References Cited

U.S. PATENT DOCUMENTS 4,907,862 A * 3/1990 Suntola ..... 349/61
5,117,224 A * 5/1992 Kawamura et al. ..... 345/88
5,248,965 A * 9/1993 Yoshimitsu ..... 345/211
5,912,651 A * 6/1999 Bitzakidis et al. ..... 345/58
6,115,016 A * 9/2000 Yoshihara et al. ..... 345/88
6,151,004 A * 11/2000 Kaneko ..... 345/88
6,175,355 B1 * 1/2001 Reddy ..... 345/691
6,339,422 B1 * 1/2002 Kuwajima et al. ..... 345/204
6,362,835 B1 * 3/2002 Urbanus et al. ..... 345/692
6,377,236 B1 * 4/2002 Karamoto ..... 345/102
6,392,620 B1 * 5/2002 Mizutani et al. ..... 345/88
6,429,839 B1 * 8/2002 Sakamoto ..... 345/87
6,473,077 B1 * 10/2002 Takenaka et al. ..... 345/209
6,473,092 B1 * 10/2002 Sojourner ..... 345/589
6,597,372 B1 * 7/2003 Huang ..... 345/691
6,750,874 B1 * 6/2004 Kim ..... 345/600
6,795,053 B1 * 9/2004 Funamoto et al. ..... 345/102
2003/0011614 A1 * 1/2003 Itoh et al. ..... 345/589

FOREIGN PATENT DOCUMENTS

EP 525976 A2 * 2/1993
JP 60-125891 7/1985
JP 2-210985 8/1990
JP 3-125333 12/1991
JP 4-204628 7/1992
JP 4-309995 11/1992
JP 5-257124 10/1993
JP 6-102484 4/1994
JP 6-160811 6/1994
JP 9-244548 9/1997
JP 9-325715 12/1997
JP 10-91118 4/1998

(Continued)

*Primary Examiner*—Bipin Shalwala
*Assistant Examiner*—Tom Sheng
(74) *Attorney, Agent, or Firm*—Oblon, Spivak, McClelland, Maier & Neustadt, P.C.

(57) ABSTRACT

A liquid crystal display method to display an image according to an image signal, comprises changing a ratio of a display period and a non-display period of the image according to the image signal.

16 Claims, 41 Drawing Sheets

FOREIGN PATENT DOCUMENTS

| | | |
|---|---|---|
| JP | 10-319895 | 12/1998 |
| JP | 11-109317 | 4/1999 |
| JP | 2000-122596 | 4/2000 |
| JP | 2001-27890 | 1/2001 |

* cited by examiner

STV

Output enable signal
OFF
ON
Signal is turned off with high voltage, and turned on with low voltage Vclk Voltage waveform of first scanning line Voltage waveform of second scanning line Voltage waveform of scanning line when output is turned off by output enable signal Voltage waveform of scanning line when output is turned on by output enable signal
Time

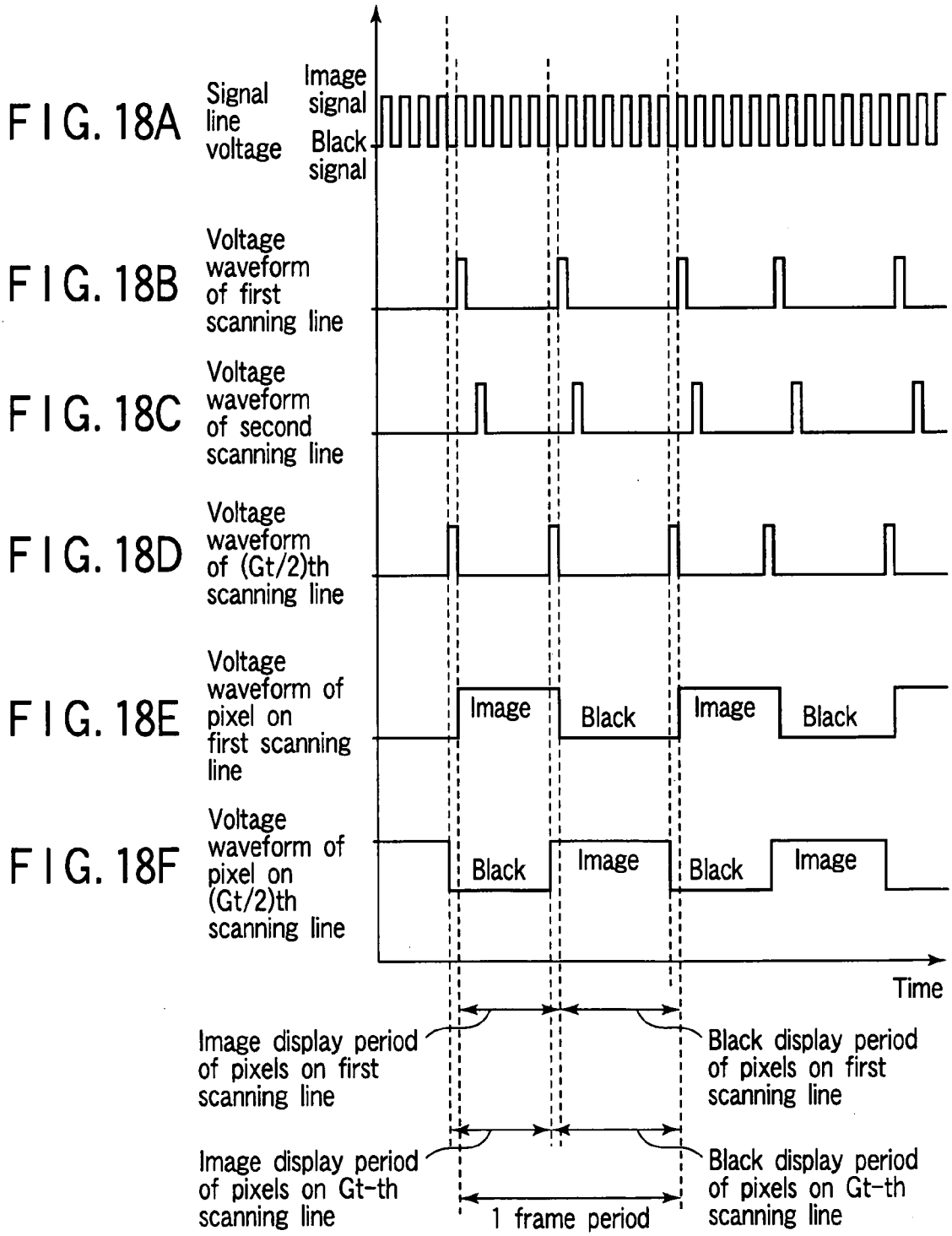
FIG. 18A
Signal line voltage
Image signal
Black signal
FIG. 18B
Voltage waveform of first scanning line
FIG. 18C
Voltage waveform of second scanning line
FIG. 18D
Voltage waveform of (Gt/2)th scanning line
FIG. 18E
Voltage waveform of pixel on first scanning line
Image
Black
Image
Black
FIG. 18F
Voltage waveform of pixel on (Gt/2)th scanning line
Black
Image
Black
Image
Time
Image display period of pixels on first scanning line
Black display period of pixels on first scanning line
Image display period of pixels on Gt-th scanning line
Black display period of pixels on Gt-th scanning line
1 frame period

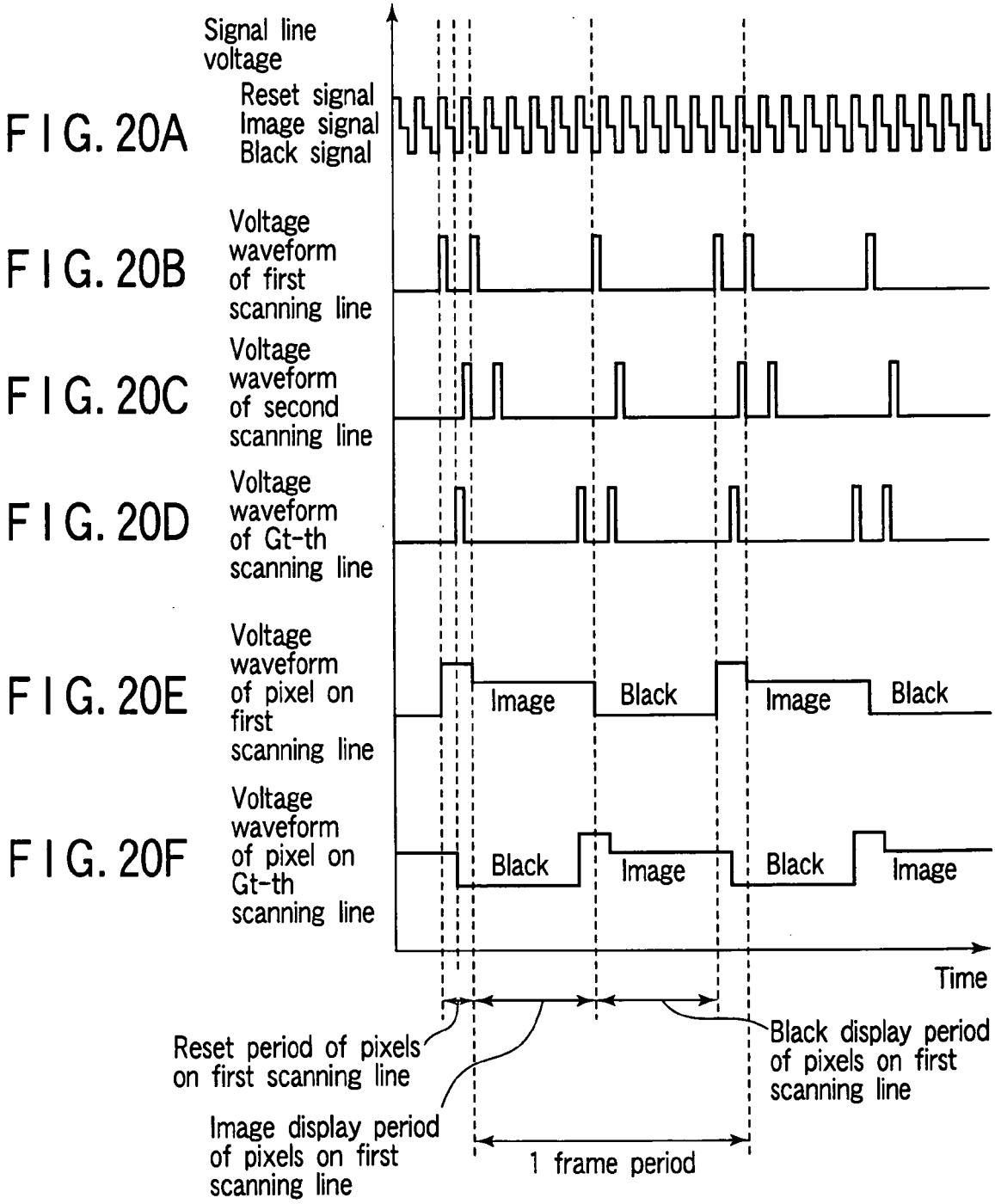
FIG. 20A
Signal line voltage
Reset signal
Image signal
Black signal
FIG. 20B
Voltage waveform of first scanning line
FIG. 20C
Voltage waveform of second scanning line
FIG. 20D
Voltage waveform of Gt-th scanning line
FIG. 20E
Voltage waveform of pixel on first scanning line
Image
Black
Image
Black
FIG. 20F
Voltage waveform of pixel on Gt-th scanning line
Black
Image
Black
Image
Time
Reset period of pixels on first scanning line
Image display period of pixels on first scanning line
Black display period of pixels on first scanning line
1 frame period

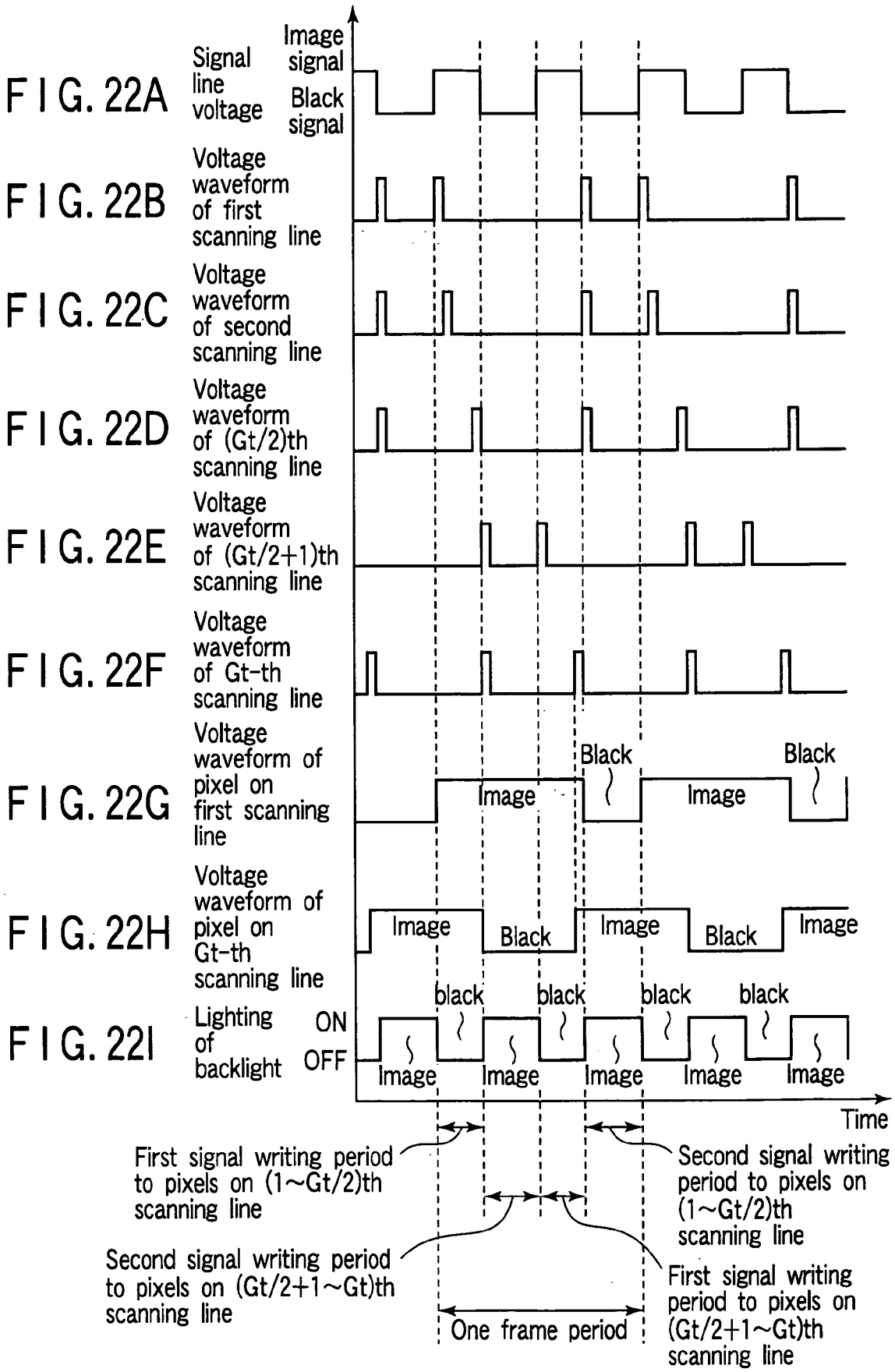
FIG. 22A
Signal line voltage
Image signal
Black signal
FIG. 22B
Voltage waveform of first scanning line
FIG. 22C
Voltage waveform of second scanning line
FIG. 22D
Voltage waveform of (Gt/2)th scanning line
FIG. 22E
Voltage waveform of (Gt/2+1)th scanning line
FIG. 22F
Voltage waveform of Gt-th scanning line
FIG. 22G
Voltage waveform of pixel on first scanning line
Black
Image
Black
Image
FIG. 22H
Voltage waveform of pixel on Gt-th scanning line
Image
Black
Image
Black
Image
FIG. 22I
Lighting of backlight
ON
OFF
black
black
black
black
Image
Image
Image
Image
Image
Time
First signal writing period to pixels on (1~Gt/2)th scanning line
Second signal writing period to pixels on (1~Gt/2)th scanning line
Second signal writing period to pixels on (Gt/2+1~Gt)th scanning line
First signal writing period to pixels on (Gt/2+1~Gt)th scanning line
One frame period

FIG. 23A

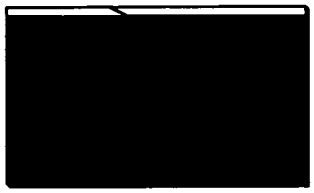

〈First sub-field〉

〈Writing first signal to pixels on first to Gt/2-th scanning lines〉

〈black display for backlight OFF〉

FIG. 23B

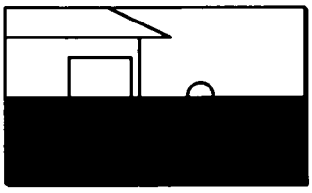

〈Second sub-field〉

〈Writing end of first signal to pixels on first to Gt/2-th scanning lines〉

〈Writing black display signal to pixels on (Gt/2+1)th to Gt-th scanning lines〉

〈Backlight is turned on and imaged is displayed〉

FIG. 23C

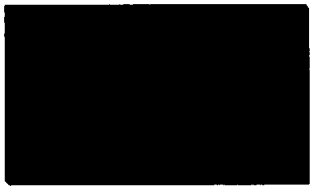

〈Third sub-field〉

〈Writing first signal to pixel on (Gt/2+1)th to Gt-th scanning lines〉

〈black display for backlight OFF〉

FIG. 23D

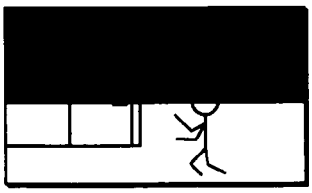

〈Fourth sub-field〉

〈Writing end of first signal to pixels on (Gt/2+1)th to Gt-th scanning lines〉

〈Writing black display signal to pixels on first to Gt/2-th scanning lines〉

〈Backlight is turned on and imaged is displayed〉

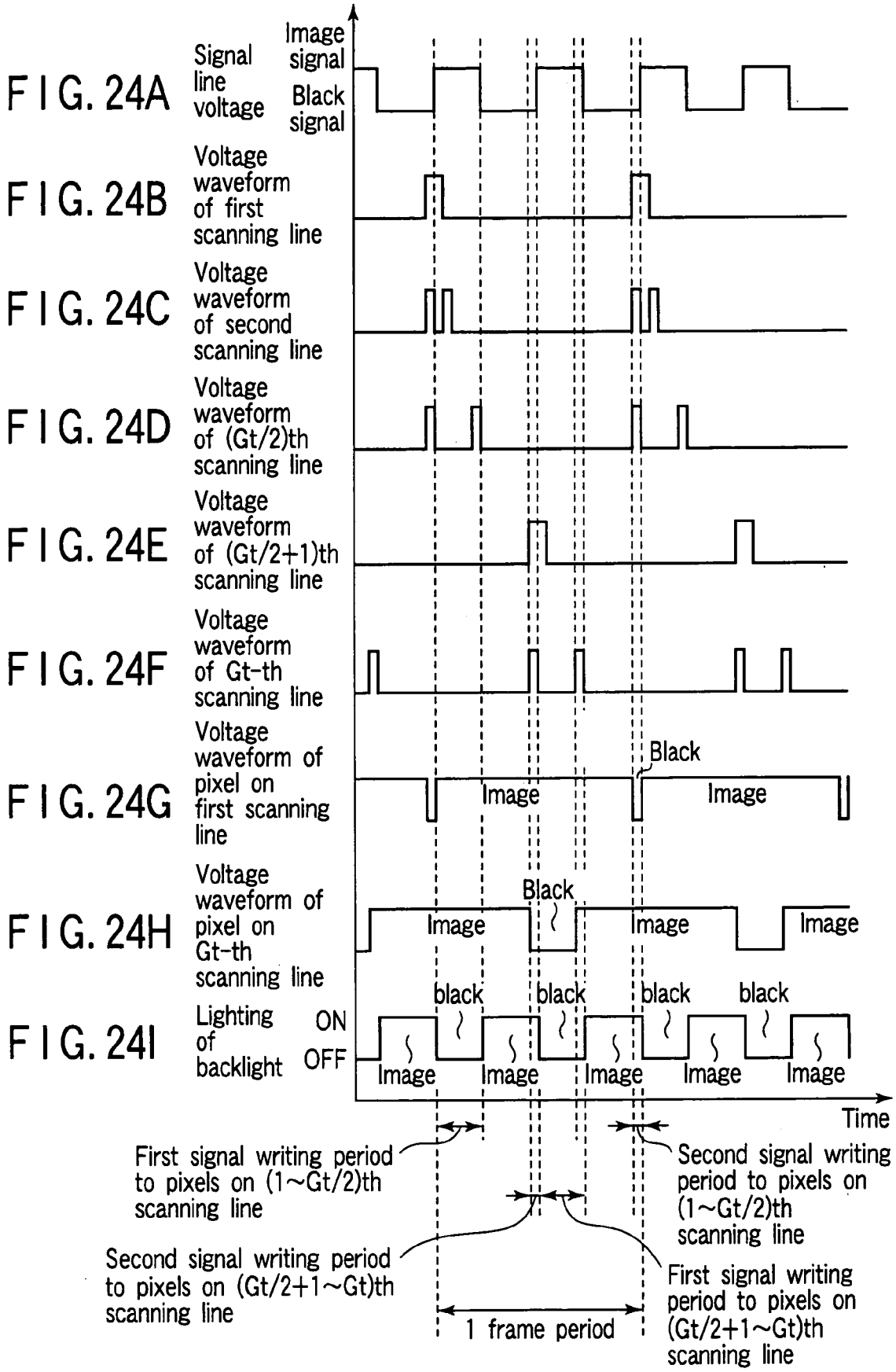
FIG. 24A
Signal line voltage
Image signal
Black signal
FIG. 24B
Voltage waveform of first scanning line
FIG. 24C
Voltage waveform of second scanning line
FIG. 24D
Voltage waveform of (Gt/2)th scanning line
FIG. 24E
Voltage waveform of (Gt/2+1)th scanning line
FIG. 24F
Voltage waveform of Gt-th scanning line
FIG. 24G
Voltage waveform of pixel on first scanning line
Black
Image
Image
FIG. 24H
Voltage waveform of pixel on Gt-th scanning line
Black
Image
Image
Image
FIG. 24I
Lighting of backlight
ON
OFF
black
black
black
black
Image
Image
Image
Image
Image
Time
First signal writing period to pixels on (1~Gt/2)th scanning line
Second signal writing period to pixels on (1~Gt/2)th scanning line
Second signal writing period to pixels on (Gt/2+1~Gt)th scanning line
First signal writing period to pixels on (Gt/2+1~Gt)th scanning line
1 frame period

FIG. 25A

<First sub-field>

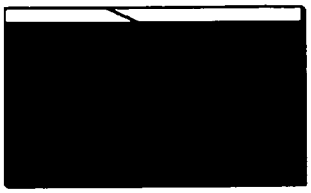

<Writing first signal to pixels on first to Gt/2-th scanning lines>

<Black display for backlight OFF>

FIG. 25B

<Second sub-field>

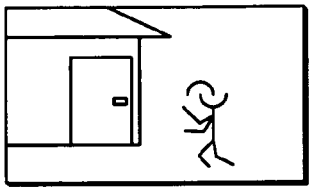

<Writing end of first signal to pixels on first to Gt/2-th scanning lines>

<Image is displayed by turning on backlight>

<There is a slight time gap between image on (Gt/2+1)th to Gt-th scanning lines and image on first to Gt/2-th scanning lines because image on (Gt/2+1)th to Gt-th scanning lines is at previous frame image>

FIG. 25C

<Third sub-field>

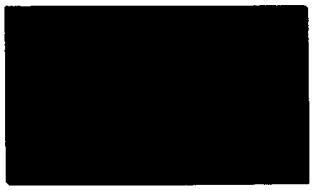

<Writing first signal to pixel on (Gt/2+1)th to Gt-th scanning lines>

<Black display for backlight OFF>

FIG. 25D

<Fourth sub-field>

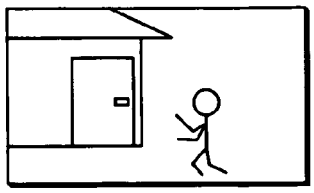

<Writing end of first signal to pixels on (Gt/2+1)th to Gt-th scanning lines>

<Backlight is turned on and imaged is displayed>

<There is no time gap between image on (Gt/2+1)th to Gt-th scanning lines and image on first to Gt/2-th scanning lines because image on (Gt/2+1)th to Gt-th scanning lines is at same frame image as on first to Gt/2-th scanning lines>

First alignment

Second alignment

FIG. 37A

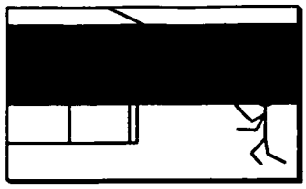

⟨Writing of First scanning line; signal is + polarity⟩

First scanning line is in first and can be written in + polarity.
Image of previous field remains at lower side of screen

FIG. 37B

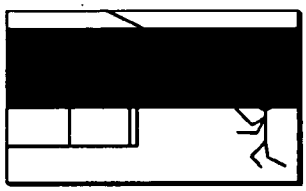

⟨Writing of Second scanning line; signal is - polarity⟩

Second scanning line is in second and can be written in - polarity

Time

FIG. 37C

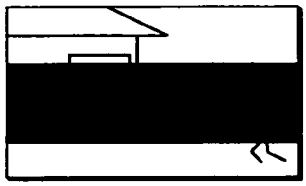

FIG. 37D

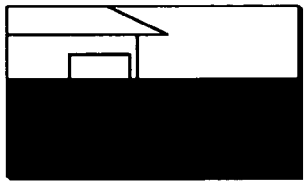

⟨Writing of (T/2-1)th scanning line; signal is + polarity⟩

End of writing to upper half

FIG. 37E

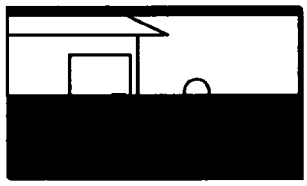

⟨Writing of T/2-th scanning line; signal is - polarity⟩

First scanning line is turned on at same time.
T/2-th scanning line is written in - polarity, and first scanning line is erased by - polarity

FIG. 37F

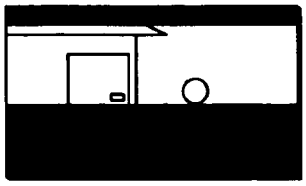

⟨Writing of (T/2+1)th scanning line; signal is + polarity⟩

Second scanning line is turned on at same time.
(T/2+1)th scanning line is written in + polarity, and second scanning line is erased by + polarity

FIG. 37G

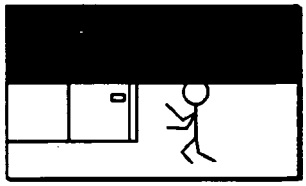

⟨Writing of T-th scanning line; signal is - polarity⟩

(T/2+1)th scanning line is turned on at same time.
Upper half of screen is erased ⟨Writing of First scanning line; signal is + polarity⟩

Image of previous field remains at lower quarter of screen

Time

⟨Writing of (T/4-1)th scanning line; signal is + polarity⟩

Upper quarter of screen is displayed

⟨Writing of T/4-th scanning line; signal is - polarity⟩

First scanning line is erased

DISPLAY METHOD FOR LIQUID CRYSTAL DISPLAY DEVICE

CROSS-REFERENCE TO RELATED APPLICATIONS

This application is based upon and claims the benefit of priority from the prior Japanese Patent Applications No. 2000-207061, filed Jul. 7, 2000; No. 2000-228934, filed Jul. 28, 2000; and No. 2000-231869, filed Jul. 31, 2000, the entire contents of all of which are incorporated herein by reference.

BACKGROUND OF THE INVENTION

1. Field of the Invention

The present invention relates to a display method of a liquid crystal display device.

2. Description of the Related Art

In recent years, a performance of a liquid crystal display (hereinafter, called as an "LCD") has been improved, and the LCD begins to spread to the conventional television field where a cathode ray tube (hereinafter, called as a "CRT") is chiefly used.

The LCD uses transistors as a select switch for each pixel, and adopts a display method (hereinafter, called as a "hold-type display"), in which a displayed image is held for 1 frame period. In contrast, in CRT, a display method (hereinafter, called as an "impulse-type display"), in which a selected pixel is darkened immediately after the selection period of the pixel, is adopted. Thus, the LCD is different from CRT in time axis characteristic in an image display. Therefore, when the motion image is displayed, image deterioration such as blurring the image etc. is caused. This reason will be easily explained.

When an observer follows and observes the moving object of the motion image (when the eyeball movement of the observer is a following motion), even if the image is rewritten, for example, in 60 Hz, the eyeball has a characteristic to smoothly follow the moving object.

The black is displayed between each frame of the motion image rewritten in 60 Hz in case of the impulse-type display like the CRT. That is, the black is displayed excluding a period when the image is displayed, and 1 frame of the motion image is presented respectively to the observer as an independent image. Therefore, the image is observed as a clear motion image in the impulse-type display.

However, in the hold-type display, the displayed image of 1 frame of the motion image is held for 1 frame period, and is presented to the observer during the corresponding period as a still image. Therefore, even though the eyeball of the observer smoothly follows the moving object, the displayed image stands still for 1 frame period as shown in FIG. 1A. Therefore, the shifted image is presented according to the speed of the moving object on the retina of the observer as shown in FIG. 1B. Accordingly, since the observer perceives the image with which the shifted images are overlapped, an impression that the motion image is obscure is given to the observer. In a word, a sharpness of the motion image is lost. In addition, since the deviation between the images presented on the retina of the observer becomes large when the velocity of the motion image becomes large, the impression that the image is more obscure is given.

On the other hand, there is a white brightness as a factor to decide the picture quality of the motion image besides the factors as mentioned above.

In the CRT, the amount of the current flowing to the electron gun is controlled according to the average brightness level of the image signal of 1 frame (hereinafter, called as an "APL"). This reason is as follows. A disadvantage such that a load of a high-voltage circuit becomes too large occurs when a high-voltage current is flown to the electron gun according to the image signal in case of a high APL image (i.e., bright image on the entire screen). Therefore, the CRT comprises a circuit (hereinafter, called as an "ABL circuit"), which automatically controls brightness corresponding to the APL and a circuit (hereinafter, called as an "ACL circuit"), which automatically controls the contrast ratio.

For example, when the image signal with the high APL is displayed on the CRT, the amount of the current flowing to the electron gun is limited by an operation of the ABL circuit. Thereby, the brightness of the entire screen lowers. However, the ACL circuit operates at this time, the contrast of the image signal is increased, and a dark part is displayed more darkly. Since a relative contrast becomes high in spite of lowering the brightness of the entire screen, a high dynamic range image can be obtained with such a processing. In contrast, when the image signal with the low APL is displayed, the punched-up image with high contrast can be similarly obtained since the brightness of a bright image area becomes large.

On the other hand, in the LCD, it is preferable to reduce the impulse rate (ratio of which the image is displayed for 1 frame period), when only a priority is given to a sharpness of the motion image. However, when the impulse rate is reduced, the white brightness is insufficient. Therefore, the contrast ratio lowers due to insufficiency of the white brightness and the reality of the motion image lowers when the image with the high APL is displayed. For example, if the brightness of the backlight is raised to supplement insufficiency of the white brightness, oppositely, the entire screen becomes whitish when APL is low and the image is dark.

As described above, the picture quality of the motion image is decided by a sharpness of the displayed motion image and white brightness. However, there is a disadvantage that the image becomes obscure when the motion image is displayed, and the sharpness is lost in the conventional liquid crystal display device. To solve such a disadvantage, when reducing the ratio of the display period of the image, that is, the ratio of the black display period is enlarged, there is a disadvantage that the power of the motion image lowers because of the decrease in dynamic range due to the white brightness insufficiency.

To cancel the blurring phenomenon, the field inversion method is proposed (see Japanese Patent Application KOKAI Publication No. 2000-10076). This is a method of controlling the transmitting of the light in an analog fashion in one polarity, using the operation characteristic of the monostable liquid crystal material which does not transmit the light in the other polarity, dividing 1 frame into two fields, that is, first and second fields, transmitting the light in the first field, and not transmitting the light in the second field. A display device of the liquid crystal panel using a bent-alignment cell is proposed (see, Japanese Patent Application KOKAI Publication No. 11-109921). A display method in each proposal is close to the impulse display by providing an image display period and the black display period.

However, in the field inversion method, display duty is just only 50%, since the application time of the voltage to two poles is equal so that the DC component should not remain in the liquid crystal material. The display duty is defined by the following equation.

$$\text{display duty}=\text{display period}/(\text{display period}+\text{non-display period})\times 100 \quad (1)$$

In addition, a crosstalk is occurred easily in the field inversion method.

In a method of dividing the field, it is necessary to increase the number of screen dividings to change the display duty. Therefore, an irregular display (brightness change like the tie suiting) occurs by the difference of the signal line driving circuit. Since it is necessary to change the scanning line driving frequency in order to change the display duty, it is more difficult to set the display duty in detail. Therefore, the high quality display cannot be obtained according to the display image.

There are many liquid crystal display devices in which the number of gray-scales of each color of RGB (R=red, G=green, B=blue) to express the color. However, a large number of display colors, such as eight bits, ten bits, come to be required in the future. Therefore, the number of colors is increased by using a frame rate control (hereinafter, called as an "FRC") technology, which displays two or more times for 1 frame period. However, in inventors experiment, even if the number of colors is reduced in the motion image from the number of colors in the still image, it is partly confirmed not to be able to recognize the difference so much.

When all pixels in the display area are the same alignment (for example, a first alignment), 1 frame is divided into two fields, writing by +polarity is performed in the field of the first half and erasure by −polarity is performed in the field of the latter half to perform the exchange drive. In this case, one scanning line period is a half of conventional ones by dividing 1 frame into two fields. The writing insufficiency might be occurred, and the contrast might be lowered.

BRIEF SUMMARY OF THE INVENTION

An object of the present invention is to provide a liquid crystal display method to improve the picture quality, especially, when the motion image is displayed.

A liquid crystal display method to display an image according to an image signal, according to the embodiment of the present invention is characterized by comprising changing a ratio of a display period and a non-display period of the image according to the image signal.

The preferred manners of the present invention are as follows. Each undermentioned manner may be solely applied or may be applied by combining then with each other.

(1) Steps of detecting a maximum brightness level of the image signal; changing a ratio of a display period and a non-display period of the image according to the detected maximum brightness level; and changing a gray-scale of the image signal based on the ratio of the display period and the non-display period of the image according to the image signal are further provided.

(2) The step of changing the ratio of the display period and the non-display period of the image includes changing a ratio of a lightening period and a non-lightening period of a light part, which lightens the liquid crystal panel from back side.

(3) The step of changing the ratio of the lightening period and the non-lightening period of the light part includes changing a lightening or no-lightening of a backlight provided on a back side of the liquid crystal panel.

(4) The step of changing the ratio of the lightening period and the non-lightening period of the light part includes changing a transmittance or no-transmittance of a shutter element provided on the backlight or on a front side of the liquid crystal panel.

(5) The step of changing the ratio of the display period and the non-display period of the image includes changing a ratio of a period when the image display signal, which corresponds to the image signal is supplied and a period when the black display signal is supplied to the liquid crystal panel.

(6) The step of changing the ratio of the display period and the non-display period of the image includes: a first step of supplying first to m-th (m is an integer of two or more) signals to a signal line; and a second step of displaying an image on a liquid crystal panel based on the first to m-th signals to a pixel, and the first step includes: supplying the second to m-th signals to the signal lien n times (n is an integer of two or more), for a period until the first signal is written again after the first signal is written to a same pixel, and the second step includes: selecting k-th (k is an integer from one or more to n or less) the second to m-th signal; and writing it to the pixel.

(7) In (6), the first to m-th signals are supplied to the signal line continuously, periodically and repeatedly.

(8) In (7), the first signal is an image signal to display the image, and the second signal is a reset signal.

(9) In (7), the first signal is an image signal to display the image, and the second signal is a black display signal.

(10) In (7), the first signal is an image signal to display the image and the second signal is a gray-scale offset signal.

(11) In (6), (7), or (8), the signal line driving circuit supplies the image signal for p gray-scales (p is an integer of two or more), the first signal and the second signal are image signals to display the image for p gray-scales, respectively, a multi gray-scale display method that 2p gray-scale display is performed is used over 1 frame period when a still image is displayed, and a high refreshing rate display method is used by displaying the image with the time difference when a motion image is displayed.

(12) Steps of deciding whether a frame image is a motion image or a still image based on the image signal and the synchronizing signal; and changing the ratio of the display period and the no-display period of the image based on the decision result are further provided.

(13) The step of changing the ratio of the display period and the no-display period of the image includes dividing the image signal of 1 frame into a plurality of areas and changing the ratio of the display period and the no-display period of each of the plurality of areas.

(14) In (2), the step of detecting a maximum brightness level of the image signal includes dividing 1 frame of the image signal into a plurality of areas and detecting a maximum brightness level of the image signal in each of the plurality of areas.

(15) The liquid crystal display device has a scanning line, a plurality of pixels formed on an intersection with the signal line formed to intersect with the scanning line is arranged in a matrix, the pixel is a first pixel which changes the transmitting light according to an image signal of a first polarity and shield a light by an image signal of a second polarity or a second pixel which changes the transmitting light according to an image signal of a second polarity and shield a light by an image signal of a first polarity, either one of the first pixel or the second pixel is arranged along a direction of the scanning line, the first pixel and the second pixel alternately are arranged to directional of the signal line, and the image is written by applying the image signal of the first polarity to the first pixel, and applying the image signal of the second polarity to the second pixel.

(16) In (15), one of the image signal of the first polarity and the image signal of the second polarity is applied to the first pixel and the second pixel connected with one of the signal line at the same time.

(17) In (13), the image signal of the first polarity is a writing signal of the first pixel and an erase signal of the second pixel; and the image signal of the second polarity is an erase signal of the first pixel and a writing signal of the second the pixel.

According to the present invention, since a ratio of the lightening period and non-lightening period or a ratio of the period when the image display signal is supplied and the period when the black display signal is supplied is changed according to the maximum brightness level, a ratio of the image display period and the black display period is changed according to the maximum brightness level. Therefore, when the maximum brightness level is high, that is, when the image is bright, the white brightness can be enhanced by lengthening the image display period (shortening the black display period). Oppositely, when the maximum brightness level is low, that is, when the image is dark, it is possible for the observation person to visually observe the motion image with sharp and low blurring by shortening the image display period (lengthening the black display period). As a result, the sharpened motion image, in which a dynamic range is wide and the picture quality deterioration is a little can be presented to the observer.

As described above, according to the present invention, since the ratio of the image display period and the black display period can be changed according to the maximum brightness level, it becomes possible to present the motion image that the dynamic range is wide and the image deterioration is few, to the observation person.

According to the present invention, the picture quality can be greatly improved by raising the driving frequency of the signal line driving circuit as a display method of the liquid crystal panel which uses the high-speed response liquid crystal. More specifically, the high picture quality which improves the color reproducibility in a still image, and improves the sharpness in the motion image is displayed by using means to change display duty of image display and black display according to display image (still image and motion image), or, the means of the high refreshing display which uses the multi gray-scale display in a still image which uses FRC and the interpolation image in the motion image In addition, generation of crosstalk can be prevented as much as possible. Even if writing that the polarity is different is performed, lowering of the contrast can be prevent as much as possible.

BRIEF DESCRIPTION OF THE SEVERAL VIEWS OF THE DRAWING

FIG. 18A to FIG. 18F are signal waveform charts to explain an operation of the third embodiment;

FIG. 20A to FIG. 20F are signal waveform charts to explain an operation of the fourth embodiment of the present invention;

FIG. 22A to FIG. 22I are signal waveform charts to explain an operation of a driving method according to the fifth embodiment of the present invention;

FIG. 23A to FIG. 23D are figures, which show a display example displayed by the operation shown in FIG. 22A to FIG. 22I;

FIG. 24A to FIG. 24I are signal waveform charts to explain an operation of a driving method according to the fifth embodiment;

FIG. 25A to FIG. 25D are figures, which show a display example displayed by the operation shown in FIG. 24A to FIG. 24I;

FIG. 37A to FIG. 37G are figures, which show a time transition of the display screen when a liquid crystal display device of the eleventh embodiment is driven;

DETAILED DESCRIPTION OF THE INVENTION

Figure 1A:
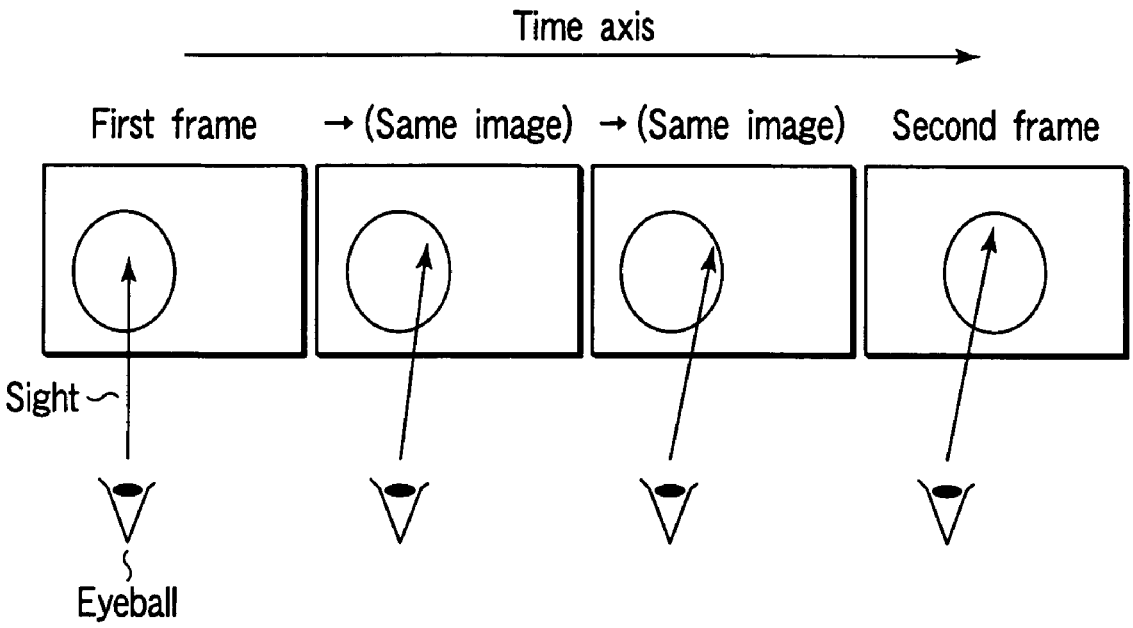
FIG. 1A PRIOR ART
FIG. 1A and FIG. 1B are figures to explain a problem of the prior art.
Figure 1B:
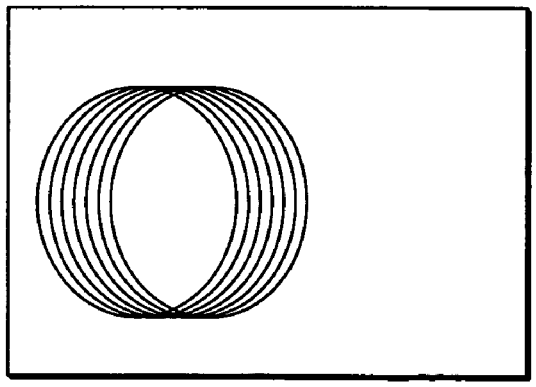
FIG. 1B PRIOR ART

Hereinafter, the embodiments of the present invention will be explained referring to the drawings.

Figure 2:
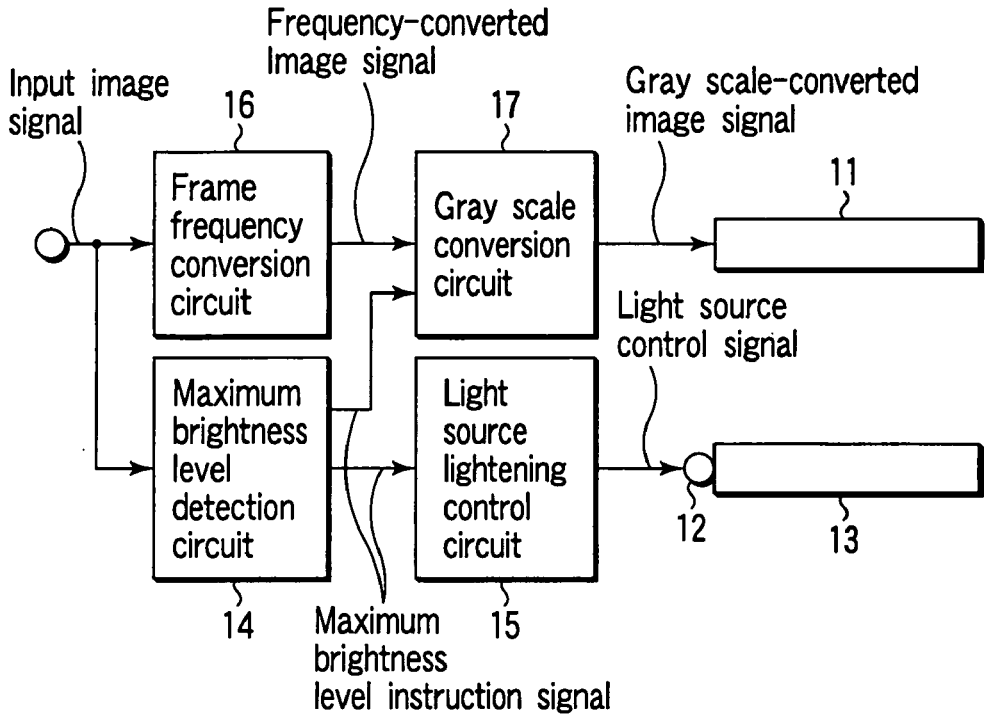
FIG. 2 is a block diagram, which shows an example of a configuration of a liquid crystal display device according to the first embodiment of the present invention.

FIG. 2 is a block diagram, which shows an example of a configuration of a main part of a liquid crystal display device according to the first embodiment of the present invention.

A liquid crystal panel 11 is so-called, an active matrix type liquid crystal panel, and a plurality of pixels are arranged in a matrix form corresponding to each intersection of a plurality of scanning lines and a plurality of signal lines. Transistors (switching elements) are provided, respectively, corresponding to the plurality of pixels. The display signal is supplied from the signal lines to the corresponding pixel electrodes through the transistors selected by the scanning lines. As a result, the transmittance of the liquid crystal of each pixel is controlled and the display of the image is performed.

A lightguide 13 to lead a light from a light source 12 to the liquid crystal panel 11 is arranged on the back side of the liquid crystal panel 11 as a backlight part (lightening part). The liquid crystal panel 11 is lightened by the lightguide 13. The light source 12 can blink with high speed and can use, for instance, the light-emitting diode (hereinafter, called as an "LED") as the light source 12.

A maximum brightness level detection circuit 14 is a circuit to detect the maximum brightness level of the input image signal. The light source lightening control circuit 15 is connected with the maximum brightness level detection circuit 14. The light source lightening control circuit 15 changes the ratio of the lightening period of the light source 12 of the backlight part and non-lightening period during 1 frame period according to the maximum brightness level for 1 frame period detected by the maximum brightness level detection circuit 14. To enhance the display brightness of the image, the light source of the backlight part may be lightened with lower brightness in the non-lightening period than that in the lightening period. In this case, the brightness of the light source of the backlight in the non-lightening period may be adjusted by the user or may be automatically adjusted based on the brightness surrounding of the display device.

The input image signal is input to a frame frequency conversion circuit 16 and the frame frequency conversion circuit 16 converts the frame frequency of the input image signal into a high frequency. The frame frequency conversion circuit 16 comprises a frame memory, for example. The frame frequency conversion circuit 16 records the image for 1 frame of the input image signal on the frame memory. Thereafter, the frame frequency conversion circuit 16 outputs the image signal whose frequency is converted based on the synchronizing signal corresponding to the desired frame frequency. The gray scale conversion circuit 17 converts the gray-scale of the image signal according to the maximum brightness level instruction signal detected by maximum brightness level detection circuit 14. That is, the gray scale conversion circuit 17 converts an image signal level.

Hereinafter, when the image signal whose frame frequency is 60 Hz is input, an example of an operation of the embodiment will be explained. The following example of the numerical value is one example, and is not limited to the example of the numerical value.

Figure 3:
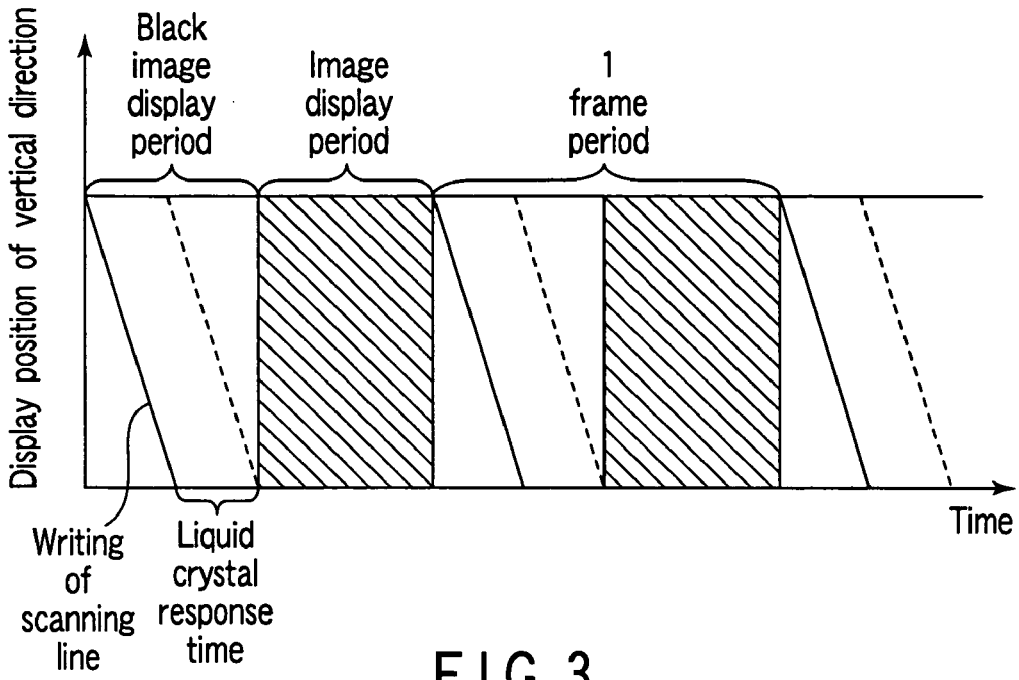
FIG. 3 is a figure to explain an operation of a liquid crystal display device according to the first embodiment of the present invention.

FIG. 3 is a figure, which shows a timing of displaying an image corresponding to an image signal whose frequency is converted, on the liquid crystal panel 11 and a timing of lighting the light source 12 of the backlight part. In FIG. 3, the vertical axis is time, and the vertical axis is a vertical display position of the liquid crystal panel.

The frame frequency conversion circuit 16 converts the frame frequency of the input image signal into a high frequency. In the embodiment, the frame frequency (60 Hz) is converted into 240 Hz, which is four times thereof. The image signal at four times frame frequency output from the frame frequency conversion circuit 16 is input to the liquid crystal panel 11 through the gray scale conversion circuit 17. Then, the image is written in the liquid crystal panel 11 at the vertical scanning period of 1/240 s. When the response time of the liquid crystal panel 11, for example, is 1/240 s (about 4.2 ms), the image which corresponds to the image signal over the entire surface of liquid crystal panel 11 is displayed after 1/120 s (1/240 s+1/240 s) from the input start of the image signal for 1 frame. Thereafter, the light source 12 of the backlight part is lightened for 1/120 s. As a result, the ratio of the image display period (lighting period of the light source 12) for 1 frame period can be 50% and the black display period (turning off period of the light source 12) can be 50%. That is, the display duty can be 50%.

Figure 4:
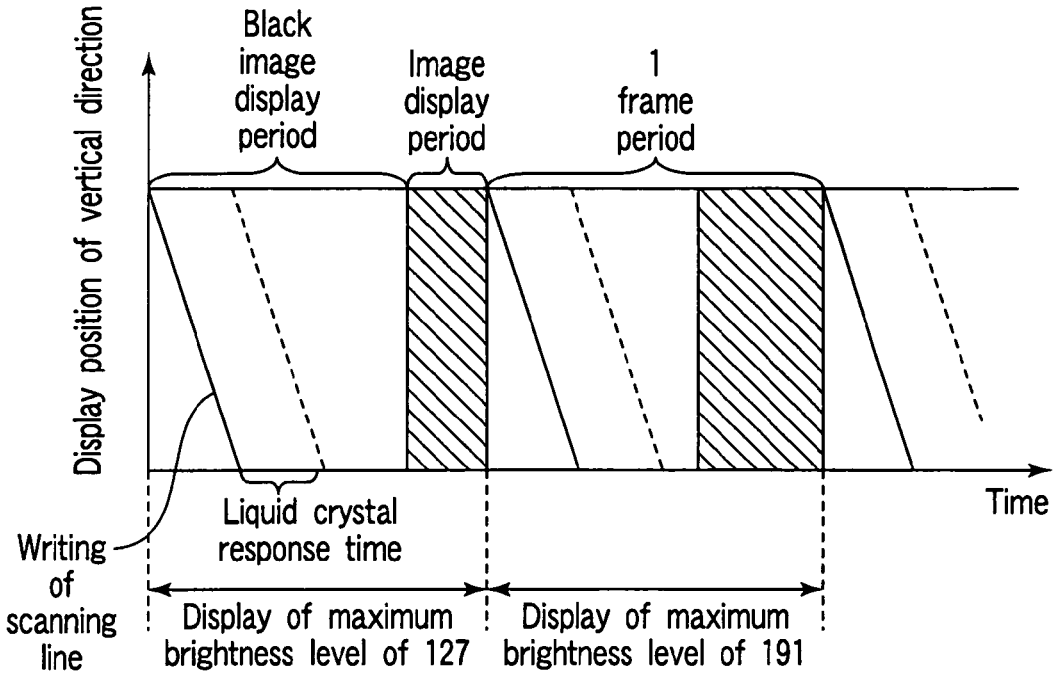
FIG. 4 is a figure to explain an operation of a liquid crystal display device according to the first embodiment of the present invention.

The ratio of the display duty can be arbitrarily changed within the range from 0 to 50% by delaying the lighting timing of the light source 12, or advancing the extinct timing of the light source 12. However, since the response time of the liquid crystal is long in the gray-scale as in general, it is desirable to take the response period of the liquid crystal panel as long as possible. To achieve this, the lighting start timing of the light source 12 becomes late as much as possible. Specifically, based on the relation of FIG. 5 described later, as shown in FIG. 4, it is desirable to set the lighting period of the light source 12, that is, the image display period based on the end of 1 frame period and to change the ratio of the image display period and the black display period in 1 frame period.

The ratio of the image display period and the black display period is set based on the maximum brightness level of the input image signal detected by the maximum brightness level detection circuit 14. The maximum brightness level detection circuit 14 is connected with the light source lightening control circuit 15 and controls the lighting period of the light source 12 corresponding to the maximum brightness level of the input image signal. For example, when the maximum brightness level of the input image signal is high, a bright area is included in the image. Therefore, the lighting period of the light source 12 (image display period) is lengthened and the black display period is shortened. Oppositely, when the maximum brightness level is low, it is a dark image. Therefore, the lighting period of the light source 12 is shortened and the black display period is lengthened.

Figure 5:
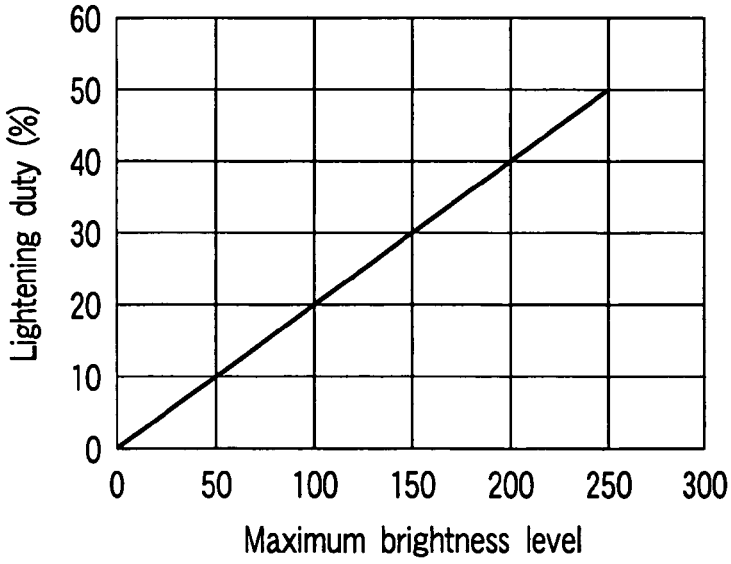
FIG. 5 is a figure, which shows a relation between a maximum brightness level and a lighting duty according to the first embodiment of the present invention.

Though various relations can be taken as a relation between the lighting duty of the light source of the backlight part (ratio of the lighting period for 1 frame period) and the maximum brightness level, in this example, the relation shown in FIG. 5 is assumed. The vertical axis of FIG. 5 is a lighting duty of the light source, the vertical axis shows the maximum brightness level, and the liquid crystal panel in 256 gray-scales is shown. In this example, the lighting duty of the light source is 50% in maximum. Therefore, the lighting duty is 50% when the maximum brightness level is 255, and the lighting duty is 0% when the maximum brightness level is 0 (at black image display on entire LCD).

Figure 6:
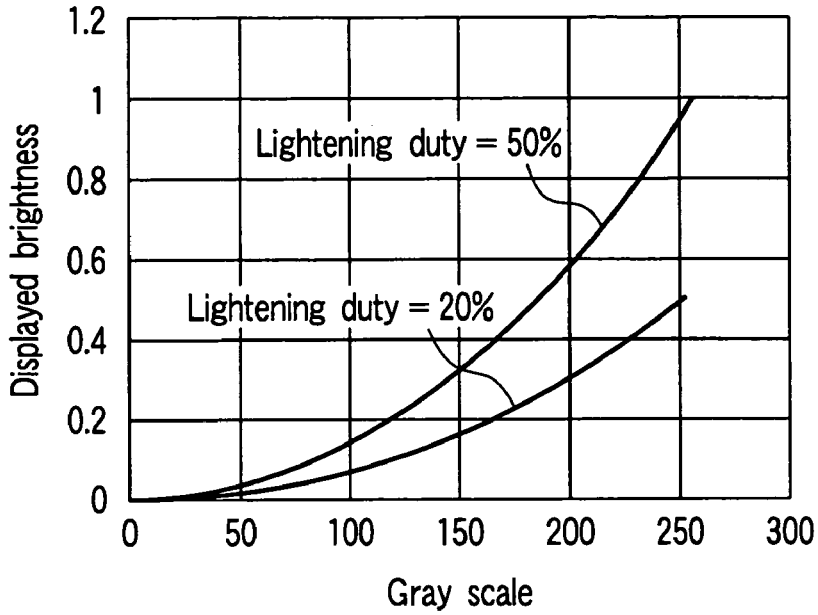
FIG. 6 is a figure, which shows a relation between a gray-scale and a display brightness according to the first embodiment of the present invention.

An example of the relation between the input image signal level (gray-scale) and the display brightness is shown in FIG. 6. In this example, the display brightness is standardized as it is assumed to be 1, when the input image signal level is 255 and the lighting duty is 50%. Here, when the maximum brightness level is 102, the lighting duty of the light source becomes 20% from the relation of FIG. 5. The above-mentioned relation between the input image signal level and the display brightness is greatly different from the relation between the input image signal level and the display brightness when the lighting duty is 50%. Therefore, the gray-scale is converted in this example by the following technique by using the gray scale conversion circuit 17.

When the gamma of LCD is γ, the relation between input image signal level L and lighting duty D and display brightness I(D) shown in FIG. 6 is shown as follows.

$$I(D)=(D/D\mathrm{max})\times(L\gamma/L\mathrm{max}\gamma) \quad (1)$$

Here, Lmax shows the number of gray-scales of the liquid crystal display (255 levels in this example), and Dmax shows the lighting duty (50% in this example) when the maximum brightness level of the input image signal and the Lmax are equal to.

If the L is converted so that the I(D) for an arbitrary D corresponds to an I(Dmax) for the Dmax, each of gammas is corresponded to each other.

Therefore, if the gray-scale after conversion is assumed to be an Lout, the following relation is led from the equation (1).

$$L\mathrm{out}=L/(D/D\mathrm{max})^{1/\gamma} \quad (2)$$

Therefore, the lighting duty of the light source is decided for the maximum brightness level of the input image based on FIG. 5, and the input image signal level is converted based on the equation (2). As a result, it becomes possible to display the image in which the gamma corresponds to each other for any input image. When the Lout is a discrete value (for example, integer), a value below decimal point of the Lout obtained by the equation (2) may be rounded up or rounded down.

This embodiment shows the case where the relation of the input image signal to the LCD and the display brightness is shown by the function of the gamma. However, even when these relations are not expressed by a function, a similar effect can be achieved by adopting the following method. A conversion table (LUT), which converts the input image signal level, is prepared for each lighting duty of the backlight to correspond the gamma. And, the input image signal level is converted referring to the LUT.

As mentioned above, the image display period is lengthened when the displayed image is bright and priority is given to the white brightness in the embodiment.

The image display period is shortened and the black display period is lengthened when the displayed image is dark.

As a result, the motion image with sharp and the small picture quality deterioration can be presented to the observer.

When the black image on the entire LCD is displayed, the light source of the backlight part is turned off.

Therefore, it becomes possible to widen the dynamic range of the liquid crystal display.

Figure 7:
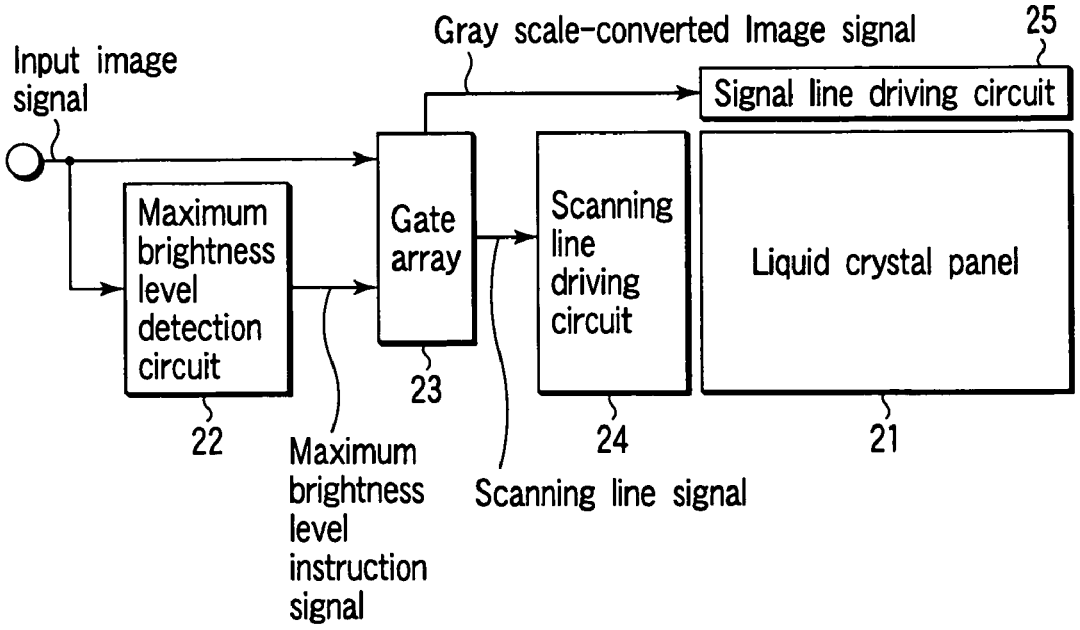
FIG. 7 is a block diagram, which shows an example of a configuration of a liquid crystal display device according to the second embodiment of the present invention.

FIG. 7 is a block diagram, which shows an example of a configuration of a main part of the liquid crystal display device according to the second embodiment of the present invention.

A basic configuration of the liquid crystal panel 21 is similar to the configuration of the liquid crystal panel 11 in the first embodiment shown in FIG. 2. It is desirable to provide the backlight part to the back side of the liquid crystal panel 21 similar to the first embodiment although the backlight part (lightening part) is not shown in FIG. 7.

A basic configuration of the maximum brightness level detection circuit 22 is similar to the maximum brightness level detection circuit 14 in the first embodiment. The gate array 23 of the liquid crystal panel module is connected with the maximum brightness level detection circuit 22. In the gate array 23, the scanning line signal corresponding to the maximum brightness level is output to scanning line driving circuit 24 to change the ratio of the image display period and the black display period in 1 frame period according to the maximum brightness level for 1 frame period detected by the maximum brightness level detection circuit 22. The input image signal level is converted by the same method as the first embodiment according to the detected maximum brightness level, and the gray-scale-converted image signal is output to the signal line driving circuit 25.

Figure 8:
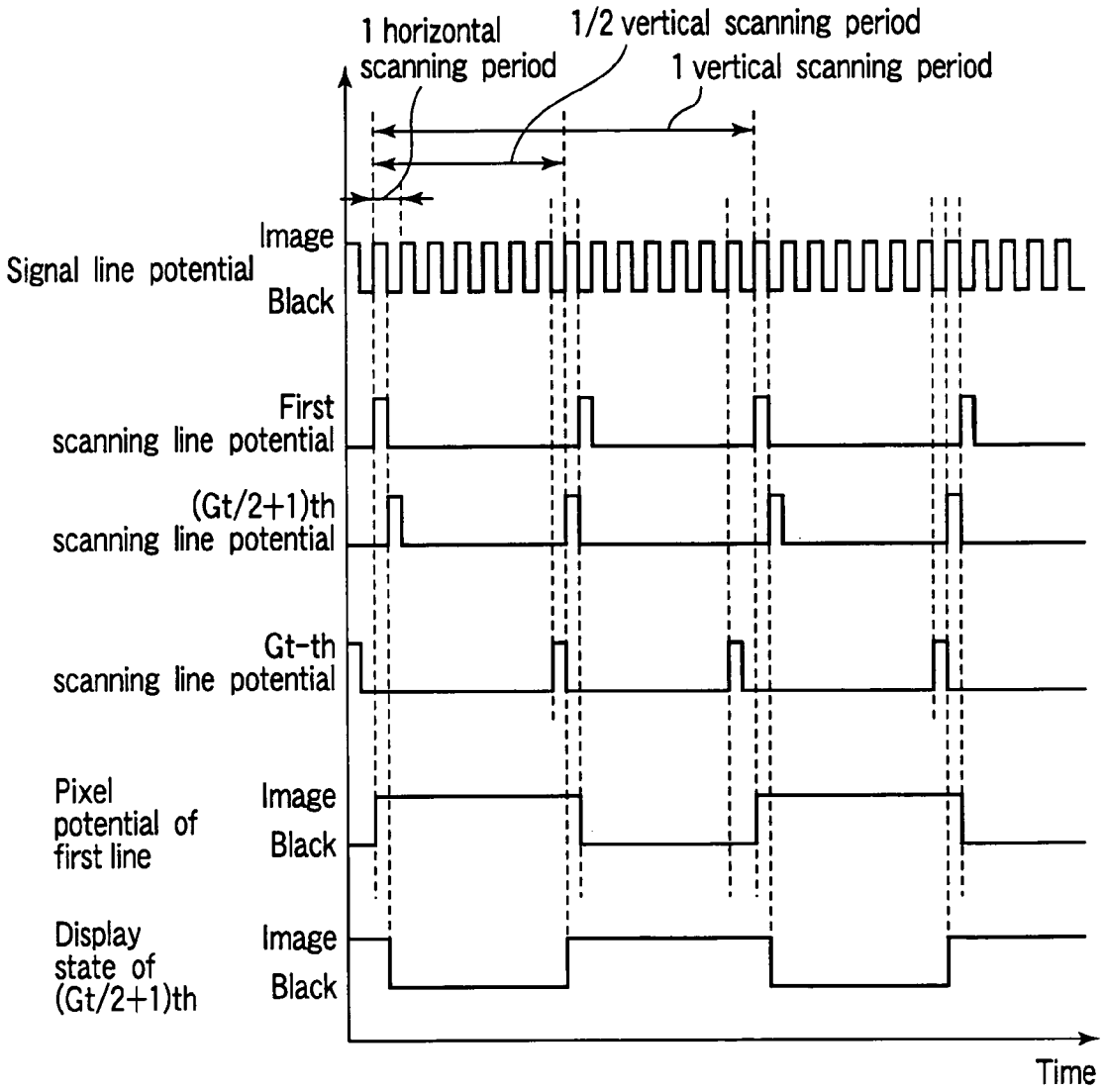
FIG. 8 is a timing chart to explain an operation of a liquid crystal display device according to the second embodiment of the present invention.

Hereinafter, the example of the operation of the embodiment will be explained referring to the timing chart shown in FIG. 8. FIG. 8 is a figure, which shows a driving waveform of the display signal output from the signal line driving circuit 25 and a scanning line signal output from the scanning line driving circuit 24, and the image display in the liquid crystal panel 21.

The image display signal is output in the first half of one horizontal scanning period and the black display signal is output in the latter half thereof from the signal line driving circuit 25. That is, the operation frequency of the scanning line driving circuit becomes twice of the normal frequency. The scanning line driving circuit 24 selects scanning line corresponding to each pixel to which the image display signal should be supplied in the first half of one horizontal scanning period when the image is displayed on the liquid crystal panel, and selects scanning line corresponding to each pixel to which the black display signal should be supplied in the latter half of one horizontal scanning period when the black is displayed on the liquid crystal panel.

For example, when the display duty is 50% and the total number of lines in vertical direction is Gt, (Gt/2+1)th scanning line is selected in the latter half of one horizontal scanning period, and the black display signal is supplied to the corresponding pixel when the scanning line of the first line is selected and the image display signal is supplied to the corresponding pixel, in the first half of one horizontal scanning period. Similarly, (Gt/2+2)th scanning line is selected in the latter half of one horizontal scanning period when the second scanning line is selected in the first half of one horizontal scanning period. In the same way, the following scanning lines are selected one by one, respectively, in the first half and the latter half of one horizontal scanning period. Thus, (Gt/2)th scanning line is selected in the latter half of one horizontal scanning period and the black display signal is supplied to the corresponding pixel when Gt-th scanning line is selected in the first half of the horizontal scanning of one period and the image display signal is supplied to the corresponding pixel.

FIG. 9A to FIG. 9E are figures, which show display state on the liquid crystal panel 21 when the display duty is 50%.

Figure 9A:
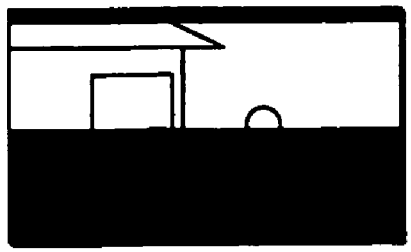
FIG. 9A to FIG. 9E are figures, which show a display example of a liquid crystal display device according to the second embodiment of the present invention.
Figure 9B:
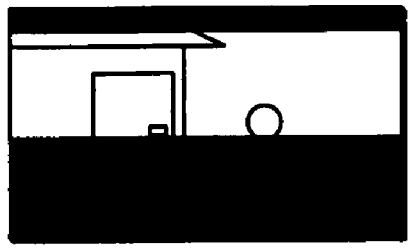
Figure 9C:
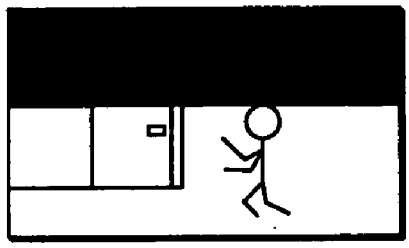
Figure 9D:
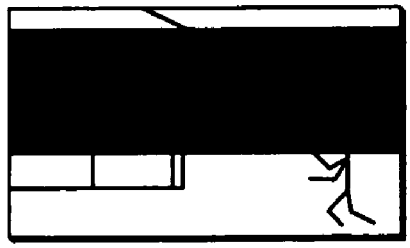
Figure 9E:
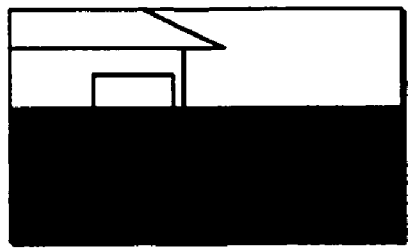

FIG. 9A shows the display state when writing of the display image signal of n-th field to (Gt/2+1)th line is completed, and the black display signal is written in the first line. FIG. 9B shows the display state when the display image signal of n-th field is written in the (Gt/2+2)th line, and the black display signal is written in the second line. FIG. 9C shows the display state when the display image signal of n-th field is written in Gt-th line, and the black display signal is written in the (Gt/2)th line. FIG. 9D shows the display state when the display image signal of the (n+1)th field is written in the first line, and the black display signal is written in the (Gt/2+1)th line. FIG. 9E shows the display state when the display image signal of the (n+1)th field is written in the (Gt/2)th line, and the black display signal is written in Gt-th line.

Similar to the first embodiment, the ratio of the display period of the image in 1 frame is arbitrarily changed by changing the writing start timing of the black display signal according to the maximum brightness level detected by the maximum brightness level detection circuit 22.

Figure 10:
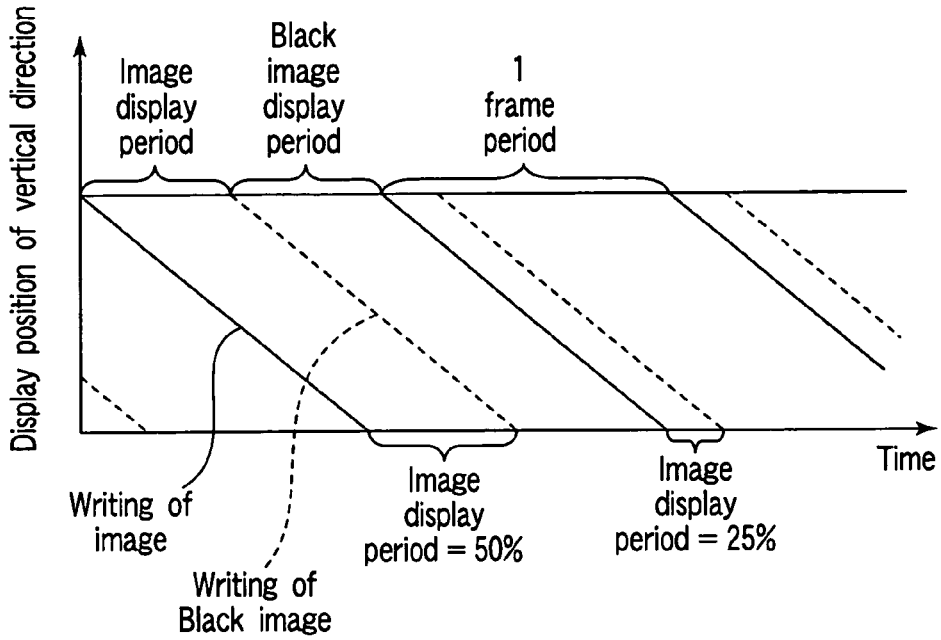
FIG. 10 is a figure to explain an operation of a liquid crystal display device according to the second embodiment of the present invention.

FIG. 10 is a figure, which shows the writing timing of the image display signal and the writing timing of the black display signal. The ratio of the image display period and the black display period for 1 frame period is changed by changing the writing timing of the black display signal according to the maximum brightness level. For example, the image display period is lengthened and the black display period is shortened when the maximum brightness level of the input image signal is high. Oppositely, the image display period is shortened and the black display period is lengthened when the maximum brightness level is low.

In the embodiment as mentioned above, since the ratio of the image display period and the black display period is changed according to the brightness of the image to be displayed, as well as the first embodiment, the motion image with sharpness and the image with small deterioration to which white brightness is secured can be presented to the observation person.

Figure 11:
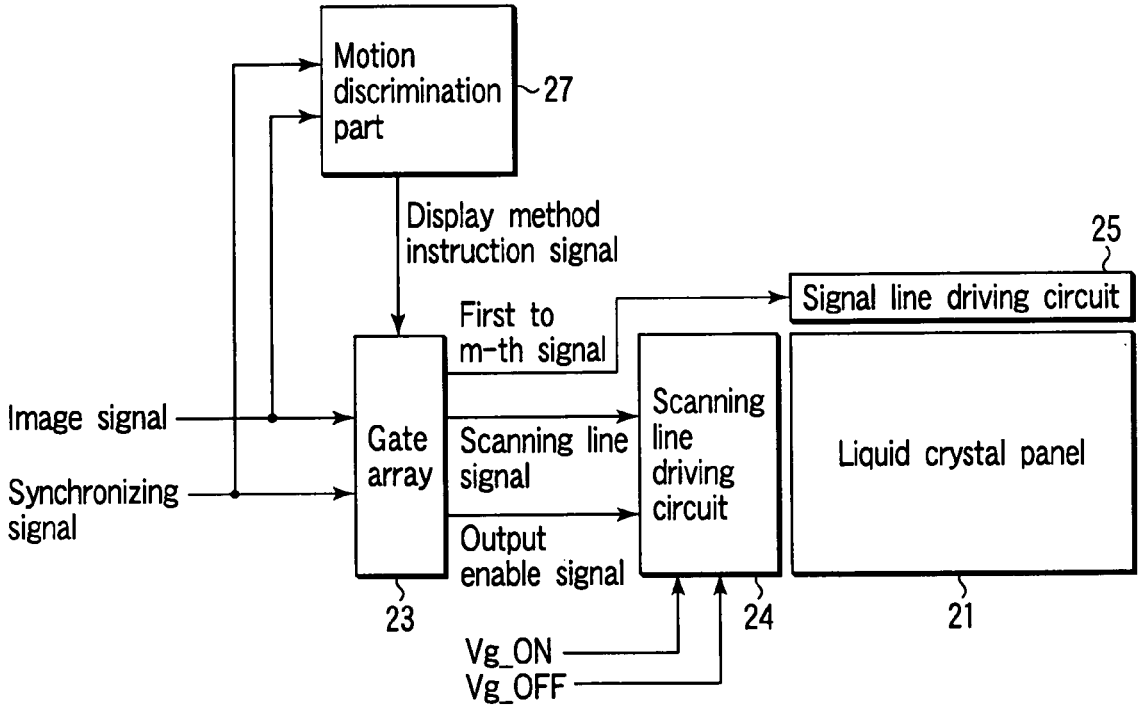
FIG. 11 is a figure, which shows a configuration of a liquid crystal display device according to the third embodiment of the present invention.
Figure 12:
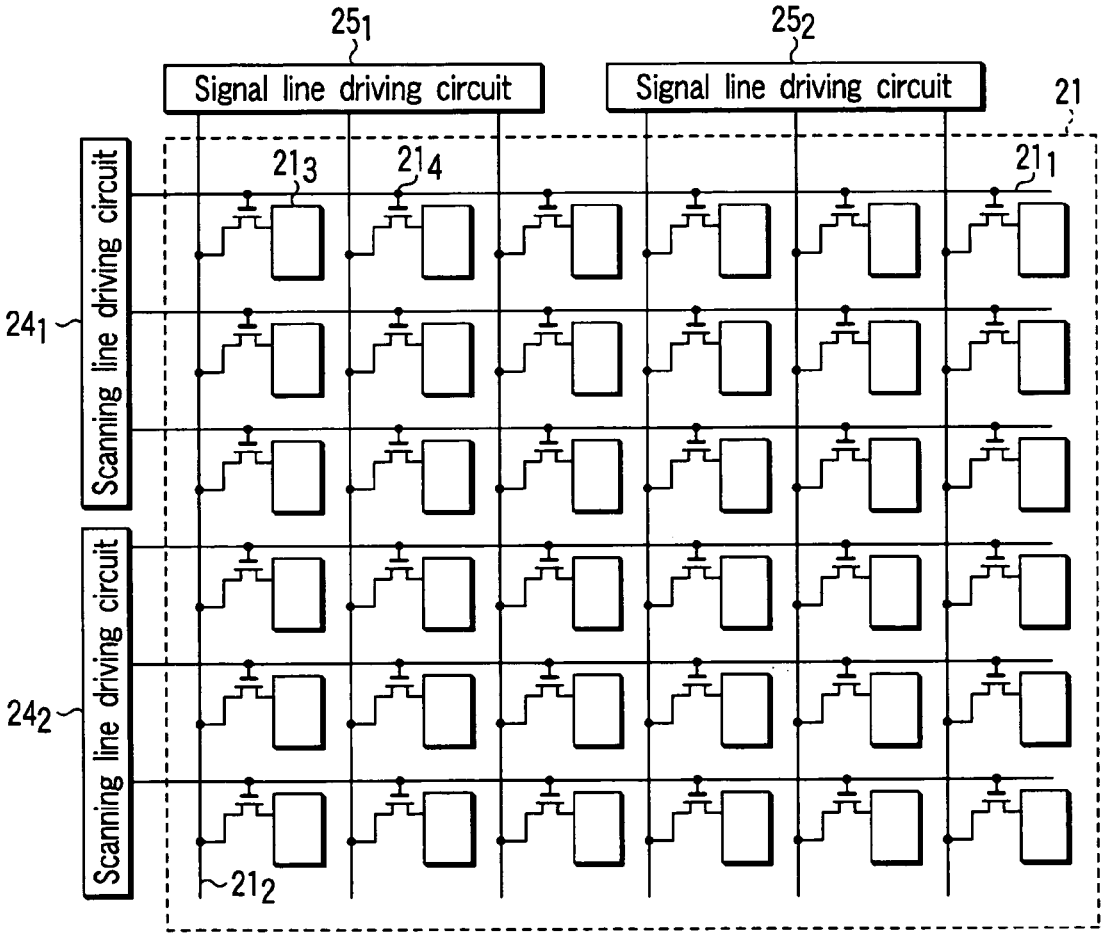
FIG. 12 is a figure, which shows an array configuration of a liquid crystal display device according to the third embodiment of the present invention.

The third embodiment of present invention will be explained. The third embodiment relates to a liquid crystal display device, and the configuration of this liquid crystal display device is shown in FIG. 11, and the configuration of the liquid crystal module (array configuration of the liquid crystal panel and the peripheral circuit) according to this liquid crystal display device is shown in FIG. 12. Since the configuration of the liquid crystal display device shown in FIG. 11 is almost the same as shown in FIG. 7, the same mark is fixed to the same part as FIG. 7 in FIG. 11, and a detailed explanation will be omitted. In FIG. 11, the motion discrimination part 27 is provided instead of the maximum brightness level detection circuit of FIG. 7.

The gate array 23 generates first to m-th signals, the scanning line signal and the output enable signal based on the image signal and the synchronizing signal sent from the outside and the display method instruction signal sent from the motion discrimination part 27. The gate array 23 sends above-mentioned first to m-th signals to the signal line driving circuit 25, and sends above-mentioned scanning line signals and the output enable signal to the scanning line driving circuit 24. The motion discrimination part 27 takes the frame image at predetermined intervals based on above-mentioned image signal and the synchronizing signal. Then, the motion discrimination part 27 examines the correlation between two frame images continuously taken, and decides whether two frame images are a motion image or a still image. This discrimination result is sent to the gate array 23 as an image information included in the display method instruction signal.

The liquid crystal module comprises the liquid crystal panel 21, the scanning line driving circuit 24, and the signal line driving circuit 25. The number of driving circuits (for example, 8 pieces in width and 2 pieces in length) of the signal line driving circuit 25 and the scanning line driving circuit 24 is determined according to the number of output pins (for example, 240 pins output) and the resolution of the liquid crystal panel (for example, 640×3×480 in VGA) as shown in FIG. 12. In FIG. 12, the liquid crystal module comprises the plurality of the scanning line driving circuits 241, 242 and the plurality of the signal line driving circuits 251, 252. The liquid crystal panel 21 comprises an array substrate (not shown in the figure), an opposing substrate (not shown in the figure) and a liquid crystal layer placed between these substrates. The array substrate comprises a plurality of scanning lines 211 formed on the first transparent substrate (not shown in the figure), a plurality of signal lines 212 formed on the first transparent substrate to intersect with the plurality of scanning lines, a the pixel electrode 213 (called as a "pixel") formed on each intersection of these scanning lines and signal lines, and a switching element (TFT (Thin Film Transistor)) 214 provided corresponding to the pixel electrode, opening and closing according to the voltage of the corresponding scanning lines, and sending the image signal from the corresponding signal line to the corresponding pixel electrode. The gate of the TFT 214 is connected with the corresponding scanning lines 211, the source thereof is connected with the corresponding the signal line 212, and drain thereof is connected with corresponding pixel electrode 64. On the opposing substrate, the opposing electrode is provided on the second transparent substrate to oppose to the pixel electrode. Scanning 62 is driven by the scanning line driving circuits 241, 242, and the signal line 212 is driven by the signal line driving circuits 251, 252.

Figures 13A, 13B, 13C:
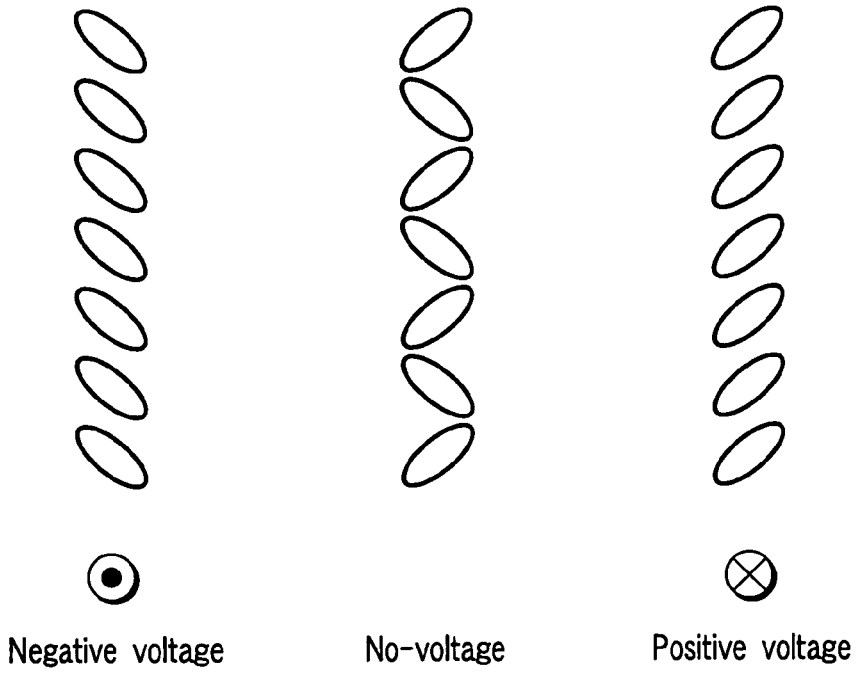
FIG. 13A to FIG. 13C are figures, which show an alignment of an anti-ferroelectric liquid crystal material.
Figure 14:
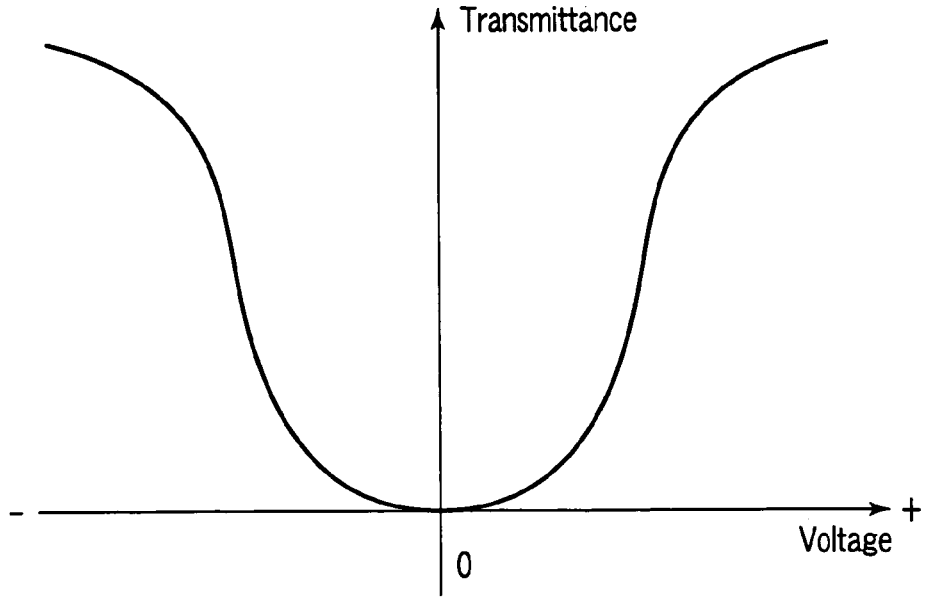
FIG. 14 is a figure, which shows a voltage-transmitting curve of the an anti-ferroelectric liquid crystal material.

The liquid crystal material in the liquid crystal panel 21 may be any materials. The liquid crystal material with a high-speed response is desirable in the present invention in which the display is switched in two or more times for 1 frame period. For example, the ferroelectric liquid crystal material, the liquid crystal material (for example the antiferroelectric liquid crystal (AFLC)) having the spontaneous polarization generated by applying the electric field, the liquid crystal material of making the ferroelectric liquid crystal material with Iso.-Ch-SmC* layer transfer series monostable and the OCB (Optically Compensated Bend) mode, etc. are used. A mode can be set to a mode (normally black) to which light is not transmitted and a mode (normally white) to which light are transmitted by a method of laminating the liquid crystal panel 21 to two polarizing plates when no voltage is applied. The alignment is shown in FIG. 13A to FIG. 13C when AFLC is used. A voltage-transmittance curve is shown in FIG. 14 when two polarizing plates are arranged in cross-Nicol state. When the no voltage is applied as shown in FIG. 13B, the liquid crystal molecules cancel the spontaneous polarization each other, and becomes a black display since the light is not transmitted. The liquid crystal is aligned in one direction, rotates the optical axis, and becomes a transparent mode when applying the voltage to the positive polarity side or the negative polarity side as shown in FIG. 13A and FIG. 13C. The point, which differs from the TN mode is only the array of the liquid crystal according to the polarity of the voltage, and is not especially disadvantage in the embodiment. In addition to three alignments of the state of no voltage application, the state of the positive voltage application, and the state of the negative voltage application, it is possible to arbitrarily take an alignment the intermediate alignment of these according to the intensity of the voltage which is applied between the electrodes.

Figure 15:
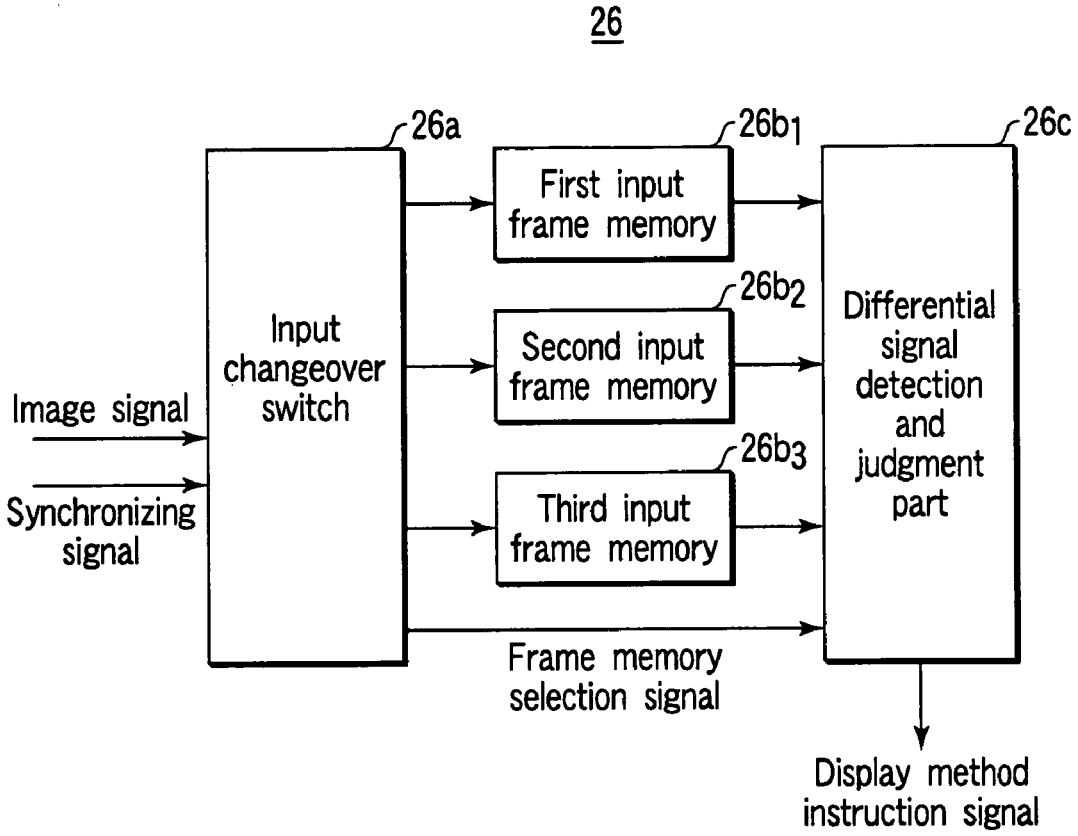
FIG. 15 is a figure, which shows a configuration of a motion discrimination part according to the third embodiment.

As shown in FIG. 11, the image signal and the synchronizing signal input from the outside are input to the gate array 23 and the motion discrimination part 27 of the liquid crystal display device. The motion discrimination part 27 decides whether the input image is a motion image or a still image. The motion discrimination part 27 may have any configuration. For example, as show in FIG. 15, a configuration which has three frame memories 26*b*1, 26*b*2, and 26*b*3, and the image is repeatedly input to the first, second, and third frame memory through input changeover switch 26*a* may be adopted. For example, the q-th frame image is input to the first frame memory 26*b*1 first, and the (q+1)th frame image is input to the second frame memory 26*b*2. Thereafter, the (q+2)th frame image is input to the third frame memory 26*b*3, at the same time, the correlation of q-th frame image in the first frame memory 26*b*1 and the (q+1)th frame image in the second frame memory 26*b*2 is checked in differential signal detection and discrimination part 26*c*. Where, q is an arbitrary integer. The frame to which the correlation is checked is decided as follows. The frame memory selection signal to direct a frame memory in which an image is input currently is transmitted to the differential signal detection and discrimination part 26*c*. Here, the correlation is checked for the frame memorized on the frame memory to which the image is not input. The differential signal detection may be performed with the entire screen or in block unit. Only an upper bit may be detected as the differential signal detection and all bits of pixel of red (R), green (G) and blue (B) are may not be checked. When the difference signal obtained by the differential signal detection is larger than the predetermined threshold value, the image is discriminated as the motion image, and when it is smaller than that, the image is discriminated as the still image. The discrimination result is sent to the gate array 23 as a display method instruction signal. The gate array 23 transmits first to m-th signals (image signal), the horizontal synchronizing signal (hereinafter, called as an "STH"), and a horizontal clock (hereinafter, called as an "Hclk")), the scanning lines signal (vertical synchronizing signal (hereinafter, called as an "STV") and the vertical direction clock (hereinafter, called as a "Vclk")), and the output enable signal to the liquid crystal module by receiving the display method instruction signal. The image signal, the horizontal synchronizing signal, the horizontal direction clock, the vertical synchronizing signal, and the vertical direction clock are converted m times frequency of the clock of the input image signal.

The peripheral circuit in the liquid crystal module will be explained.

The liquid crystal module comprises a liquid crystal panel 21 and a peripheral circuit thereof, and the peripheral circuit includes a signal line driving circuit 25 and a scanning line driving circuit 24 usually.

The scanning line driving circuit 24 has a shift register.

As shown in FIG. 16A to FIG. 16G, when the scanning line signal is input to the scanning line driving circuit 24, after vertical synchronizing signal STV is latched by the shift register in the scanning line driving circuit 24, an signal, whose pulse width is equal to vertical synchronizing signal STV (hereinafter, called as a "writing signal"), is shifted one by one and are transferred to the shift register according to the vertical direction clock Vclk.

Figures 16A, 16B, 16C, 16D, 16E, 16F, 16G:
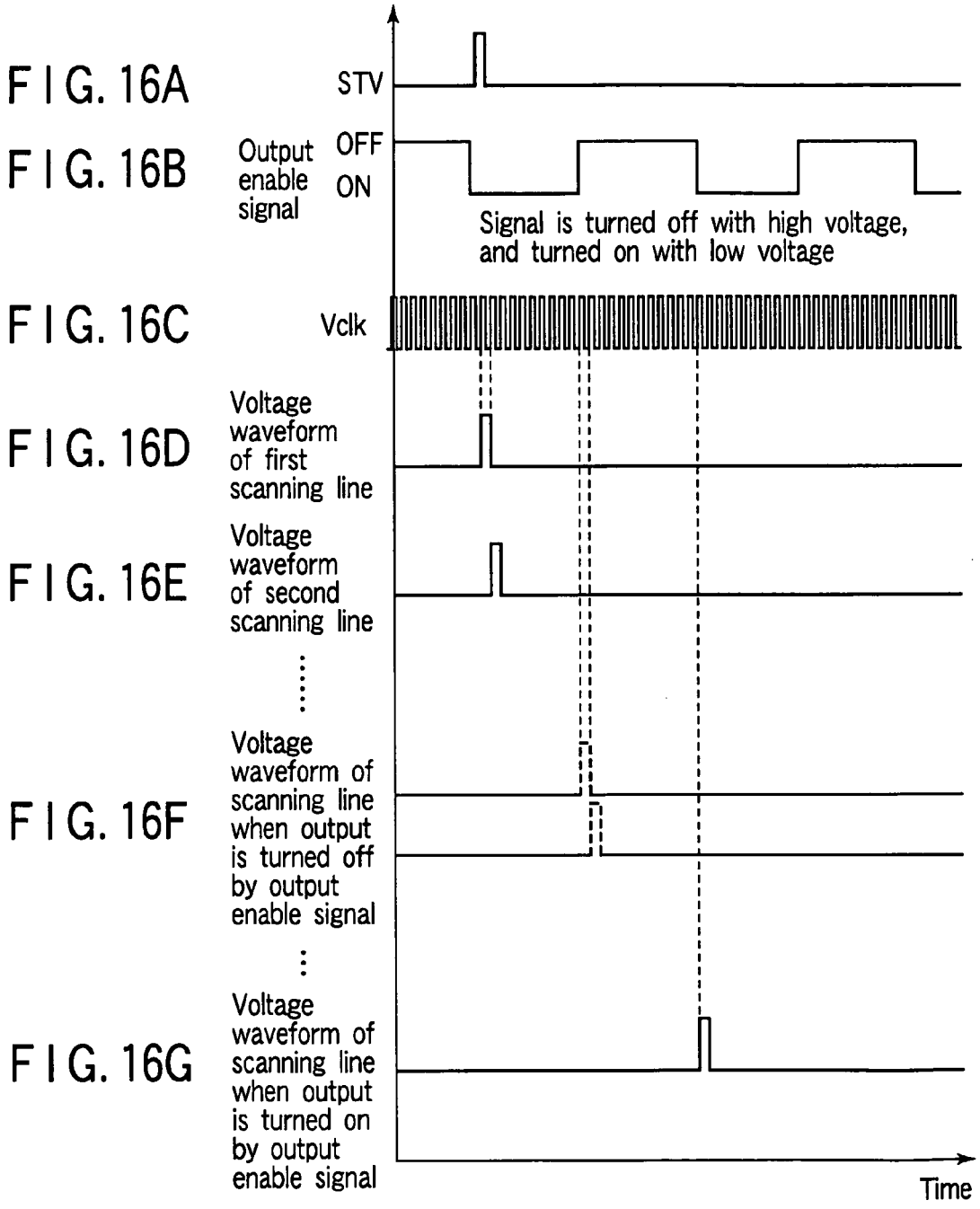
FIG. 16A to FIG. 16G are voltage waveform charts to explain an operation of a scanning line driving circuit according to the third embodiment.

On the other hand, the output enable signal is a signal to control the output of the scanning line driving circuit 24. When the writing signal is input to the above-mentioned shift register when the output enable signal is turned on, writing of the scanning line is performed (see FIG. 16G). When the writing signal is input to the above-mentioned shift register when the output enable signal is turned off, writing of the scanning line is not performed (see FIG. 16F). The voltage waveform of a dot line of FIG. 16F shows the voltage waveform, which will appear on the scanning line when the output enable signal is turned on.

Such a control method is assumed to be a basic configuration, the same operation as above-mentioned can be performed, when the output control is performed by dividing 1 scanning line driving circuit into some blocks. By inputting output enable signals different for each scanning line driving circuit, an output of the scanning line driving circuit 241, for example, shown in FIG. 12 can be turned off, and an output of the scanning line driving circuit 242 can be turned on. Control of writing of each scanning line is controlled by using this control method in the following embodiments.

Figures 17A, 17B, 17C, 17D, 17E, 17F:
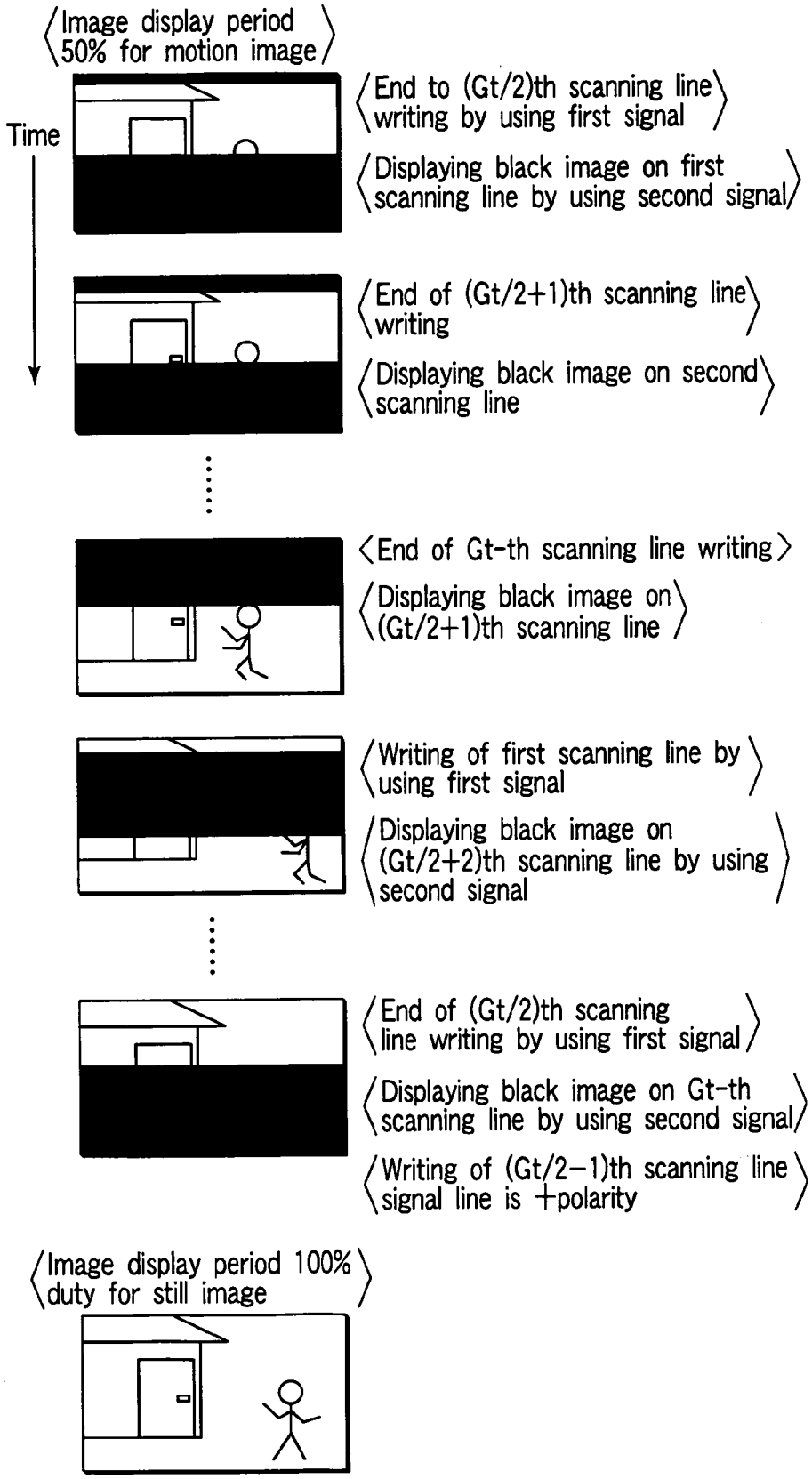
FIG. 17A to FIG. 17F are figures, which show a display screen displayed by an operation of a scanning line driving circuit shown in FIG. 16A to FIG. 16G.

Next, in the liquid crystal display device according to the embodiment, a driving method, when the display duty of 100% is performed in the still image and a driving method, when the display duty of 50% is performed in the motion image will be explained, when the display device is a normally black. It is necessary to put a voltage into the state of the no-voltage between pixels to display the black when the backlight of the normally lighting is used. Then, the first scanning line is selected when the writing ends to the scanning line of half of the screen as shown in FIG. 17A, the black signal (called as a "second signal" in the embodiment, and the image signal is called as a "first signal") is written to the pixel connected with the first scanning line. Gt is assumed to be the number of all scanning lines. The first signal is written in the pixel on (Gt/2+1)th scanning line as shown in FIG. 17B. The second signal is continuously written in the pixel on the second scanning line. The first signal is written in the pixel on the Gt-th scanning line continuously as shown in FIG. 17C. The second signal is continuously written in the pixel on (Gt/2+1)th scanning line. Next, the first signal is written in the pixel on the first scanning line as shown in FIG. 17D. The second signal is continuously written in the pixel on (Gt/2+2)th scanning line. And, the first signal is written in the pixel on the (Gt/2−1)-th scanning line as shown in FIG. 17E. And, the second signal is written in the pixel on the Gt-th scanning line. FIG. 17F shows a still image of display duty of 100%, and does not display the black in this case.

The display duty can be changed by changing timing in, which the second signal is written like this. The signal to the signal line in display duty of 50% is supplied to the signal line by periodically alternately repeating the first signal (image signal) and the second signal (black signal) (see FIG. 18A). The image signal uses two kind of signals of the first signal and the second signal. Therefore, the image is supplied to the signal line by the frequency twice the conventional display signal. The scanning line is selected from the first to Gt-th scanning lines one by one, and the first scanning line is selected after Gt-th scanning line. And, the same scanning lines are selected two times for 1 frame period (see FIG. 18B, FIG. 18C, and FIG. 18D). The image is displayed at half of the first period of 1 frame period, and the black is displayed at half of the following period in the pixel connected with each scanning line (see FIG. 18E and FIG. 18F).

Figure 19:
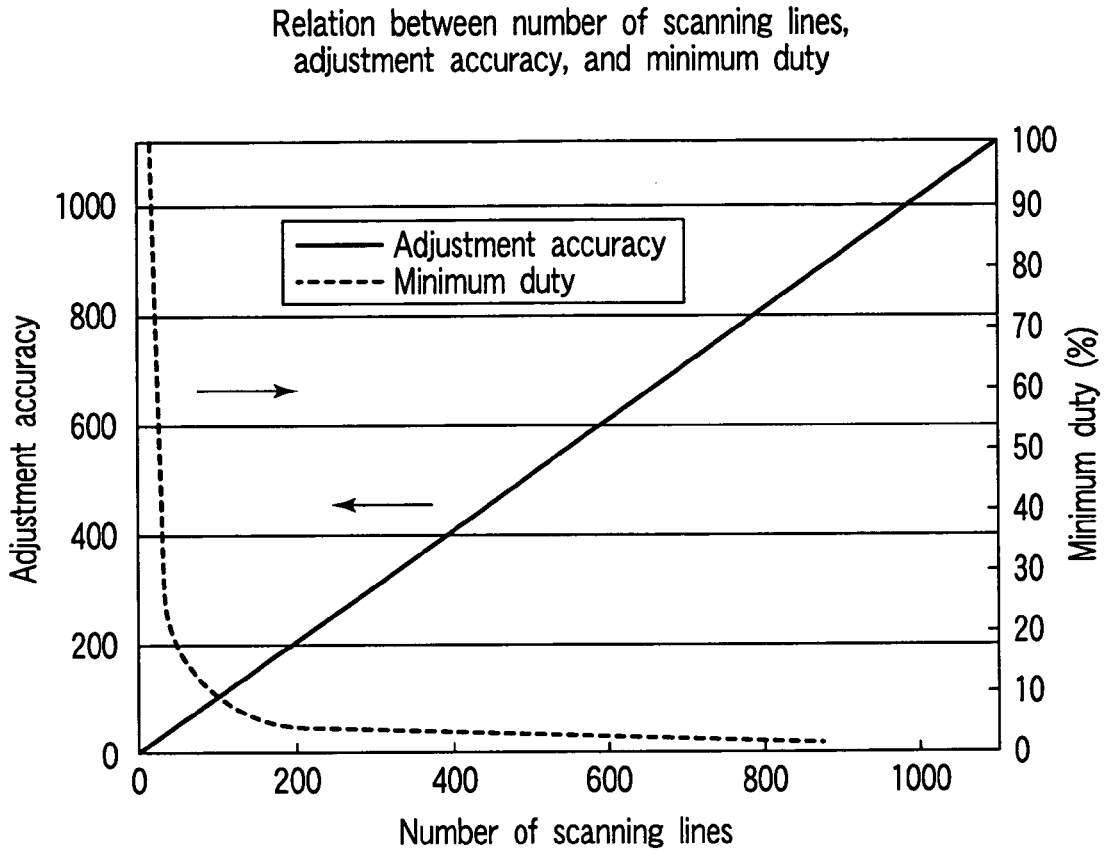
FIG. 19 is a figure, which shows a relation of number of scanning line, adjustment accuracy, and minimum duty (%) in the third embodiment.

Next, a variable rate of the display duty will be explained. The variable rate of the display duty is determined according to the number of scanning lines of the liquid crystal panels 21. When VGA with 480 scanning lines is used, for example, it is possible to adjust the duty from 100/480% duty to display duty of 100% at intervals of 100/480% (The adjustment accuracy is 480). When a high-definition television method with 1035 numbers of scanning lines is used, it is possible to adjust the duty from 100/1035% duty to display duty of 100% at intervals of 100/1035% (adjustment accuracy is 1035). The relation among the number of scanning lines, the adjustment accuracy, and the minimum duty is shown in FIG. 19. The minimum duty is in inverse proportion to the number of scanning lines though the adjustment accuracy is in proportion to the number of scanning lines.

As explained above, according to the embodiment, the display duty can be easily changed according to the display image, and it becomes possible to display the image with high quality. Since it becomes possible to provide the black image display period, unsharpness of the image can be prevented.

Next, the fourth embodiment of present invention will be explained. This embodiment is a driving method of the liquid crystal display device, and the driven liquid crystal display device is almost same configuration as the liquid crystal display device according to the third embodiment. The fourth embodiment differs from the third embodiment in use of the liquid crystal material where response insufficiency is occurred caused by the writing period's becoming half.

In the fourth embodiment, the third signal, which is the reset signal, is used besides the first signal, which is the image signal, and the second signal, which is the black display signal. The third signal is written as a reset signal (white display in AFLC) on the high potential side at a previous step where the image signal, which is the first signal, is written in the pixel as shown in FIG. 20A, and, as a result, the response can be raised. Since the reset signal will write the image signal in a short term after reset, a white display is not confirmed visually regarding to the influence on the display. The writing period (width of the voltage waveform of scanning line) becomes ⅓ of the conventional case, and becomes shorter than conventional ones in the embodiment. However, the driving method of the embodiment can be used within the scope of improving writing by the effect of reset. In the embodiment, the first signal to the third signal are supplied to the signal line at three repetition cycles. The driving frequency of the signal line driving circuit 25 is 3 times conventional ones. In the embodiment, 1 frame period of the pixel connected with each scanning line is consisted of the image display period, the black display period, and the reset period (see FIG. 20E and FIG. 20F).

The display duty can be easily changes according to the display image, and unsharpness of the image can be prevented according to the fourth embodiment. As a result, it becomes possible to display the image with high quality. The driving method of the fourth embodiment can be applied also to the liquid crystal display device, which uses the liquid crystal material where response insufficiency is occurred caused by the writing period's.

The power dissipation of the signal line driving circuit rises so much when a lot of image signals are input like the third embodiment and the fourth embodiment. Then, a driving method of a low power dissipation will be explained as the fifth embodiment. In the fifth embodiment, it is the same configuration except for using the blinking backlight as the third embodiment.

Figures 21A, 21B:
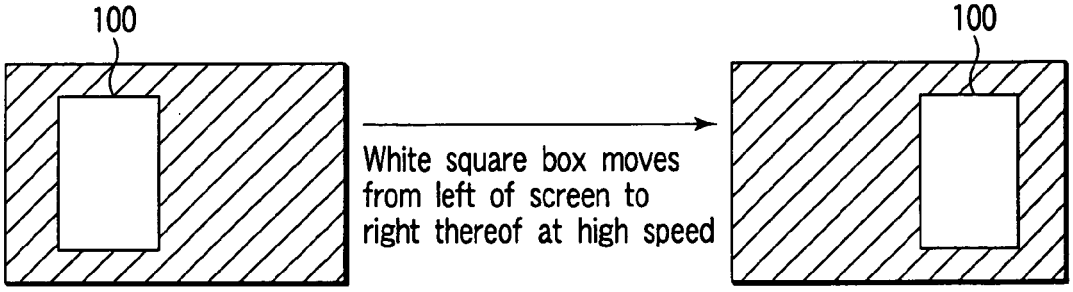
FIG. 21A to FIG. 21D are figures to explain the picture quality deterioration (diagonal phenomenon) by differing the image creating method and the display method.
Figure 21C:
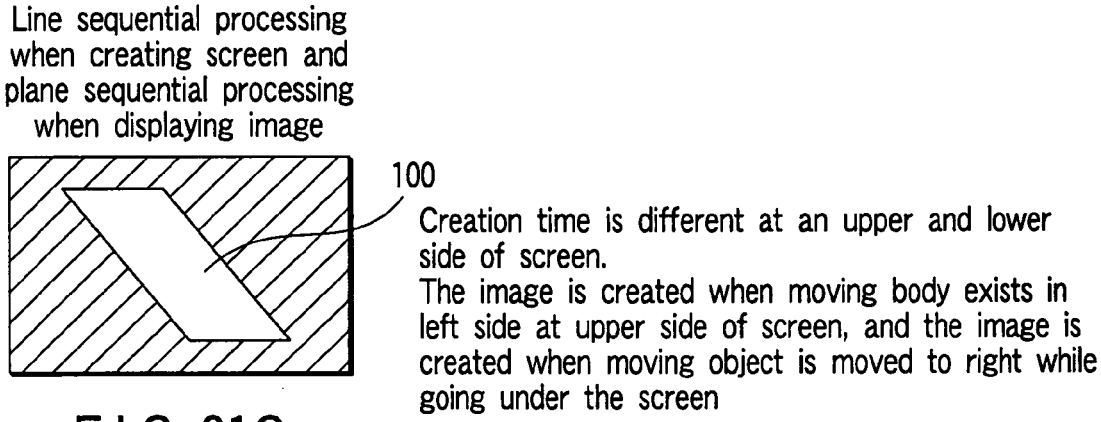
Figure 21D:
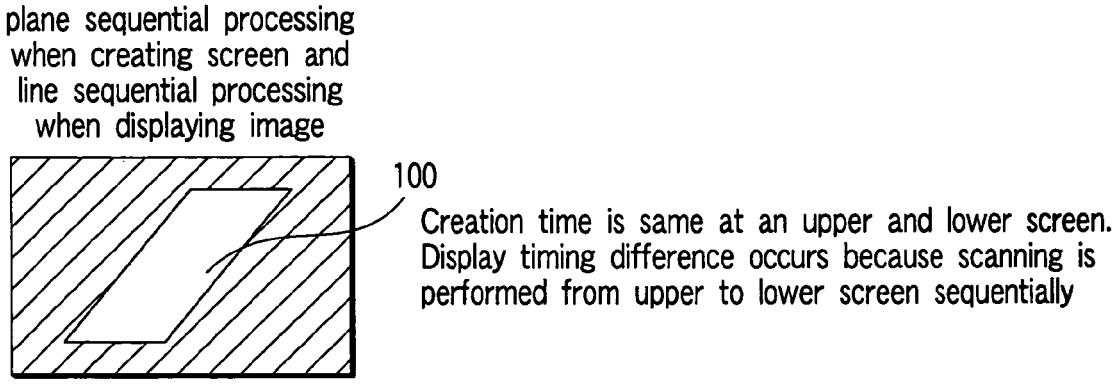

The driving method of the embodiment is effective in the diagonal phenomenon, which can be generated when the display method and the creating method of the original picture image are different. This diagonal phenomenon appears when the speed of the moving object is especially fast. It is considered that the case where white the square box 100 is moved from the left of the screen to the right at high speed in the display screen as shown in FIG. 21A and FIG. 21B. When the display method is the plane sequential method (screen is displayed in the lump) and the original picture image is the line sequential method (image shooted by CCD camera etc.), the time of creating the image is different on the top and bottom of the screen as show in FIG. 21C. Therefore, the image inclines from upper left of the screen to lower right thereof. On the other hand, when the display method is the line sequential method (CRT and LCD) and the original picture image is the plane sequential method (scene is created one by one with the film shooting and the CG (Computer Graphics) technology of the movie etc.), a time difference is occurred on the top and bottom of the screen at display, though it is the same at the time of the image creating on the top and bottom of the screen. Therefore, the image inclines from upper right of the screen to lower left thereof as shown in FIG. 21D. These phenomena become remarkable when the screen size is long and the speed of the moving object is fast in horizontal direction. For example, when it takes 1 second for the moving object to move from the left to the right of the screen in the high-definition television, the inclination of about 1.7° is caused. When the display method and the creating method of the original picture image are the same, above-mentioned disadvantage is not generated.

Then, as an example of the case where the original picture image is created by the plane sequential method is taken and the driving method of the embodiment will be explained referring to FIG. 22A to FIG. 22I.

The driving method of the embodiment writes the first signal (image signal) in the pixel of scanning line of one side of upper half of the screen at first ¼ period (first sub-field) of 1 frame period as shown from FIG. 22A in FIG. 22. In the following ¼ period (second sub-field, the second signal (black display signal) is written in the pixel of (Gt/2+1)th to Gt-th scanning lines) at the same time in scanning lines in lower half of the screen (FIG. 22E and FIG. 22I). In addition, in the following ¼ period (third sub-field), the first signal is written in the pixel on the scanning line in lower half of the screen. In the remainder ¼ period (fourth sub-field), the second signal is written in the pixel on the scanning line in upper half of the screen at the same time. Then, the display is not performed by turning off the backlight in the writing period of the first signal, and the backlight is turned on in the second and the fourth sub-fields (see FIG. 22I). In FIG. 22I, the backlight is turned on in the second and the fourth sub-fields in 1 frame period FIG. 23A to FIG. 23D show one example of the display image displayed by the driving method according to the embodiment. Respectively, FIG. 23A to FIG. 23D show the screen corresponding to the first to fourth sub-fields shown in FIG. 22A to FIG. 22I. The screen in the same phase is displayed in the lump as shown in FIG. 23A to FIG. 23D. Therefore, the inclining phenomenon is not caused. It is display duty of 25% in the embodiment. Therefore, it is effective when fast movement is displayed.

FIG. 24A to FIG. 24I are waveforms when slow movement is displayed by driving method of the embodiment. In this case, 1 frame period is divided into first to fourth sub-fields. The first signal is written in the pixel on first to (Gt/2)th scanning lines in the first sub-field. The second signal is written in the pixel on (Gt/2+1)th to Gt-th scanning lines immediately before the end of the second sub-field. The first signal is written in the pixel on (Gt/2+1)th to Gt-th scanning lines in the third sub-field. The second signal is written in the pixel on first to (Gt/2)th scanning lines immediately before the end of the fourth sub-field. The inclination of the image does not become a disadvantage since movement of the moving object is slow with such driving. In a word, though the screen in which the phase is shifted in a certain period in 1 frame period is displayed on the upper and lower half of the screen at the same time, it is hard to confirm visually the deviation since the movement of the moving object is slow and the deviation is small.

FIG. 25A to FIG. 25D show one example of the display image displayed by the above-mentioned driving method. FIG. 25A to FIG. 25D correspond to the first to fourth sub-fields shown in FIG. 24A to FIG. 24I, respectively. The image in lower half of the screen is an image of one previous frame in the second field for the image in upper half of the screen. Therefore, the image in lower half of the screen only shifts to the image in upper half of the screen and is displayed (see FIG. 25B). However, the phenomenon that the amount of movement inclines small is not confirmed visually easily since movement is slow. Brightness can be raised as display duty of 50% by using the driving method of the embodiment.

The power dissipation can be decreased by decreasing the writing frequency of the image in the signal line driving circuit 25 like this, and blinking the backlight. In the driving method, of the embodiment, the display duty can be easily changed according to the display image and unsharpness of the image can be prevented. As a result, the image display with high quality becomes possible.

Figure 26:
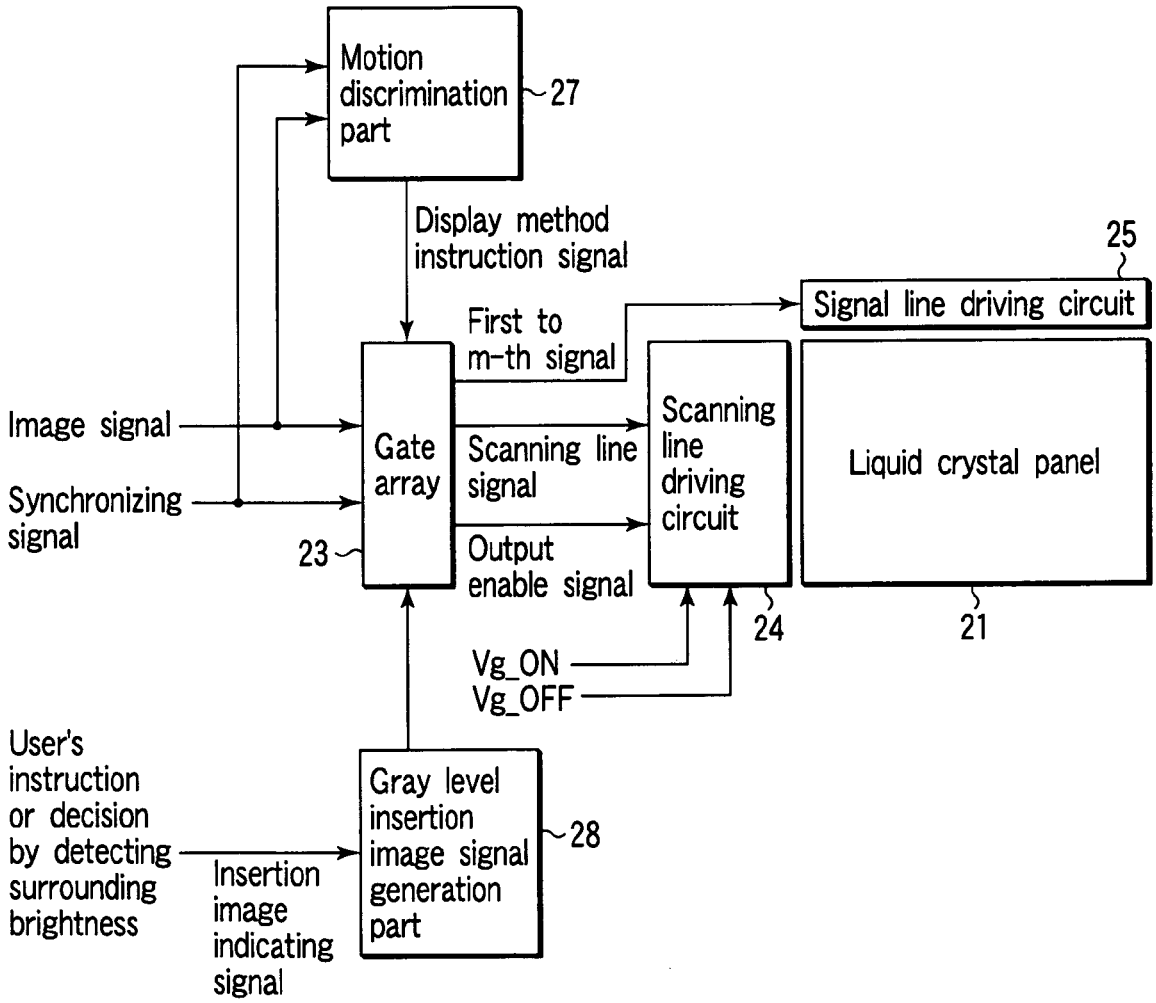
FIG. 26 is a figure, which shows a configuration of a liquid crystal display device used for a driving method according to the sixth embodiment of the present invention.

Next, the sixth embodiment of present invention will be explained. This embodiment prepares and uses the gray scale display by preparing the reset signal in the driving method according to the fifth embodiment to be a gray-scale signal substituting a black display. The contrast lowers by preparing and using the gray scale display. However, when the difference between brightness and the display brightness in the surrounding grows, it is understood that the contrast discrimination range lowers. Especially, when brightness in the surrounding rises, the influence is large. The ability (contrast discrimination value) falls on about 80% at each person visual when brightness in the surrounding increases for example for the display brightness by a factor of ten. However, since the contrast discrimination value depends on the absolute value of the display brightness, it is not uniquely decided. The liquid crystal display device for which the driving method of the embodiment is used has a configuration, which can be seen and adjusted easily when the user gives priority to brightness to the contrast. Then, the display device for which the driving method of the embodiment is used as shown in FIG. 26 newly comprises a gray level insertion image signal generation part 28 to create the gray level image to be inserted to the liquid crystal display device as shown in FIG. 11. The gray level insertion image signal generation part 28 creates gray-scale lusterware image, and sends the lusterware image to the gate array 23. The lusterware image is transmitted to the liquid crystal module as the third signal.

The user may decide which gray-scale is selected as mentioned above. The optical detection part (It is possible to take out as a signal by using, for example, the photodetector and the current voltage converter) is provided in the part around the panel, and adjust the gray-scale according to brightness in the surrounding.

In the driving method of the embodiment, the display duty can be easily changed according to the display image. In addition, unsharpness of the image can be prevented. As a result, the image display with high quality becomes possible.

The seventh embodiment of present invention will be explained. This embodiment uses a gray-scale display method. The FRC technology which displays two or more times for 1 frame period is widely used to display a gray-scale any more, when the signal line driving circuit which can display the number of gray-scales to express color of each color RGB (R=red, G=green, B=blue) respectively by 64 steps (six bits). The FRC technology is used in a still image in the embodiment. The refreshing rate which shows the screen is rewritten in the motion image is raised. In a still image, the picture quality can be improved with more gray-scales. However, in the motion image, it is more effective to raise the refreshing rate which rewriting the screen than to increase the number of gray-scales.

Figure 27:
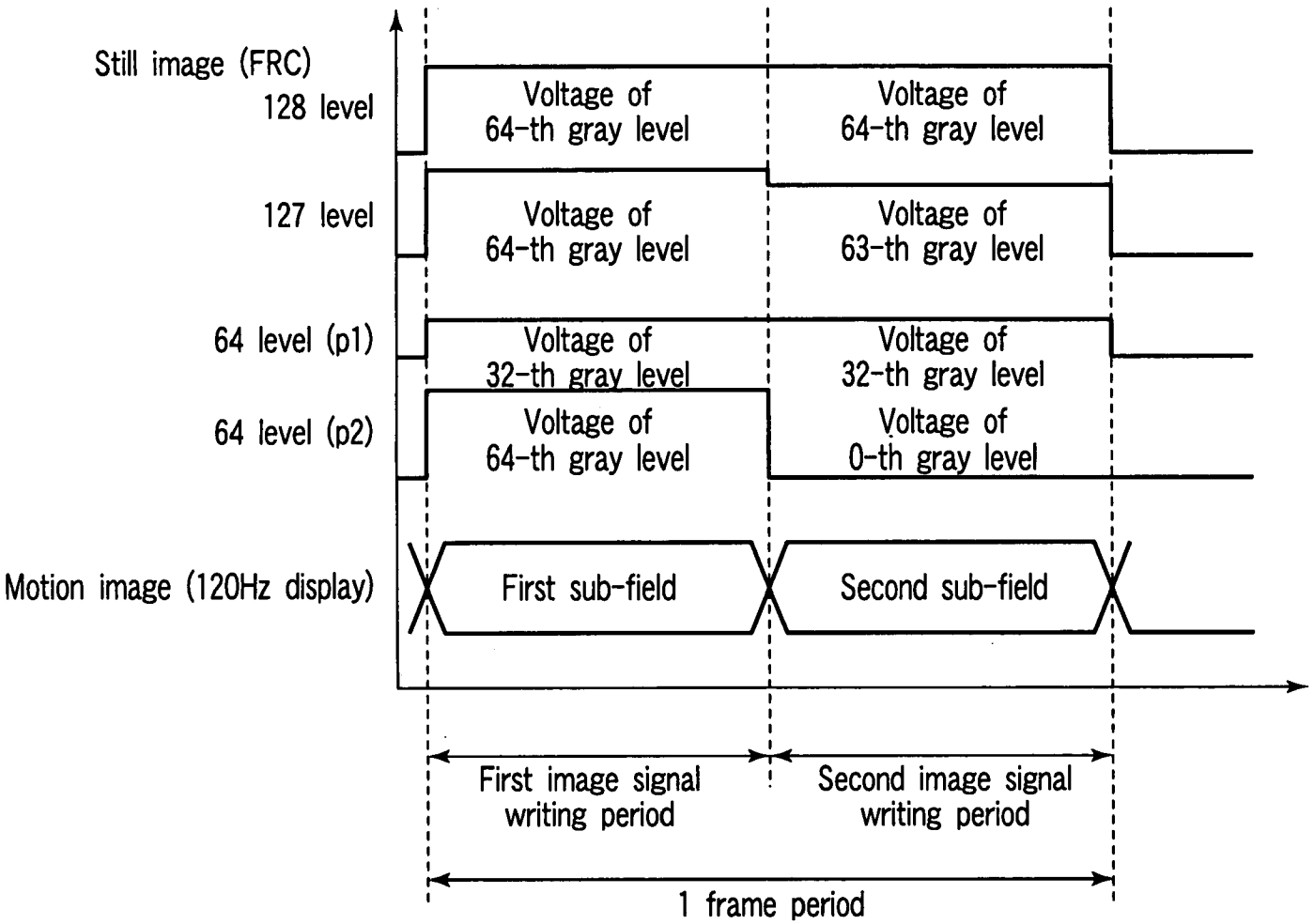
FIG. 27 is a signal waveform chart to explain an operation of a driving method according to the seventh embodiment of the present invention.
Figure 28:
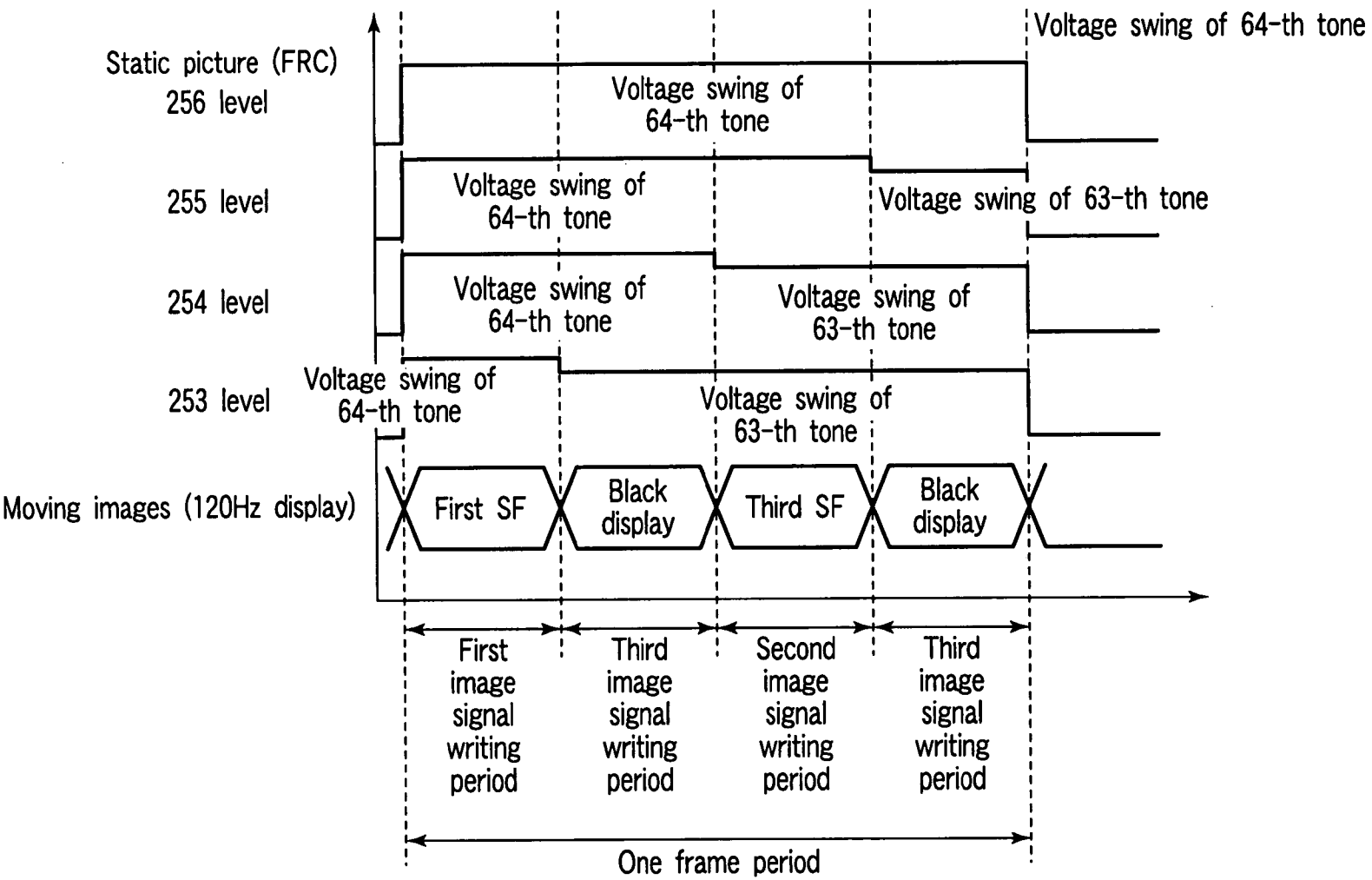
FIG. 28 is a signal waveform chart to explain an operation of a driving method according to the seventh embodiment of the present invention.

In the embodiment, both the first signal and the second signal input the signal with 64 gray-scales and displays with 128 gray-scales in a still image as shown in FIG. 27. Both the first signal and the second signal input the signal with 64 gray-scales in the motion image. However, high refreshing (120 Hz) display with 64 gray-scale is performed by transmitting the image to which a time phase shifts in the motion image. 1 frame is constructed by two sub-field images of the first and second sub-fields. The original picture image is displayed in the first sub-field as the first signal. The interpolation image created by the previous frame image and the current frame image is displayed in the second sub-field as the second signal. When the signal line driving circuit can be written up to four times velocity at high speed, the following method may be adopted. A static image is displayed with 256 gray-scales. 1 frame is divided into four sub-fields as a motion image. And, the original picture image is displayed in the first sub-field as the first signal. And, it is assumed to be 240 Hz refreshing rate display which shows the interpolation image with a different phase is displayed respectively on the second, third, and fourth sub-fields. The original picture image is displayed in the first subfield as the first signal, the interpolation image is displayed in the third sub-field as the second signal, and a black image is displayed in the second and the fourth sub-fields as the third signal as shown in FIG. 28. As a result, the motion image with higher quality can be displayed though it is 120 Hz refreshing rate.

Figure 29:
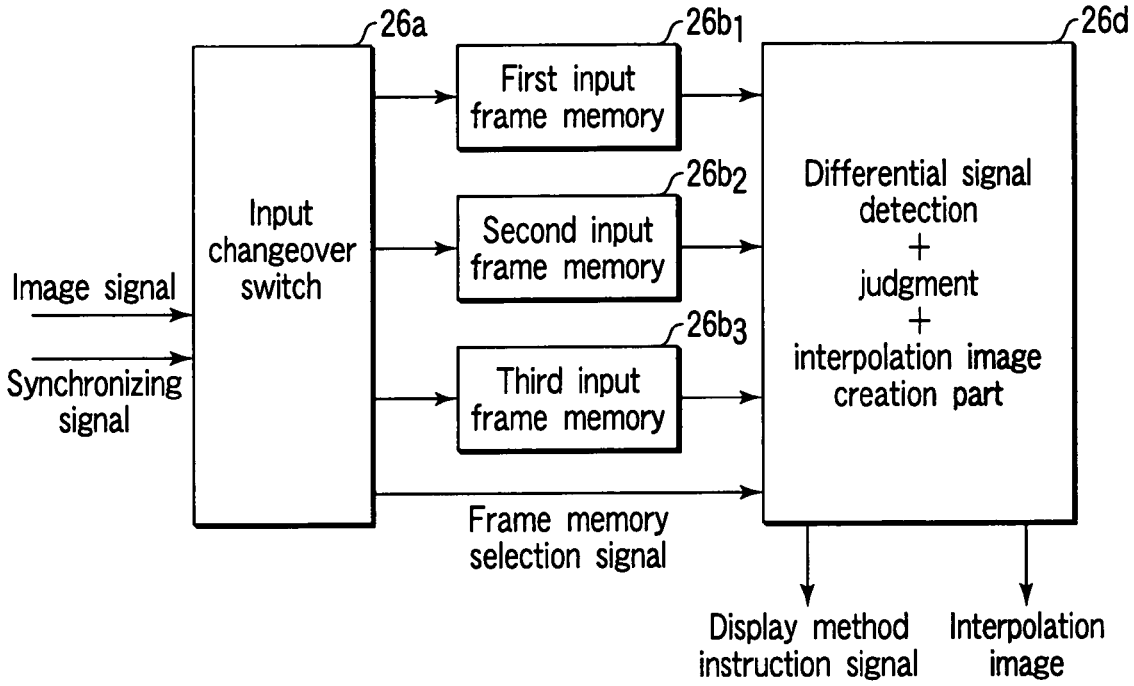
FIG. 29 is a figure, which shows a configuration of a liquid crystal display device used for a driving method according to the seventh embodiment of the present invention.

A creation of the interpolation image will be explained, when the input signal source is a signal of 60 Hz refreshing rate. The creating method of the interpolation image has a method of extracting the change area and the image information after change from the movement vector in MPEG4 and replacing the change area with the image information in the frame memory (frame memory shown in FIG. 15 can be used) (see Japanese Patent Application KOKAI Publication No. 11-89327), and an interpolation method (Japanese Patent Application KOKAI Publication No. 7-107465). The decision of the display method and the creation of the interpolation image is performed by the differential signal detection+discrimination+interpolation image creation part 26*d* with the differential signal detection, the discrimination function, and the interpolation image creation function as showing in FIG. 29, though the explanation of details is omitted here. The display method instruction signal, which shows the decided display method and the generated interpolation image are sent to the gate array 23, and transmitted to the liquid crystal module thereafter.

In the seventh embodiment, it becomes possible to display the image with high quality also.

In third to seventh embodiment, the signal line driving circuit supplies first to m-th signals (m is an integer of two or more) to each signal line. The display period of first to m-th signals in each pixel will be explained as follows.

All processes from writing of the first signal to writing of the first signal again in the pixel are assumed to be 1 frame period. And, it is considered that second to m-th signals are applied to each signal line for n times (n is an integer of two or more) respectively. It is assumed m=3 and n=4, for example. There is the first, second, and third signal as a kind of the signal. The first signal (image signal) is a signal written in each pixel. Therefore, the first signal is input to pixel arranged to directional of the column at Pxv times. The second signal and the third signal are input at arbitrary intervals for four times. Total Sn of the signals supplied to the signal line is shown by the next equation.

$$Sn=Pxv+4\times 2 \tag{2}$$

In this case, the input frequency of the second signal and the input frequency of the third signal may differ from each other such as n2 and n3, respectively. In that case, Sn is shown by the following equation (3).

$$Sn=Pxv+n2+n3 \tag{3}$$

The input timing of the second and third signal can be changed according to the image. When the number of signals input until the second signal is input is assumed to be k2 after the first signal is input and the number of signals input until the third signal is input is assumed to be k3 after the first signal is input (affix character means the second signal and the third signal respectively), a display period T1 of the first signal, a display period T2 of the second signal, and a display period T3 of the third signal and in each pixel are shown from the following equations (4) by (7). Ttotal indicates 1 frame period here.

$$T\text{total}=T1+T2+T3 \tag{4}$$

$$T1=T\text{total}\times(k2/Sn) \tag{5}$$

$$T2=T\text{total}\times((k3-k2)/Sn) \tag{6}$$

$$T3=T\text{total}\times((Sn-k3)/Sn) \tag{7}$$

In above-mentioned example, the display method in which the third signal is written continuously to the second signal will be explained.

when display duty of 50% is performed with the motion image for example, the method of the difference of the display method according to the image inputs the black display signal as the second signal. In this case, when the liquid crystal display device used is normally black, the voltage that the voltage is not applied to the liquid crystal material can be assumed to be a reset signal. It is necessary to perform an image writing and a black display one by one in each pixel at the case with a liquid crystal display device, which always lights the backlight though the driving method is different according to the liquid crystal display device. That is, the first signal is executed by assuming the image signal and the second signal to be a black display signal, and inputting the second signal between the first signals of each pixel. After the first signal is input, the second signal after Ttotal/2 will be written about a certain pixel. In this case, Sn, K2, and T1 are shown from equation (8) by (10) respectively.

$$Sn=Pxv+Pxv=2Pxv \tag{8}$$

$$k2=\text{Pxv} \tag{9}$$

$$T1=T\text{total}\times(k2/Sn)=T\text{total}/2 \tag{10}$$

When the displayed image is overall dark, and the outside light from the surrounding is a little in the reflection type liquid crystal display device, a gray display which is not a black display as the second signal but gray-scale may be performed to raise the brightness of the entire screen.

To change the number of colors and the refreshing rate with a still image and the motion image, in a still image, the first signal and the second signal are the image signals in both eight bits, it is assumed T1=Ttotal/2, and it is FRC display method in nine bits when extending to 1 frame. In the motion image, the first signal is displayed, and the image signal in eight bits is displayed and the second signal black is displayed, it is assumed T1=Ttotal/2, and it is also possible to display by the display method of display duty of 50%. The high refreshing rate display method becomes possible by assuming the first signal and the second signal, an image signal to which the phase shifts with time.

In the above-mentioned embodiment, the liquid crystal display method of changing the display duty for 1 frame image. The embodiment is the liquid crystal display method to divide 1 frame image to a plurality of areas and change the display duty for each area.

Figure 30:
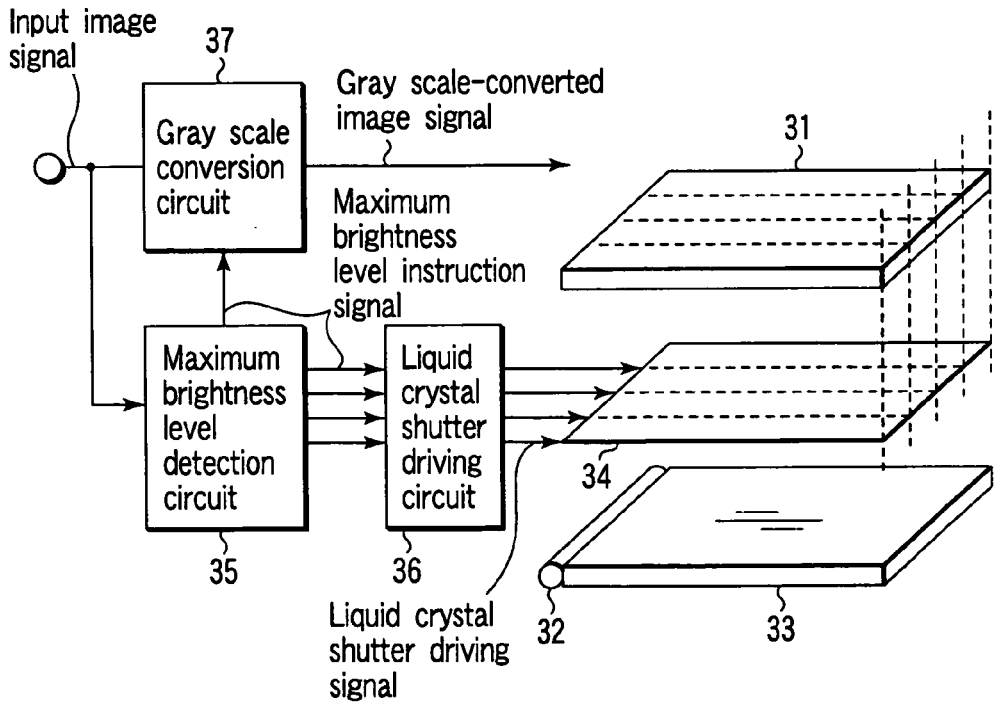
FIG. 30 is a block diagram, which shows an example of a configuration of a liquid crystal display device according to the eighth embodiment of the present invention.

FIG. 30 is a block diagram, which shows an example of a configuration of a main part of the liquid crystal display device according to the eighth embodiment of the present invention.

A basic configuration of the liquid crystal panel 31 is almost similar to the configuration of liquid crystal panel 11 in the first embodiment shown in FIG. 2, but in the embodiment, the configuration of the lightening part provided to the back side of the liquid crystal panel 31 is different from the first embodiment.

The lightening part in the embodiment is divided into the plurality of areas postponed to directional of scanning line of the liquid crystal panel 31 (horizontal direction), respectively, like the stripe. The lightening/non-lightening of each area can be controlled. The method of lightening such division includes, for example, a method of dividing the lightening part into the plurality of areas of the horizontal stripes and setting up the light source in each area and a method of using EL capable of a division lighting in the horizontal stripe etc. In the example of the following description, a case of the division lightening is performed by the liquid crystal shutter will be explained.

Liquid crystal shutter 34 is arranged between backlight part and the liquid crystal panel 31 which consists of the light source 32 and the lightguide 33. In the embodiment, the liquid crystal shutter is placed between the backlight part and the liquid crystal panel, but the liquid crystal shutter may be placed on the liquid crystal panel. In this example, the liquid crystal shutter 34 is divided into four like the horizontal stripe. When the liquid crystal shutter 34 shows the transmitting characteristic when the voltage is applied and no transmitting when no voltage is applied, on/off of the liquid crystal shutter 34 in the backlight part, that is, on/off can be controlled like the horizontal stripe by controlling the voltage application/no application of each of four divided ITO electrode areas.

The liquid crystal shutter 34 is driven by the liquid crystal shutter driving circuit 36. The maximum brightness level detection circuit 35 is connected with the liquid crystal shutter driving circuit 36. The maximum brightness level detection circuit 35 detects each maximum brightness level of the image displayed in each image display area of the liquid crystal panel 31 corresponding to each division area of the liquid crystal shutter 34. In the embodiment, each maximum brightness level of the image displayed in the area divided into four like the horizontal stripe is detected. The division method is not limited like the horizontal stripe but a vertical stripe, the matrix or other division methods may be adopted. A basic function of the gray scale conversion circuit 37 is similar to the gray scale conversion circuit of the first embodiment.

Figure 31:
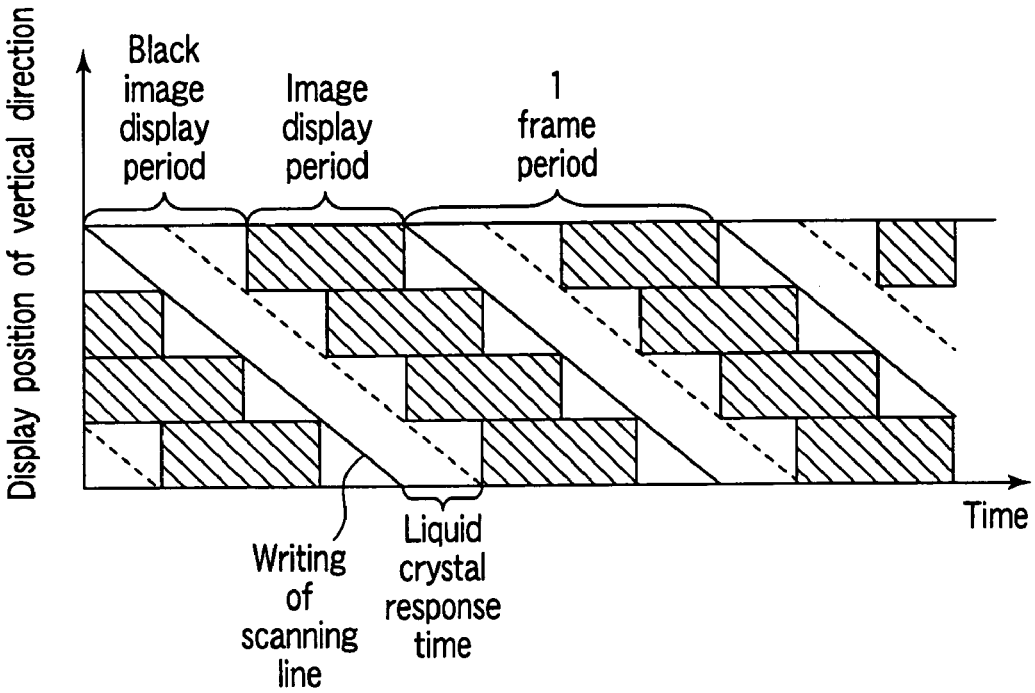
FIG. 31 is a figure to explain an operation of a liquid crystal display device according to the eighth embodiment of the present invention.

FIG. 31 is a figure, which shows one example of timing which shows image, which corresponds to image signal in each area of the liquid crystal panel 31 is displayed. The vertical axis shows time and the vertical axis shows the position of where the liquid crystal panel vertical is displayed.

Figure 32:
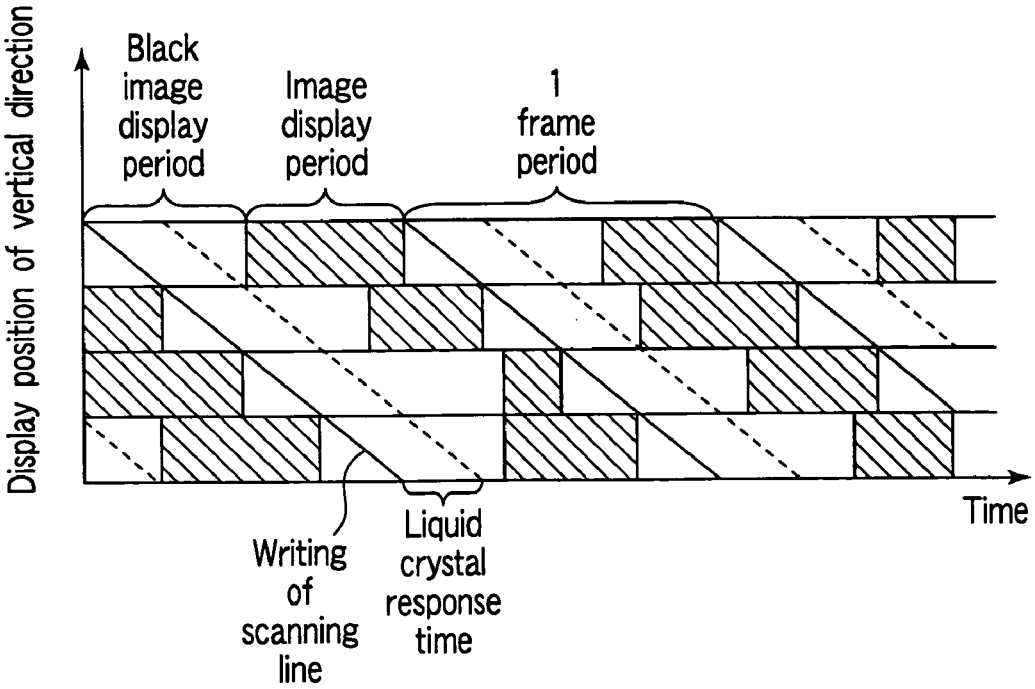
FIG. 32 is a figure to explain an operation of a liquid crystal display device according to the eighth embodiment of the present invention.

It is assumed that the image signal with the frame frequency of 60 Hz is input to the liquid crystal panel 31. When the response time of the liquid crystal of the liquid crystal panel 31 is 1/240 s, as shown in FIG. 31, when the corresponding division area is turned on (state of the transmitting) after completing the response of the liquid crystal corresponding to the area, each image display period of each division area becomes 50% for each division area of the liquid crystal shutter 34. As shown in FIG. 32, arbitrarily changing the ratio of each division area at the image display period within the range of 50% or less becomes possible by changing timing when each division area of liquid crystal shutter 34 is turned on according to the maximum brightness level of each division area detected by maximum brightness level detection circuit 35.

In the embodiment, the input image signal is input to the liquid crystal panel 31 without changing the frame frequency thereof. It becomes possible to lengthen an on period of the liquid crystal shutter 34, in a word, lengthen the image display period by raising the frame frequency of the image signal input to the liquid crystal panel 31 with the technique same as the first embodiment In the embodiment, since the ratio of the image display period and the black display period is changed according to the brightness of the image which should be displayed, the motion image with sharpness of the small image deterioration for which white brightness is secured can be presented to the observation person as well as the first embodiment. Since the ratio of each division areas at the image display period and the black display period is changed, a detailed control becomes possible, and a further improvement of the picture quality can be achieved.

A basic configuration of the ninth embodiment is similar to the second embodiment. In the second embodiment, the maximum brightness level is detected for the input image signal of 1 frame period, and the image display period and the black display period are changed every 1 frame. In the embodiment, the maximum brightness level of each plurality of area, which consists of one line or two or more lines is detected, and the image display period and the black display period of each area are changed. That is, as well as the first embodiment, the writing start timing of each area of the black display signal is changed according to the maximum brightness level. The gray-scale of the display image of each area is converted by the method same as the eighth embodiment.

In the embodiment, since the ratio of each division areas at the image display period and the black display period is changed according to the brightness of the image, the same effect as the eighth embodiment can be achieved.

The tenth embodiment is an embodiment which controls (changes) the ratio of the lightening period and non-lightening period of the lightening part and controls (changes) the brightness of the lightening light.

For example, in the configuration of the first embodiment shown in FIG. 2, it becomes possible to comparatively easily control the brightness of the backlight part by controlling the amount of the current by using LED for light source 12. At this time, the light source brightness control circuit is installed to the light source lightening control circuit 15.

The average brightness in 1 frame of the backlight part is shown by brightness×lighting duty of the backlight part (i.e., ratio of the light source at the lighting period for 1 frame period). FIG. 5 is a figure, which shows relation between the maximum brightness level and lighting duty of input image signal when brightness of backlight part is assumed to be constant. Even if the lighting duty is made smaller, the relation same as FIG. 5 can be obtained by raising the brightness of the backlight part. In a word, when the lighting duty of the backlight part of 255 the maximum brightness level is adjusted to ½ (25%), the same white brightness as the first embodiment can be obtained by doubling the brightness of the backlight part. When the maximum brightness level of the input image is 0, the brightness of the black display can be suppressed by assuming the brightness of the backlight part to be 0.

In the embodiment, the same effect as the first embodiment can be achieved. In addition, the impulse rate can be reduced when the motion image is displayed, since the brightness of the lightening light (brightness of the backlight part) is controlled. Therefore, it becomes possible to present the motion image with a small picture quality deterioration to the observer when the sharpness of the motion image can be improved further more, and the image with especially high maximum brightness level moves at high speed.

Next, display means will be explained when ferroelectric liquid crystal material having Iso.-Ch-SmC* layer transfer series is used as another liquid crystal material.

Figure 33A:
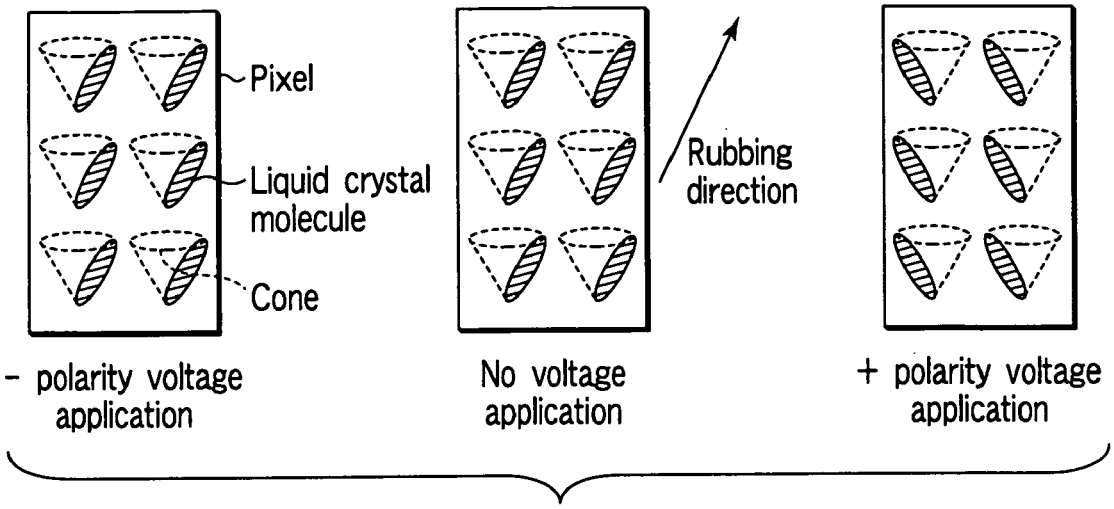
FIG. 33A and FIG. 33B are figures to observe the alignment of the liquid crystal element in which the ferroelectric liquid crystal material having Iso.-Ch-SmC * layer transfer series is monostabilized from the upper portion of the panel.
Figure 33B:
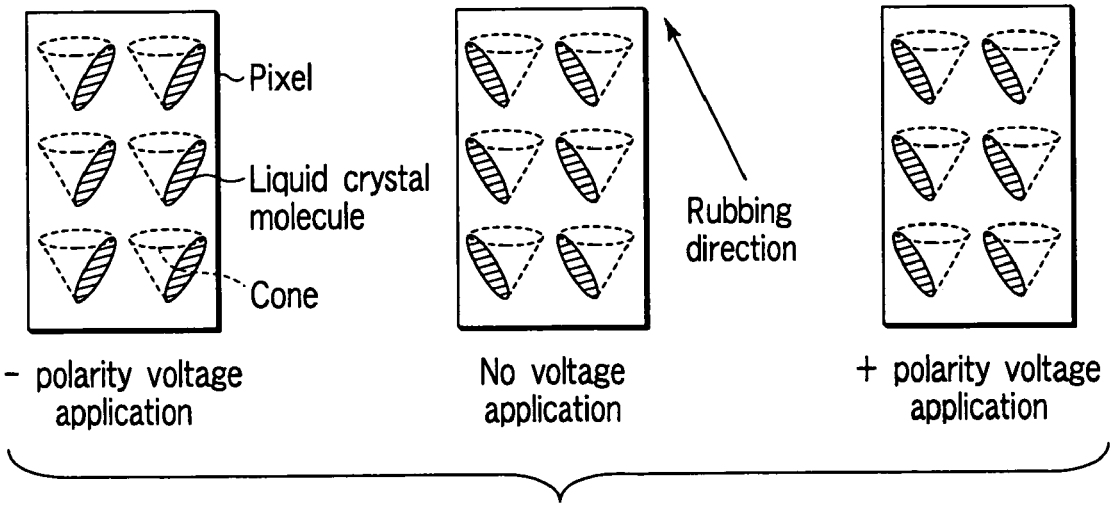

FIG. 33A and FIG. 33B are figures to observe the alignment of the liquid crystal element in which the ferroelectric liquid crystal material having Iso.-Ch-SmC * layer transfer series is monostabilized from the upper portion of the panel. In the first alignment, when no voltage is applied, a uniaxial alignment processing direction (for example, the rubbing direction) corresponds to a molecular axis. When the +polarity voltage is applied, the molecule changes on the cone according to the applied voltage. When the negative polarity voltage is applied, the molecule keeps a direction in the uniaxial alignment processing direction (FIG. 33A). On the other hand, in the second alignment, when no voltage is applied, a molecular axis corresponds to a uniaxial alignment processing direction. When the −polarity voltage is applied, the molecule changes the on cone according to the applied voltage. When the +polarity voltage is applied, the molecule keeps a direction in uniaxial alignment processing direction (FIG. 33B). If the refractive index anisotropy to which the liquid crystal has assumed to be Δn, the thickness of the cell is assumed to be d, and Δnd is set to ½ wavelength, the maximum brightness can be obtained when an angle of aperture of the molecule is 45°. These alignment is formed by cooling to about 50° C. while applying the DC voltages of −1 to −5V (forming first alignment) or 1 to 5V (forming second alignment) between each electrode after the liquid crystal element is heated to 80° C. or more.

Figure 34A:
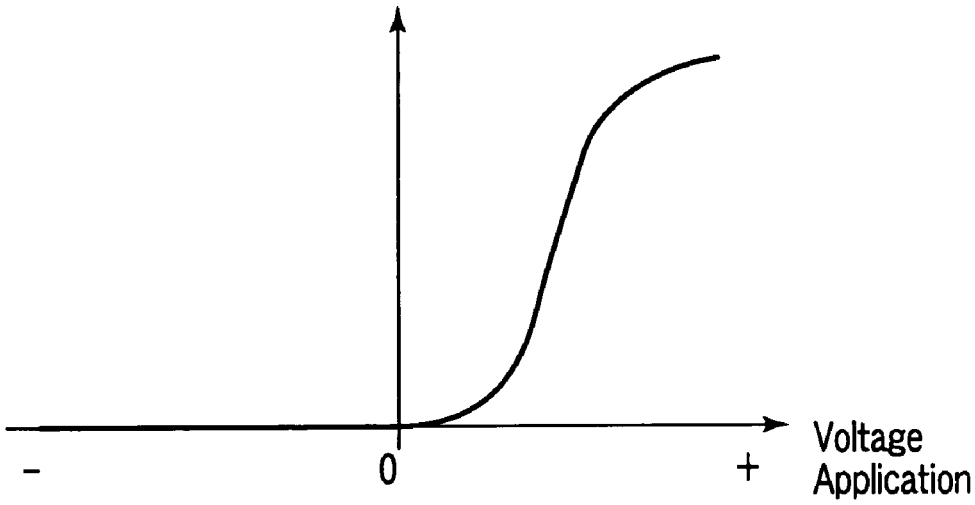
FIG. 34A and FIG. 34B show voltage-transmittance curve in first and second alignments.
Figure 34B:
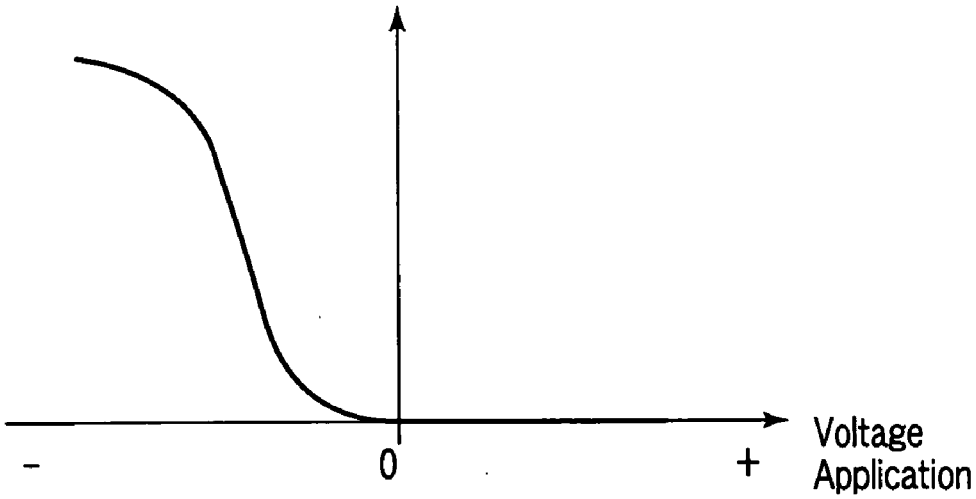

FIG. 34A and FIG. 34B show voltage-transmittance curve in first and second alignments.

In this case, the light transmits, for example, only when a positive voltage applies, for the pixel according to the liquid crystal layer with the first alignment and the light transmits, for example, only when a negative voltage applies for the pixel according to the liquid crystal layer where with the second alignment.

Figure 35:
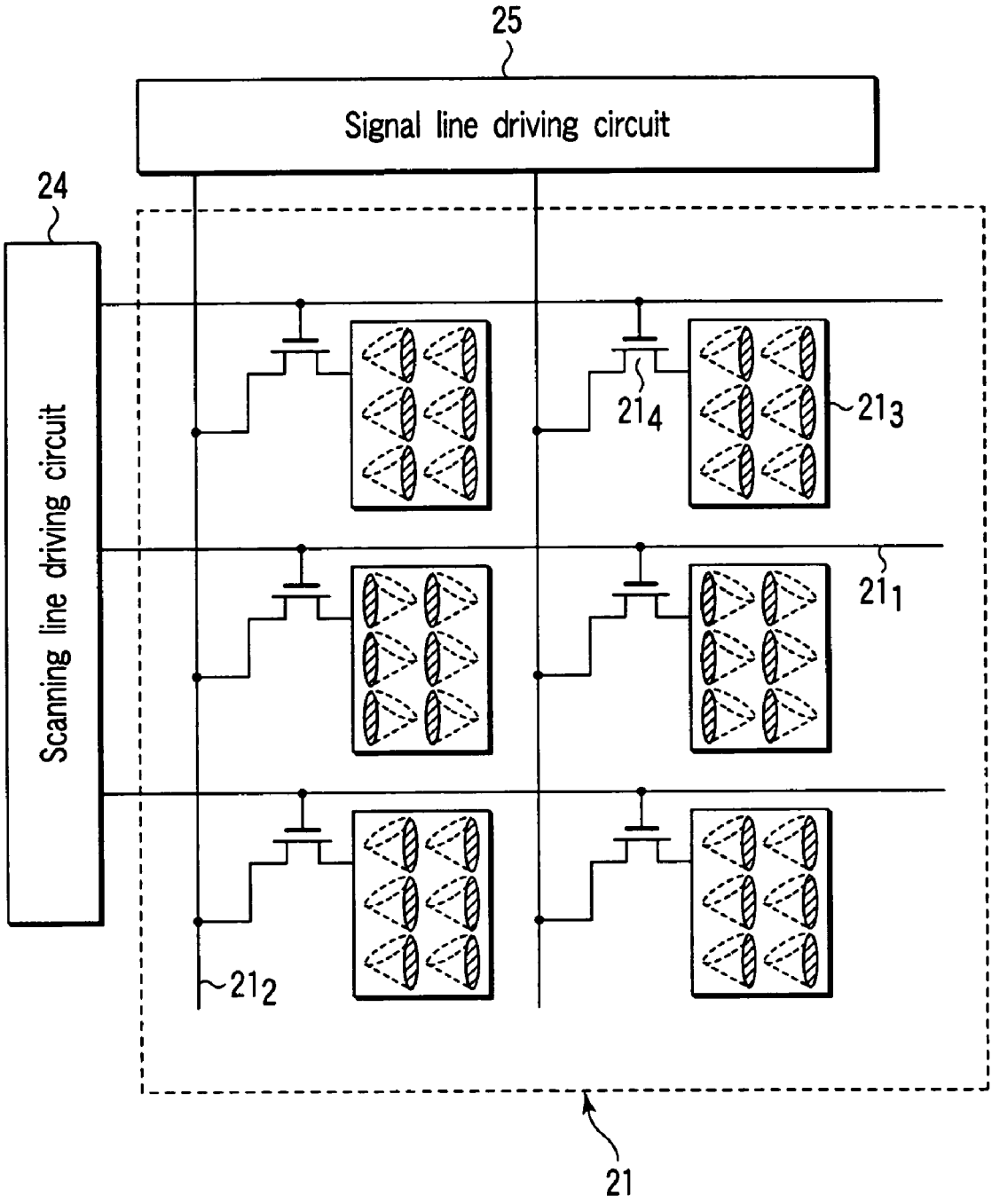
FIG. 35 is a figure, which shows a configuration of a liquid crystal display device according to the eleventh embodiment of the present invention.
Figure 36:
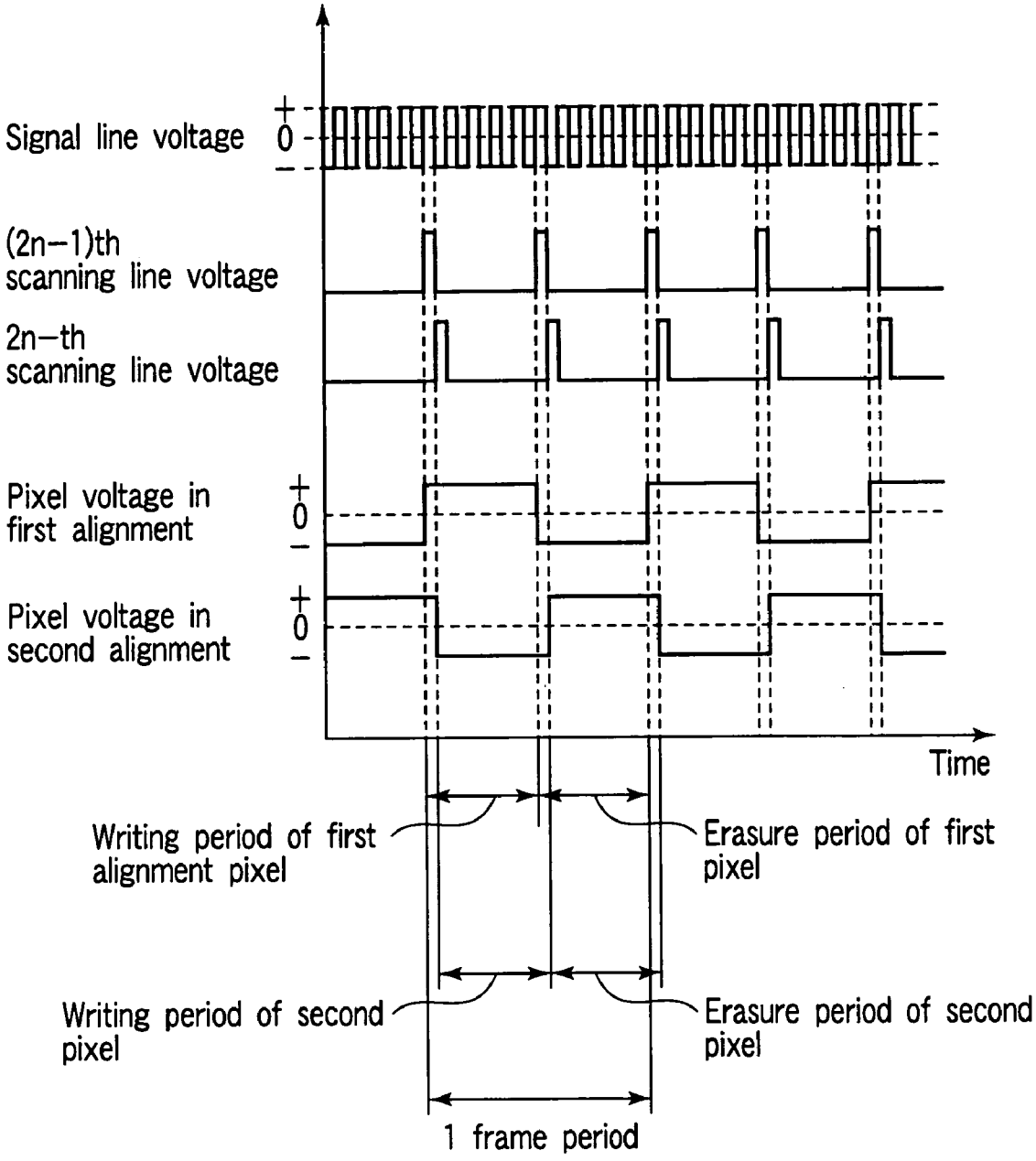
FIG. 36 is a signal waveform chart of each part when a liquid crystal display device of the eleventh embodiment is driven.

Next, the eleventh embodiment of the liquid crystal display device by the present invention will be explained referring to FIG. 35 to FIG. 37G. The configuration of a liquid crystal display device according to the embodiment is shown in FIG. 35. In FIG. 35, the same mark is fixed to the same part as FIG. 12, and a detailed explanation will be omitted. In the embodiment, the alignment of the liquid crystal layer is set for each pixel. As shown in FIG. 35, the same alignment in row direction (directional of scanning line), directional of the column for the scanning line unit, and the first and second alignments in are alternately arranged. The driving method of the liquid crystal display device according to the embodiment is a line inversion driving method. This method of the line inversion driving will be explained referring to FIG. 36. FIG. 36 shows the voltage waveform of pixel of the signal line 212, the scanning line 211, the pixel electrode 213 of the liquid crystal display device according to the embodiment driven by the above-mentioned line inversion driving method. The voltage of the signal line 212 is line-inverted and is turned on to each the scanning line 211 twice. The number of all scanning lines indicates the case of T (even number) here. When the number of all scanning line is odd numbers, it is possible to drive similarly by assuming that the 1 frame period is constructed by adding a select period of a scanning line to a sum of selected period of the total scanning period.

Writing by above-mentioned driving method will be explained referring to FIG. 36 to FIG. 37G. When the first scanning line is selected, the pixel connected with the first scanning lines is the first alignment (see FIG. 35), and becomes a writing period because the image signal is applied from the signal line by +polarity (see FIG. 37A). When the second scanning line is selected, the pixel connected with the second scanning lines is the second alignment, and becomes a writing period because the image signal is applied from the signal line by −polarity (see FIG. 37B). In the same way, when (T/2)th scanning line is selected, the pixel connected with T/2 scanning lines is the second alignment, and becomes a writing period because the image signal is applied from the signal line by −polarity, at the same time, the first scanning line also as a state of turning on and the pixel (Erase by the first alignment-polarity) connected with the first scanning lines is erased in the screen (see FIG. 37E). It is assumed that T/2 is an even number here. Similarly, when (T/2+1)th scanning line is selected, a pixel connected with (T/2+1)th scanning line is a first alignment and becomes in a writing period because the image signal with +polarity is applied from the signal line, and at the same time, a second scanning line is also in a turn on state and erases a pixel on the screen (which is a second alignment and is erased by +polarity) connected with a second scanning line (see FIG. 37F). By repeating this operation, actually, when the first scanning line is turned on, (T/2+2)th scanning line is turned on and when the second scanning lines is turned on, (T/2+3)th scanning line is turned on. Therefore, the half in the display area will actually be displayed (see FIG. 37G). The driving method according to the invention, differs from the prior art such as FIG. 8 divides 1 frame into two fields and performs erasure by using the signal of a reverse-polarity to different pixels. Therefore, the writing period twice the conventional driving method at the writing period can be secured. As a result, the lowering contrast can be prevented as much as possible.

Next, the twelfth embodiment of the present invention will be explained referring to FIG. 38A to FIG. 43. In the twelfth embodiment, the display mode, in which the period of the display and the period of non-display is switched according to the image, can be set. The display period is equal to non-display period and is display duty of 50% in FIG. 37A to FIG. 37G (It is a value, which can be disregarded though differs strictly for ½ horizontal period).

Figure 38A:
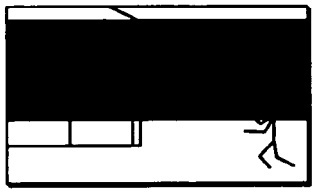
FIG. 38A to FIG. 38D are figures, which show a time transition of the display screen when a liquid crystal display device is driven by the driving method of the twelfth embodiment of the present invention.
Figure 38B:
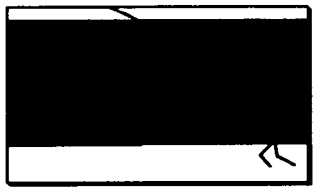
Figure 38C:
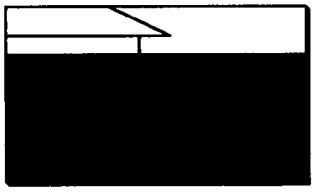
Figure 38D:
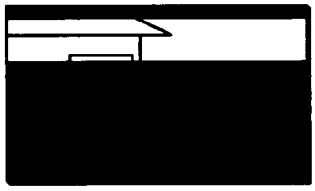
Figure 39:
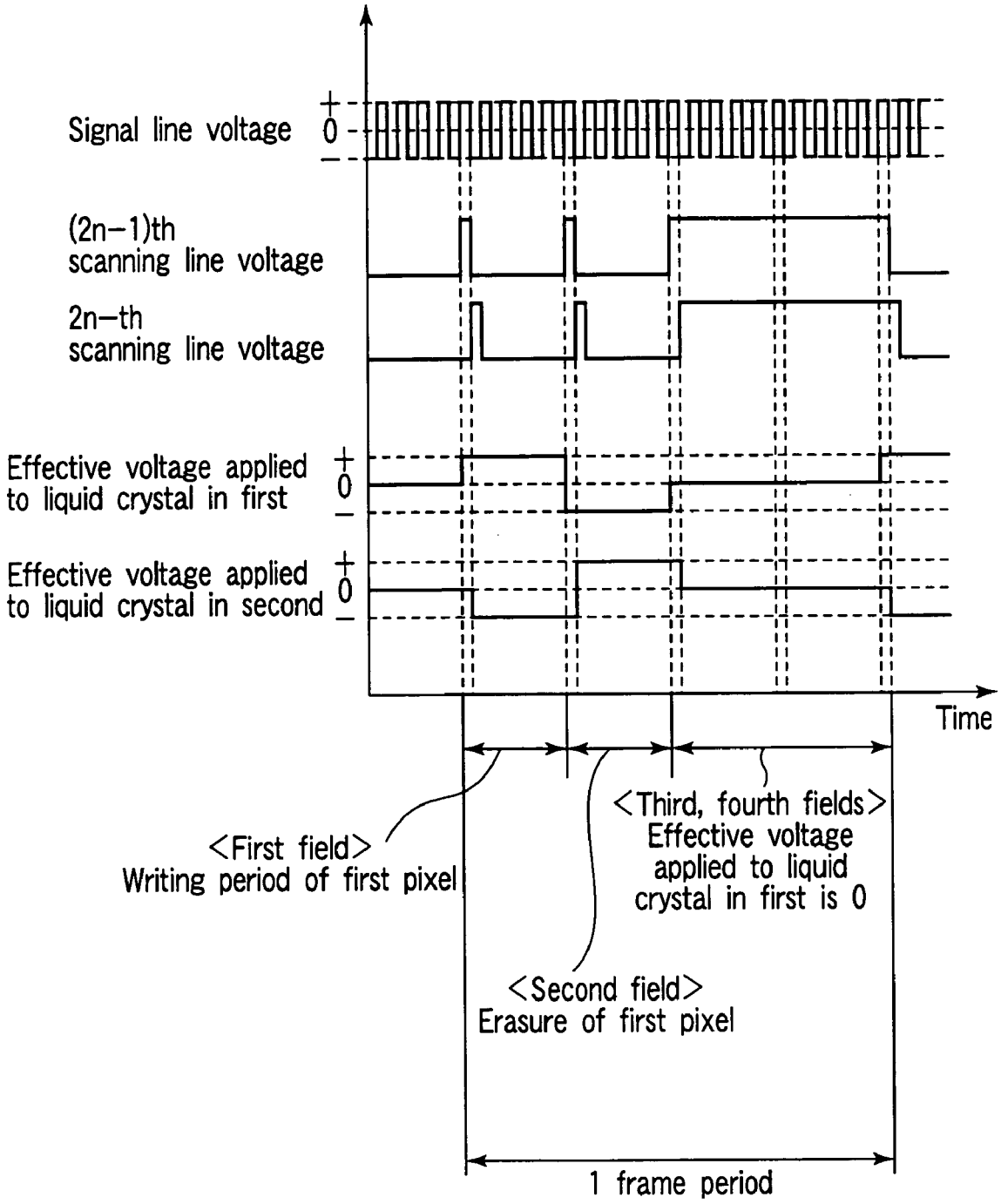
FIG. 39 is a signal waveform chart of each part of a liquid crystal display device when a liquid crystal display device is driven by the driving method of the twelfth embodiment.

When assuming display duty of 25% to further improve unsharpness of the image of the motion image by the holding characteristic first scanning line is also turned on at the same time and the pixel on the screen connected with the first scanning lines is erased, when (T/4)th scanning line is selected as shown from FIG. 38A in FIG. 38D (FIG. 38C and refer to FIG. 38D).

Basically, the display duty is made large in a still image, and the display duty is reduced in the motion image as the moving speed of the moving object becomes fast. For example, display duty of 75% is for a still image, that of 50% is for images with slow speed moving objects, and that of 25% is for images with high speed moving objects.

Here, it is considered that image sticking is occurred by occurring imbalance of +writing and −writing and applying the DC component to the pixel when the display duty does not become display duty of 50%. As a method of improving this, for example, in the display duty of 25%, 1 frame of the voltage waveform to the pixel with the first alignment is divided into four fields, the first field is a display period by +polarity writing, and third and fourth fields are periods when the effective voltage is 0 to perform +polarity writing and −polarity writing continuously. In this case, since 200 to 300 pixels are driven at the same time, if a signal line capacity for 1 signal line and the capacity of the output buffer of the driving circuit 40 is 200 pF and the unit pixel capacity is 1 pF, the signal line driving circuit 40 has the current supply ability 2–3 times signal line driving circuit 40. On the other hand, since DC is generated by the displayed polarity in display duty of 75%, it is not possible to complete erasure by the polarity at non-display period.

Figure 40:
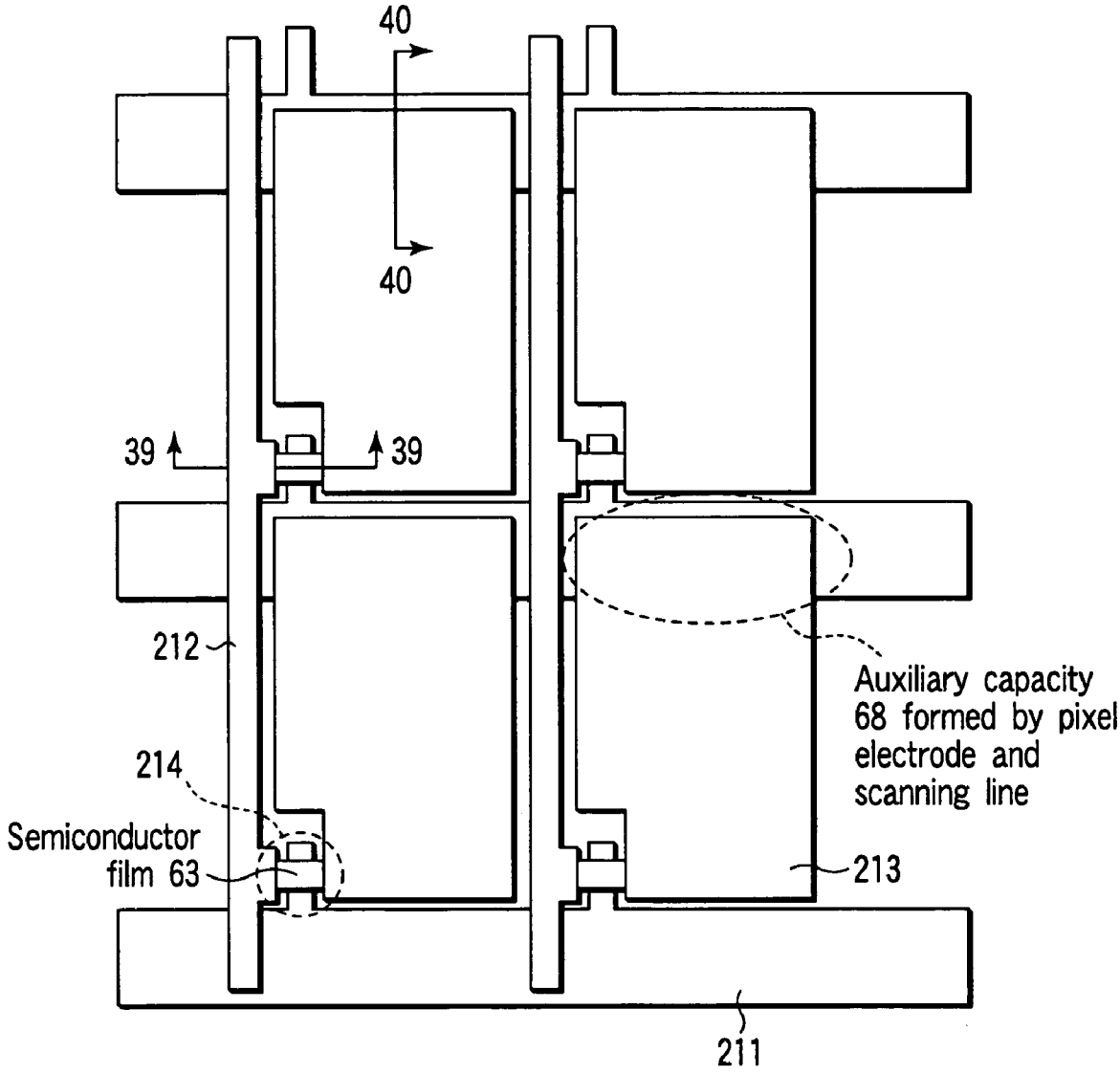
FIG. 40 is a figure, which shows another array configuration of a liquid crystal display device driven by a driving method of the twelfth embodiment.
Figure 41:
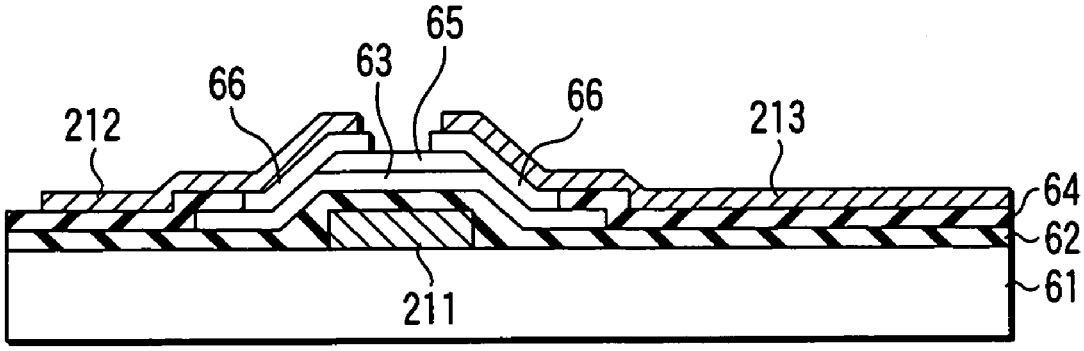
FIG. 41 is a sectional view of a liquid crystal display device when cutting along by a cutting line 39—39 shown in FIG. 40.
Figure 42:
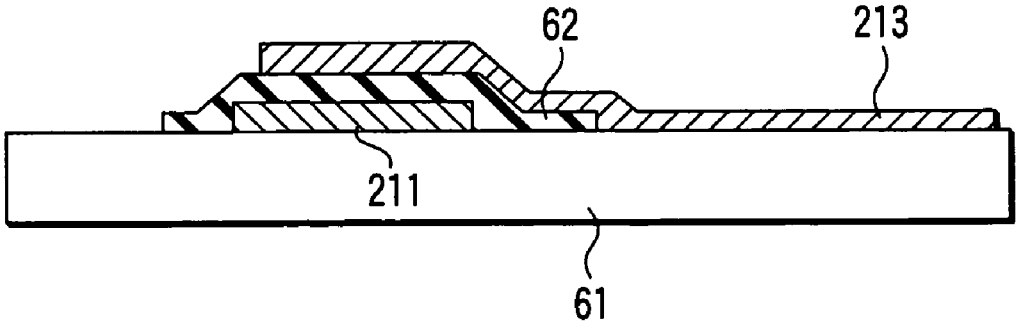
FIG. 42 is a sectional view of a liquid crystal display device when cutting along by a cutting line 40—40 shown in FIG. 40.
Figure 43:
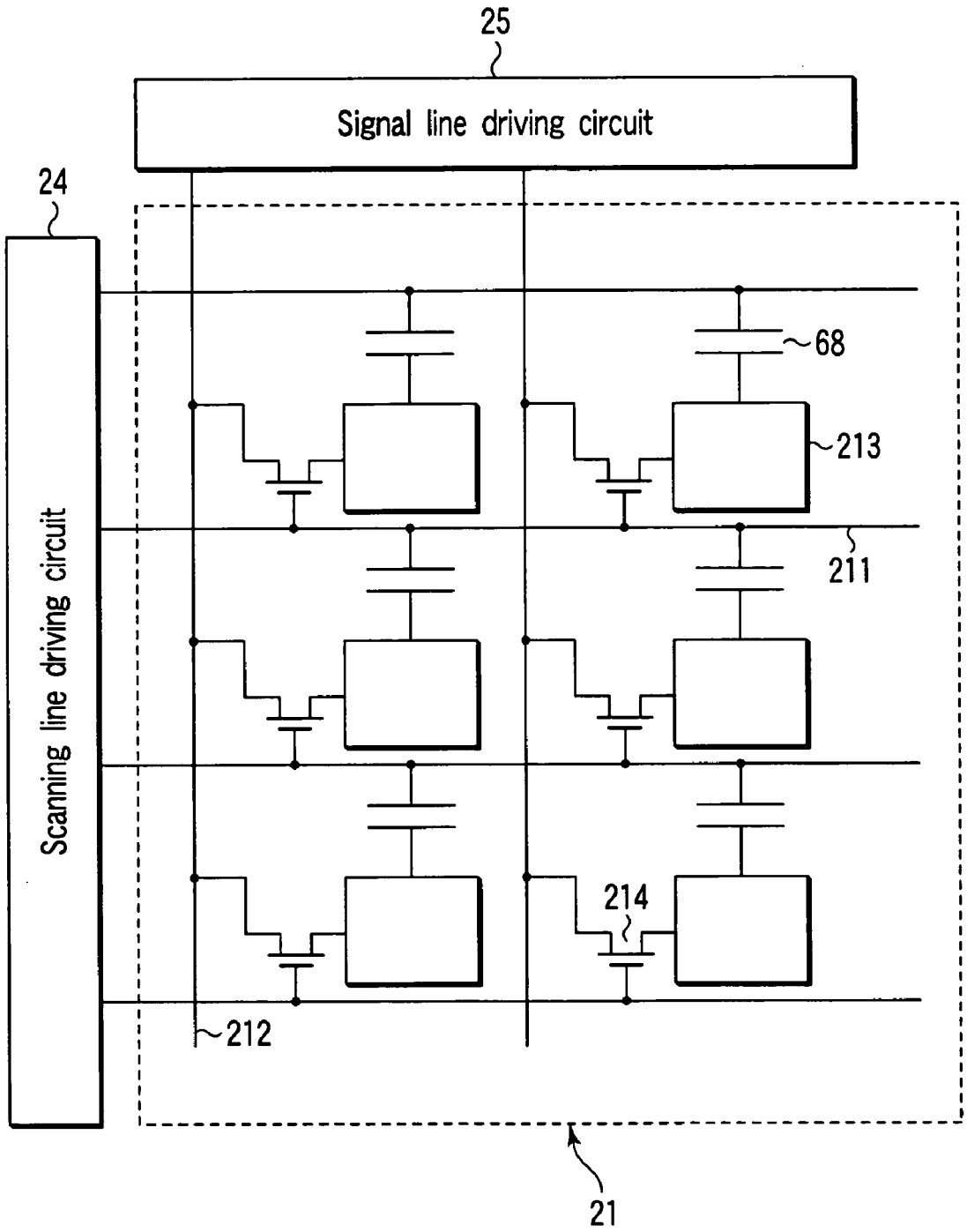
FIG. 43 is an equivalent circuit chart of a liquid crystal display device shown in FIG. 40.

Then, a liquid crystal display device configured that an excessive voltage is applied may be used. This liquid crystal display device uses the Cs on-gate structure to make an auxiliary capacity on a previous scanning line 211 as shown in FIG. 40. The sectional view of the liquid crystal display device cutting along cutting line 39—39 shown in FIG. 40 is shown in FIG. 41. The sectional view cutting along cutting line 40—40 is shown in FIG. 42. In this liquid crystal display device, the scanning line 211 is formed on the glass substrate 61. The insulation film 62 is formed so as to cover this scanning line. The semiconductor film 63, which becomes the active layer of the TFT 214 at the predetermined position, is formed on the insulation film 62. The etching stopper 65 is formed in the predetermined area on the semiconductor film 63. The insulation film 64 with the opening to, which exposes in part of the etching stopper 65 and the semiconductor film 63 at the bottom is formed on the semiconductor film 63. The semiconductor film 66 to which high density impurities, which become the source and drain of the TFT 214, are doped is formed on the exposed semiconductor film 63. The signal line 212 and the pixel electrode 213 are formed so as to connect with the semiconductor film 66, which becomes the source and drain of the TFT 214. And, the auxiliary capacity 68 is formed by arranging the electrode opposing to both the scanning line 211 and the pixel electrode 213 at the same time. Therefore, the auxiliary capacity 68 is influenced by the voltage change in the scanning line 211. FIG. 43 shows the equivalent circuit of above-mentioned liquid crystal display device. In the auxiliary capacity 68 whose one end is connected with the pixel electrode, another end is connected with adjacent scanning line 211, but is not connected with a scanning line corresponding to the above-mentioned pixel electrode.

Figure 44:
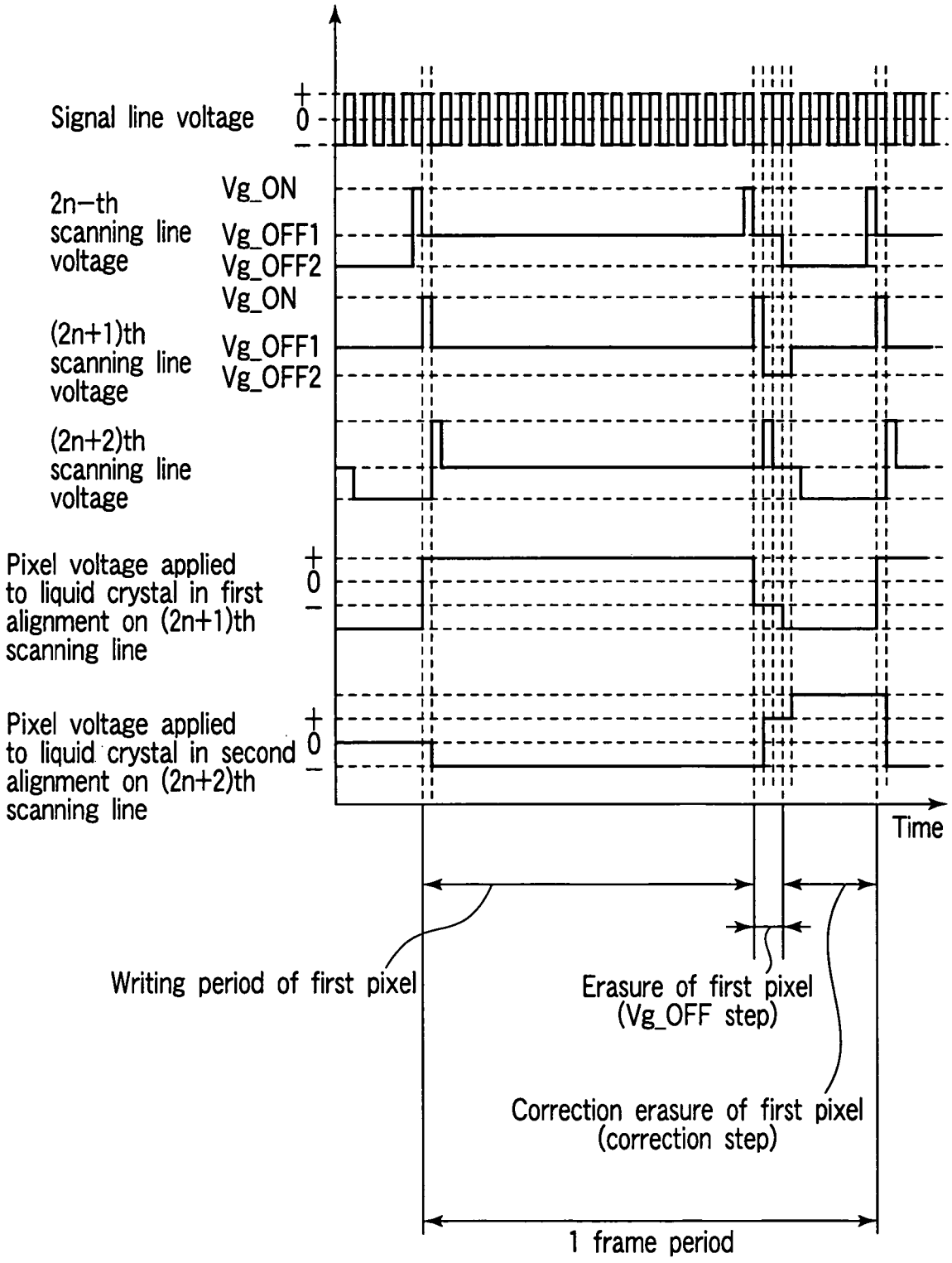
FIG. 44 is a signal waveform chart of each part when a liquid crystal display device shown in FIG. 43 is driven by a driving method of the twelfth embodiment.
Figure 45:
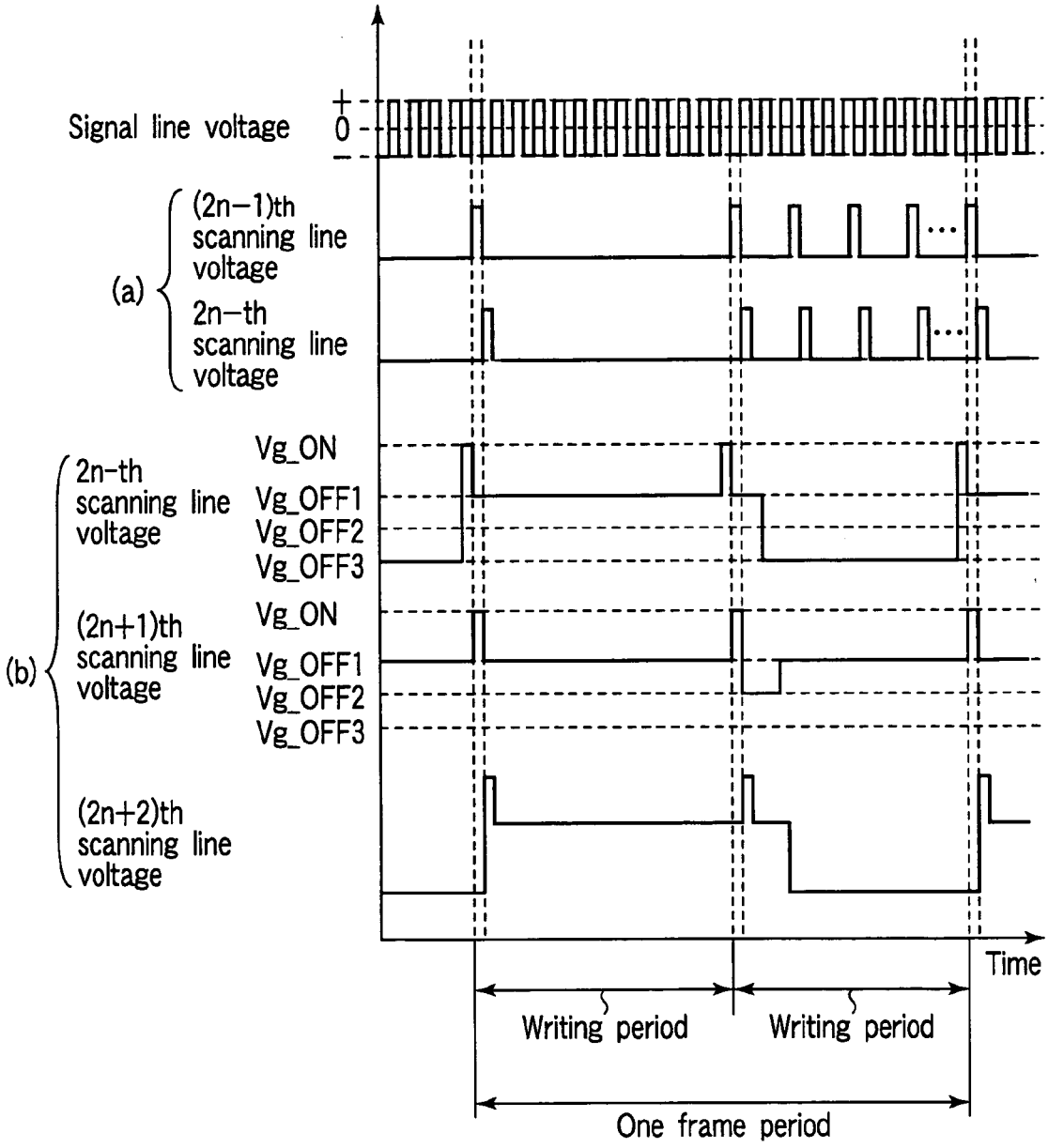
FIG. 45 is a modification of FIG. 44.

The voltage waveform of each part generated by the driving method according to embodiment is shown in FIG. 44. As shown in FIG. 44, the scanning line 211 is driven by the scanning line driving circuit, which can output three levels. One of the output values of this scanning line driving circuit is a voltage Vg_ON to turn on the switching element. The other two output values are two kinds of voltages Vg_OFF 1 and Vg_OFF 2 to turn off the switching element.

Here, the pixel (pixel electrode) in the first alignment connected with the (2n+1)th scanning line 211 is noticed. The voltage Vg_ON to write the image signal in the pixel is applied to the scanning line 211, and the voltage is written in the pixel in +polarity. After displaying for the almost ¾ frame period corresponding to display duty of 75%, the switching element 15 is turned on again, and the image is erased by using the writing signal to the pixel in the second alignment connected with another scanning line. Continuously, voltage Vg_OFF 2 is applied when the switching element is turned off. Next, to shift the pixel voltage through the auxiliary capacity, the voltage of 2n-th scanning line is shifted to lower voltage Vg_OFF 2 than voltage Vg_OFF 1. This voltage difference (Vg_OFF1−Vg_OFF 2) corresponds to the amount by which the amount with a short writing period is corrected, in −polarity.

Next, the pixel (which is connected with (2n+2)th scanning line) in the second alignment will be explained. First, to write the image signal in the pixel, the voltage Vg_ON is applied to the scanning line and the voltage is written in the pixel in −polarity. After displaying for the period by almost ¾ frames corresponding to display duty of 75%, the switching element is turned on again and the image is erased by using the writing signal to the pixel in the first alignment connected with other scanning lines (+polarity). Continuously, the voltage Vg_OFF 1 is applied when the switching element is turned off. Next, to shift the pixel voltage through auxiliary capacity, the voltage of (2n+1)th scanning line is shifted to the higher voltage Vg_OFF 1 than the voltage Vg_OFF 2. This voltage difference corresponds to the amount which corrects a short writing period in +polarity.

An originating (image originating), which originates in the image and an originating (material originating), which originates in the material are considered as a possibility that DC is generated besides above-mentioned. The image originating is a potential difference when the erase signal is greatly different from the writing signal in the driving method according to the embodiment in which the image signal of another polarity is applied to for erasure. The plurality of erase signals are added as shown in FIG. 43(*a*) to improve this. It is possible to convert a signal into the averaged signal by adding the two or more kinds of image signals. It is possible to change the number of image signals according to the image or according to the amount of image sticking though the sixth signal for the erasure is selected in FIG. 43. On the other hand, the polarization of an ion material in the liquid crystal might be different according to the polarity as the disadvantage of the material originating. In this case, the scanning line driving circuit is assumed to be 4 levels as shown in FIG. 43(*b*), and the signal level to turn off the switching element is increased to three. In FIG. 43(*b*), a case that an applied voltages of the erasure in the first alignment by −polarity becomes larger than the erasures in the second alignment by +polarity is explained. The correction voltage (Vg_OFF3−Vg_OFF 1) to the first alignment is larger than the correction voltage (Vg_OFF2−Vg_OFF 1) to the second alignment.

$$|Vg_OFF3-Vg_OFF1| \geqq |Vg_OFF2-Vg_OFF1|$$

The voltage to scanning line and the input frequencies of the erase signal etc. can be variously changed within the scope of which image sticking of the liquid crystal element (liquid crystal layer) or nor flicker is not occurred.

The explanation and the drawing will be omitted since it is almost the same configuration as FIG. 11 as for the system, which changes the display means according to the image, and it is similar excluding what Vg_OFF 1 and Vg_OFF 2 input to the scanning line driving circuit 24.

Figure 46:
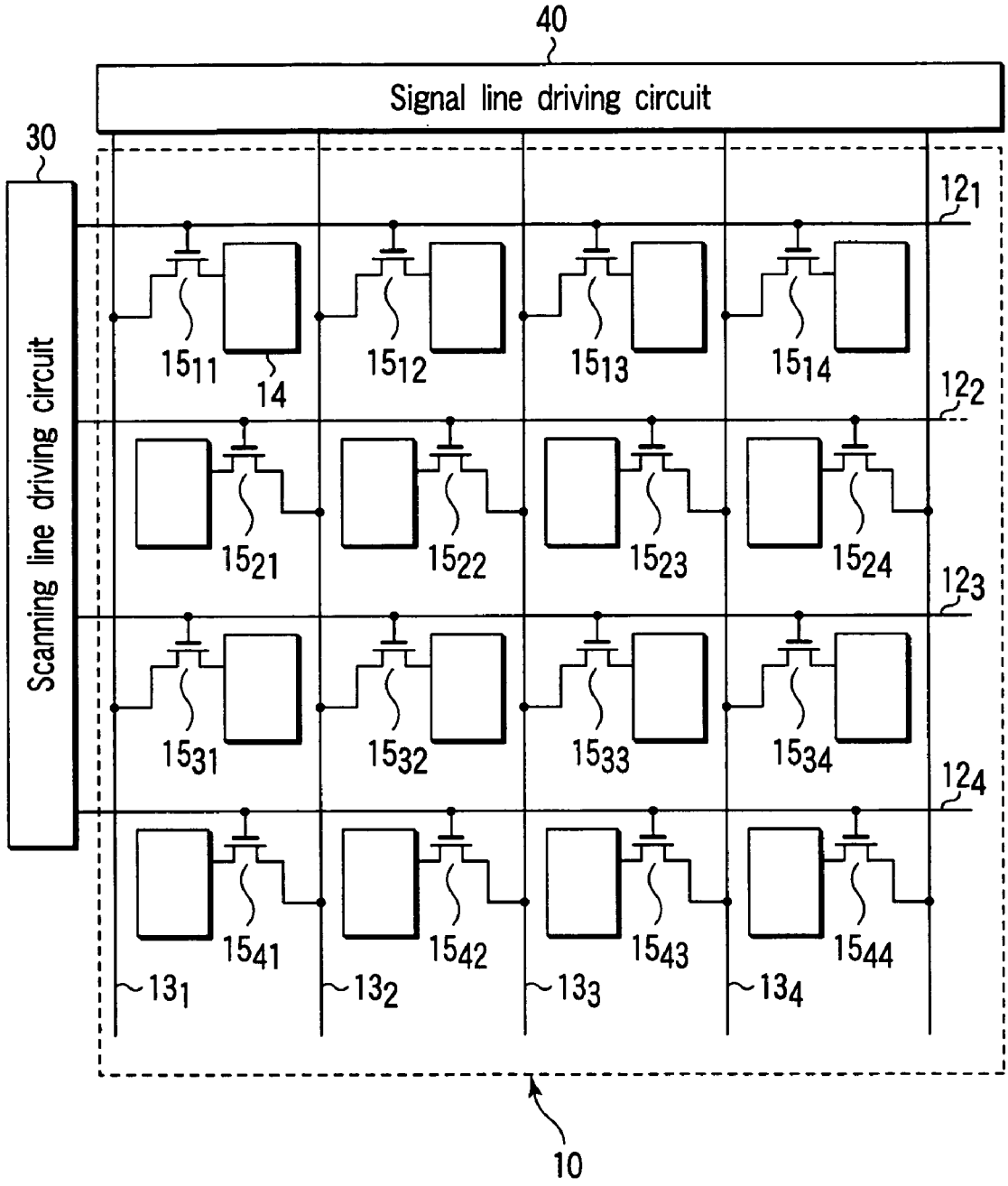
FIG. 46 is a figure, which shows an array configuration according to the thirteenth embodiment of the present invention.
Figure 47:
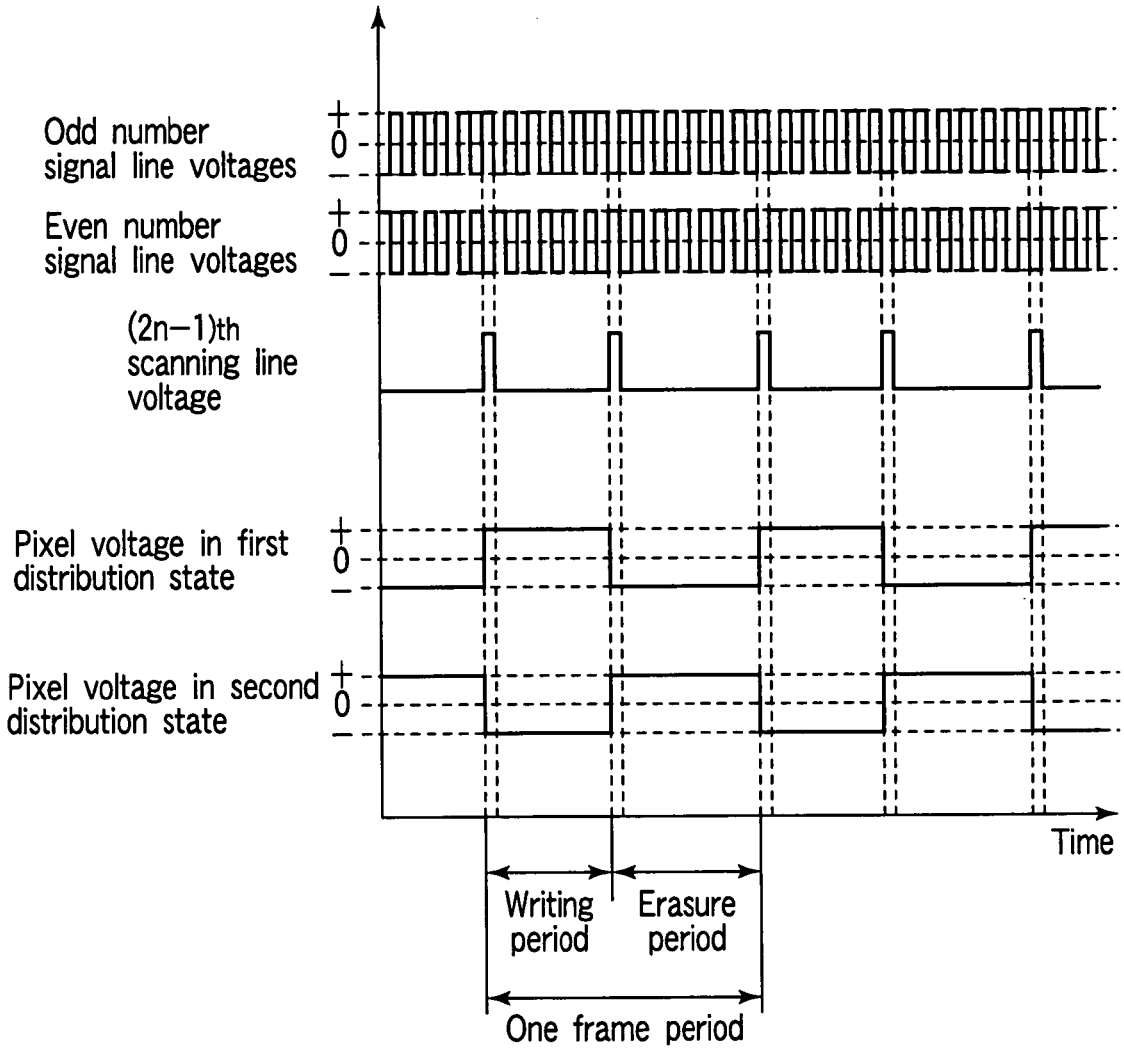
FIG. 47 is a signal waveform chart of each part when a liquid crystal display device according to the thirteenth embodiment is driven.

Next, the thirteenth embodiment of the liquid crystal display device according to the present invention will be explained referring to FIG. 46 and FIG. 47. The configuration of a liquid crystal display device of the thirteenth embodiment is shown in FIG. 46. The liquid crystal display device of the thirteenth embodiment has a configuration different from the liquid crystal display device of the eleventh embodiment, in which the array of the first liquid crystal layer and the second alignment are shown in FIG. 35.

Figure 48:
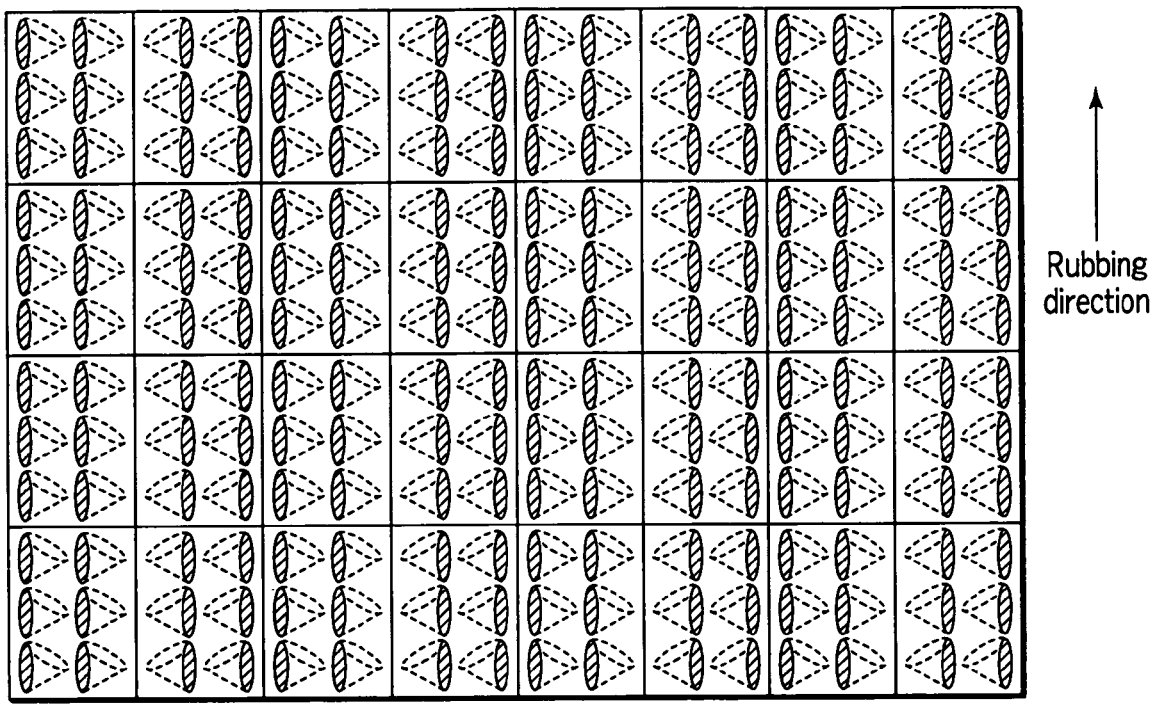
FIG. 48 is a figure to explain a signal line unit array.

In the liquid crystal display device according to the eleventh embodiment shown in FIG. 35, the arrangement of the first alignment or the second alignment is the same in pixels in row direction but is different in pixels in column direction, that is, the scanning line unit array. In the thirteenth embodiment, the arrangement of the first alignment or the second alignment is the same in pixels in column direction but is different in pixels in row direction, that is, the signal line unit array as shown in FIG. 48.

Since the signal with different polarity is input to the signal line for 1 frame period in the liquid crystal display device of the scanning line unit array and the dot unit array, the writing period and the erasure period can be provided as already explained. Then, the array configuration, which changes the connection of each the scanning line 211 of the pixel electrode 213, the TFT 214, and the signal line 212 as shown in FIG. 46 is used in the embodiment. The source of the TFT 214 whose gate is connected with the odd number, for instance, the first scanning line 2111, is connected with the signal line 212. The source of the TFT 21421 whose gate is connected with the even number, for instance, the second scanning line 211, is connected with the signal line 212 respectively, to shift to an adjacent signal line.

When the liquid crystal display device according to the embodiment constructed as mentioned-above is driven. It is possible to use for an the signal line unit arrangement by inputting the signal in which the polarity is reversed in each scanning line and in each signal line as shown in FIG. 47. However, in this case, it is necessary to horizontally shift the image for one pixel at intervals of two scanning line. This can be easily executed at the step where the image signal is output from the gate array. As a result, the polarity of the image signal to the signal line is reversed for column direction and row direction. Therefore, the crosstalk can be more improved, and the alignment area can be made large because of the signal line unit array.

Though the present invention is explained by each embodiment referring to the drawing above, the present invention is not limited to each embodiment. The invention is carried out in the scope of the invention.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. A liquid crystal display method to display an image according to an image signal, comprising:

providing one display period and one non-display period of said image for 1 frame period;

detecting a maximum brightness level of said image signal in said 1 frame; and changing a ratio of the display period and the non-display period of said image in said 1 frame period according to said detected maximum brightness level, wherein when the maximum brightness level is high, the ratio is increased by lengthening the one display period and shortening the one non-display period, and when the maximum brightness level is low, the ratio is decreased by shortening the one display period and lengthening the one non-display period.

2. The liquid crystal display method according to claim 1, wherein said changing the ratio of the display period and the non-display period of said image in said 1 frame period includes changing a ratio of a lightening period and a no-lightening period of a light providing part, which lights a liquid crystal panel from a back side thereof.

3. The liquid crystal display method according to claim 1, wherein said changing the ratio of the display period and the non-display period of said image in said 1 frame period includes changing a transmittance or a no-transmittance of a shutter element provided on a light providing part or on a front side of a liquid crystal panel.

4. The liquid crystal display method according to claim 1, wherein said changing the ratio of the display period and the non-display period of said image in said 1 frame period includes changing a ratio of a period when the image display signal, which corresponds to said image signal, is supplied and a period when a black display signal is supplied to a liquid crystal panel.

5. The liquid crystal display method according to claim 1, further comprising:

deciding whether a frame image is a motion image or a still image based on the image signal and a synchronizing signal; and changing the ratio of the display period and the no-display period of said image based on said decision result.

6. The liquid crystal display method according to claim 1, wherein said changing the ratio of the display period and the no-display period of said image includes supplying said image signal of the 1 frame to a plurality of areas of a liquid crystal display device and changing the ratio of the display period and the no-display period of each of the plurality of areas of the liquid crystal display device.

7. The liquid crystal display method according to claim 1, wherein said detecting a maximum brightness level of said image signal includes supplying said image signal of the 1 frame to a plurality of areas of a liquid crystal display device and detecting a maximum brightness level of said image signal in each of said plurality of areas of the liquid crystal display device.

8. The liquid crystal display method according to claim 1, wherein a liquid crystal display device has a scanning line, a signal line, and a plurality of pixels, formed at an intersection of the signal line with the scanning line, are arranged in a matrix, said plurality of pixels having a first pixel which changes the transmitting light according to an image signal of a first polarity and shields a light based on an image signal of a second polarity and a second pixel which changes the transmitting light according to the image signal of the second polarity and shields a light based on the image signal of the first polarity, either one of said first pixel and said second pixel is arranged along a direction of said scanning line, said first pixel and said second pixel alternately are arranged along said signal line, and the image is written by applying the image signal of said first polarity to said first pixel, and applying the image signal of said second polarity to said second pixel.

9. The liquid crystal display method according to claim 8, wherein one of the image signal of said first polarity and the image signal of said second polarity is applied to said first pixel and said second pixel connected to said signal line at the same time.

10. The liquid crystal display method according to claim 9, wherein the image signal of said first polarity is a writing signal of said first pixel and an erase signal of said second pixel; and the image signal of said second polarity is an erase signal of said first pixel and a writing signal of the second said pixel.

11. The liquid crystal display method according to claim 1, further comprising:

changing a gray-scale of said image signal in said 1 frame based on said ratio of the display period and the non-display period of said image in said 1 frame period according to said image signal.

12. The liquid crystal display method according to claim 1, wherein said changing the ratio of the display period and the non-display period of said image in said 1 frame period includes changing a ratio of a lightening period and a no-lightening period of a light providing part, which lights a liquid crystal panel from a back side thereof.

13. The liquid crystal display method according to claim 11, wherein said changing the ratio of the display period and the non-display period of said image in said 1 frame period includes changing a transmittance or a no-transmittance of a shutter element provided on a light providing part or on a front side of a liquid crystal panel.

14. The liquid crystal display method according to claim 11, wherein said changing the ratio of the display period and the non-display period of said image in said 1 frame period includes changing a ratio of a period when the image display signal, which corresponds to said image signal, is supplied and a period when a black display signal is supplied to a liquid crystal panel.

15. The liquid crystal display method according to claim 11, wherein said changing the gray-scale of said image signal includes changing the gray-scale by the following formula:

$$Lout = L/(D/D\max)^{1/\gamma}$$

where, Lout: gray-scale after change,

L: gray-scale before change,

γ: gamma characteristic of image signal,

D=(display period)/(1 frame period), and

Dmax: maximum value of D.

16. The liquid crystal display method according to claim 1, wherein said changing the ratio of the display period and the non-display period of said image in said 1 frame period includes enlarging the ratio of the display period when the maximum brightness level becomes large.

* * * * *